US008347678B2

(12) United States Patent
Chong

(10) Patent No.: US 8,347,678 B2
(45) **Date of Patent: *Jan. 8, 2013**

(54) REKEYABLE LOCK CYLINDER ASSEMBLY

(75) Inventor: Gerald B. Chong, Rowland Heights, CA (US)

(73) Assignee: Newfrey, LLC, Newark, DE (US)

( * ) Notice: Subject to any disclaimer, the term of this patent is extended or adjusted under 35 U.S.C. 154(b) by 925 days.

This patent is subject to a terminal disclaimer.

(21) Appl. No.: 12/137,323

(22) Filed: Jun. 11, 2008

(65) Prior Publication Data

US 2008/0236224 A1 Oct. 2, 2008

Related U.S. Application Data

(60) Continuation-in-part of application No. 11/923,058, filed on Oct. 24, 2007, now Pat. No. 7,434,431, which is a continuation of application No. 11/465,921, filed on Aug. 21, 2006, now Pat. No. 7,322,219, which is a division of application No. 11/011,530, filed on Dec. 13, 2004, now Pat. No. 7,114,357, which is a continuation-in-part of application No. 10/256,066, filed on Sep. 26, 2002, now Pat. No. 6,860,131.

(51) Int. Cl.

| | |
|---|---|
| ***E05B 9/04*** | (2006.01) |
| ***E05B 9/10*** | (2006.01) |
| ***E05B 17/04*** | (2006.01) |
| ***E05B 27/04*** | (2006.01) |
| ***E05B 29/04*** | (2006.01) |

(52) U.S. Cl. ..... 70/383; 70/340; 70/341; 70/373; 70/379 R; 70/380; 70/384; 70/492; 70/493; 70/495; 70/DIG. 60

(58) Field of Classification Search ..... 70/373, 70/448, DIG. 60, 379 R, 379 A, 380, 382–385, 70/337–343, 368, 492, 493, 495
See application file for complete search history.

(56) References Cited

U.S. PATENT DOCUMENTS 1,565,556 A 12/1925 Fremon (Continued)

FOREIGN PATENT DOCUMENTS

CA 2333329 A1 2/1999

(Continued)

*Primary Examiner* — Lloyd Gall

(74) *Attorney, Agent, or Firm* — Richard J. Veltman, Esq.; Aust IP Law; Ronald K. Aust, Esq.

(57) ABSTRACT

A rekeyable lock cylinder assembly includes at least one lock cylinder and a mortise lock adapter. Each lock cylinder includes a cylinder body with a longitudinal axis. A locking bar is disposed in the cylinder body for movement transverse to, and rotationally about, the longitudinal axis. A plug assembly having a tool receiving aperture is disposed in the cylinder body and is rotatable about the longitudinal axis. A plurality of pins and a corresponding plurality of racks are disposed in the plug assembly. A first member is moveable in response to application of a force by a tool received through the aperture to simultaneously disengage all of the plurality of racks from the plurality of pins. The mortise lock adapter includes a housing configured for receiving the cylinder body of the lock cylinder. A mortise lock actuator is coupled to the plug assembly of the lock cylinder.

19 Claims, 58 Drawing Sheets

U.S. PATENT DOCUMENTS 1,610,224 A 12/1926 Dalboni et al.
1,845,867 A 2/1932 Ellingson
1,965,889 A 7/1934 Gerald
2,139,842 A 12/1938 Miller
2,194,469 A 3/1940 Fremon
2,232,017 A 2/1941 Wilder
2,370,862 A 3/1945 Johnstone
2,391,832 A 12/1945 Johnstone
2,895,323 A 7/1959 Ernest
2,977,786 A 4/1961 Marron
3,149,486 A 9/1964 Russell
3,183,692 A 5/1965 Check
3,190,093 A 6/1965 Schlage
3,261,189 A 7/1966 Best
3,293,892 A * 12/1966 Falk ..... 70/493
3,320,781 A 5/1967 Hill
3,431,757 A 3/1969 Hori
3,589,153 A 6/1971 Hill
3,667,262 A 6/1972 Hill
3,693,384 A 9/1972 Genakis
3,726,116 A 4/1973 Dimotta
3,728,880 A 4/1973 Falk
3,735,612 A 5/1973 Popovici
3,754,422 A 8/1973 Stackhouse
3,788,111 A * 1/1974 Parlier ..... 70/492
3,824,818 A * 7/1974 Neale ..... 70/358
3,910,083 A 10/1975 Burlingame
3,974,671 A 8/1976 Rossetti
3,990,282 A 11/1976 Sorum
3,999,413 A 12/1976 Raymond et al.
4,015,458 A 4/1977 Mercurio
4,031,729 A * 6/1977 Gretler ..... 70/380
4,069,694 A 1/1978 Raymond et al.
4,094,175 A 6/1978 Pechner
4,142,391 A 3/1979 Paig
4,195,504 A 4/1980 Foshee
4,320,639 A 3/1982 Kleefeldt et al.
4,372,139 A 2/1983 Laake
4,376,382 A 3/1983 Raymond et al.
4,377,940 A 3/1983 Hucknall
4,380,163 A 4/1983 Reder
4,393,673 A 7/1983 Widen
4,404,824 A 9/1983 Hennessy
4,412,437 A 11/1983 Smith
4,440,009 A 4/1984 Smith
4,689,978 A 9/1987 Drummond
4,712,399 A 12/1987 Mattossovich
4,712,401 A 12/1987 Monahan
4,712,402 A 12/1987 Monahan
4,723,427 A 2/1988 Oliver
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A 10/1990 Boag
4,996,856 A 3/1991 Lin et al.
5,000,019 A 3/1991 Foster
5,010,753 A 4/1991 Boris, Jr.
5,024,071 A 6/1991 Shafirkin
5,038,589 A 8/1991 Martin
5,044,180 A 9/1991 Lebrecht
5,044,185 A 9/1991 Green
5,050,412 A 9/1991 Errani
5,070,716 A 12/1991 Whorlow
5,076,081 A 12/1991 Boris, Jr.
5,088,305 A 2/1992 Myers
5,121,619 A 6/1992 Martin
5,174,136 A 12/1992 Thwing
5,209,088 A 5/1993 Vaks
5,211,044 A 5/1993 Kim
5,233,850 A 8/1993 Schroeder
5,291,767 A 3/1994 Weindorf, Jr. et al.
5,325,690 A 7/1994 Adler et al.
5,428,978 A 7/1995 Tsukano
5,431,034 A 7/1995 Fann et al.
5,479,801 A * 1/1996 Keller ..... 70/373
5,507,162 A 4/1996 Chhatwal
5,540,071 A 7/1996 Reikher
5,640,865 A 6/1997 Widen
5,666,835 A * 9/1997 Keller ..... 70/397
5,704,234 A 1/1998 Resch
5,718,136 A 2/1998 Aldieri et al.
5,752,400 A 5/1998 Kim
5,765,417 A 6/1998 Bolton
5,791,181 A 8/1998 Sperber et al.
5,884,512 A 3/1999 Wayne
5,921,122 A 7/1999 Lin
5,921,123 A 7/1999 Schwarzkopf et al.
5,956,986 A 9/1999 Vonlanthen
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A 9/2000 Loreti
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,523,382 B1 2/2003 Dimig et al.
6,532,782 B2 3/2003 Chiu
6,564,601 B2 5/2003 Hyatt, Jr.
6,776,017 B2 8/2004 Herdman
6,860,131 B2 * 3/2005 Armstrong et al. ..... 70/492
6,862,909 B2 3/2005 Armstrong et al.
6,871,520 B2 3/2005 Armstrong et al.
6,959,569 B2 11/2005 Strader et al.
6,968,717 B2 11/2005 Suzuki et al.
7,007,528 B2 3/2006 Chong et al.
7,059,160 B2 * 6/2006 Keller ..... 70/375
7,114,357 B2 * 10/2006 Armstrong et al. ..... 70/492
7,117,701 B2 10/2006 Armstrong et al.
7,213,429 B2 5/2007 Armstrong et al.
7,234,331 B2 6/2007 Armstrong et al.
7,308,811 B2 12/2007 Armstrong et al.
7,322,219 B2 * 1/2008 Armstrong et al. ..... 70/492
7,428,836 B2 * 9/2008 Yang et al. ..... 70/379 R
7,434,431 B2 * 10/2008 Armstrong et al. ..... 70/492
7,448,239 B1 11/2008 Huang et al.
7,448,240 B1 11/2008 Huang et al.
7,475,578 B2 * 1/2009 Brown et al. ..... 70/451
7,526,935 B2 5/2009 Huang et al.
7,634,931 B2 12/2009 Segien et al.
7,836,739 B2 11/2010 Huang et al.
7,874,191 B2 1/2011 Chiang et al.
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 4/2004 Takadama
2005/0132766 A1 6/2005 Milo
2005/0229656 A1 10/2005 Brown et al.
2006/0117822 A1 6/2006 Boesel et al.
2008/0314106 A1 12/2008 Mathachan
2010/0050717 A1 3/2010 Chiang et al.

FOREIGN PATENT DOCUMENTS

| | | | |
|---|---|---|---|
| DE | 19544840 | A1 | 6/1997 |
| EP | 0157967 | | 10/1985 |
| EP | 0210037 | | 1/1987 |
| EP | 0526904 | B1 | 6/1992 |
| EP | 0872615 | | 10/1998 |
| GB | 990987 | | 5/1965 |
| GB | 1554877 | | 10/1979 |
| JP | 54005360 | | 3/1979 |
| JP | 7197705 | A | 8/1995 |
| JP | 2001234648 | A | 8/2001 |
| WO | 9314290 | | 7/1993 |
| WO | 9736072 | | 10/1997 |

* cited by examiner

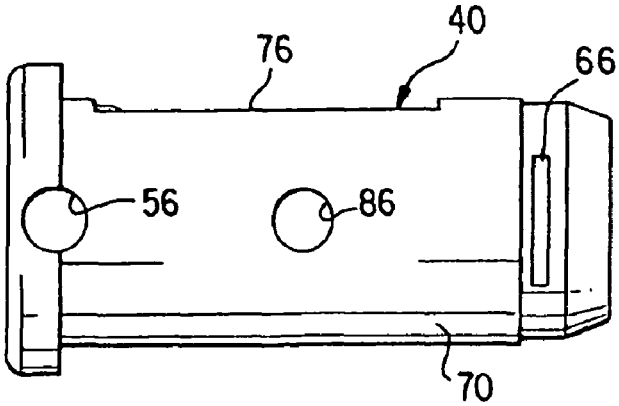
FIG. 16D
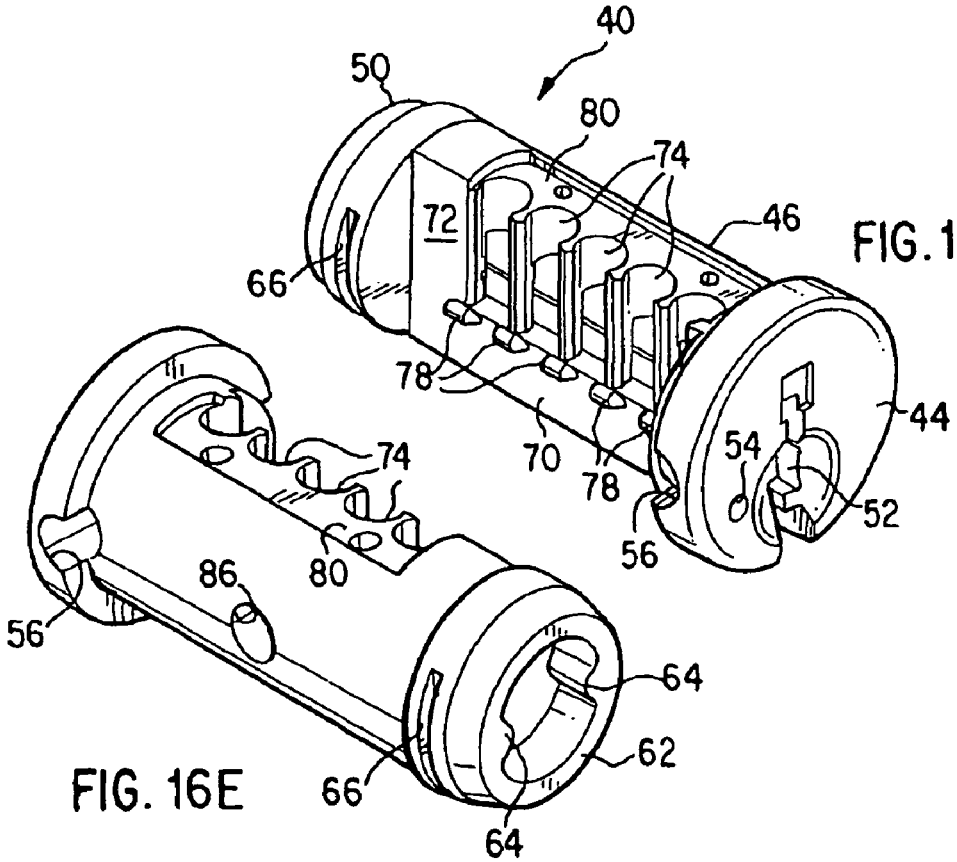
FIG. 16F
FIG. 16E

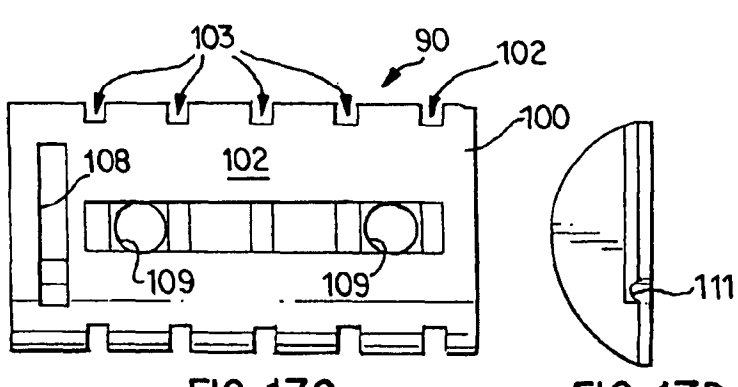
FIG.17A
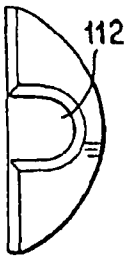
FIG.17B
FIG.17C
FIG.17D
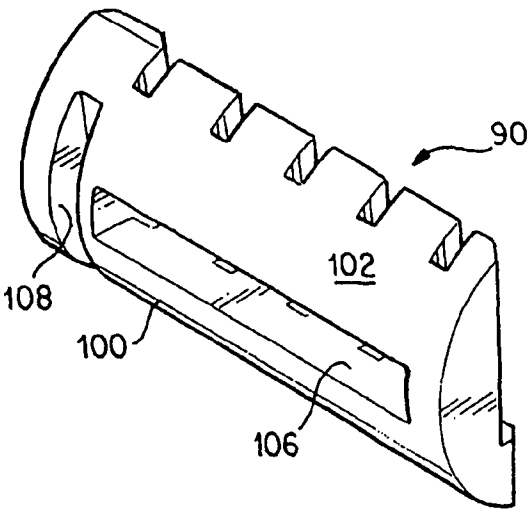
FIG.17E
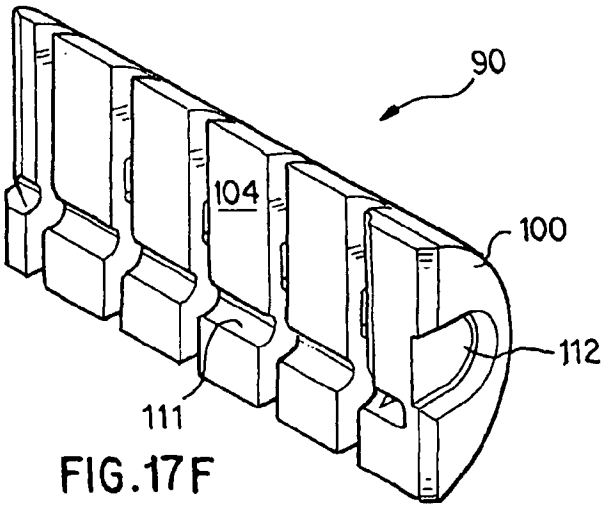
FIG.17F

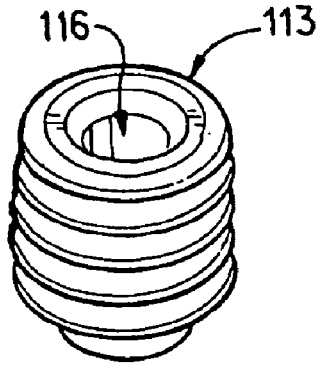
FIG. 20A
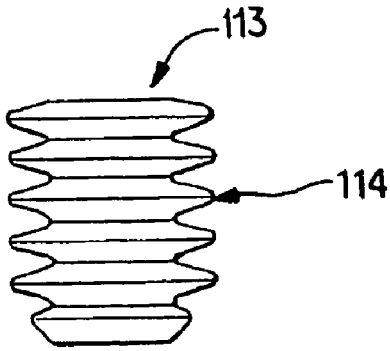
FIG. 20B
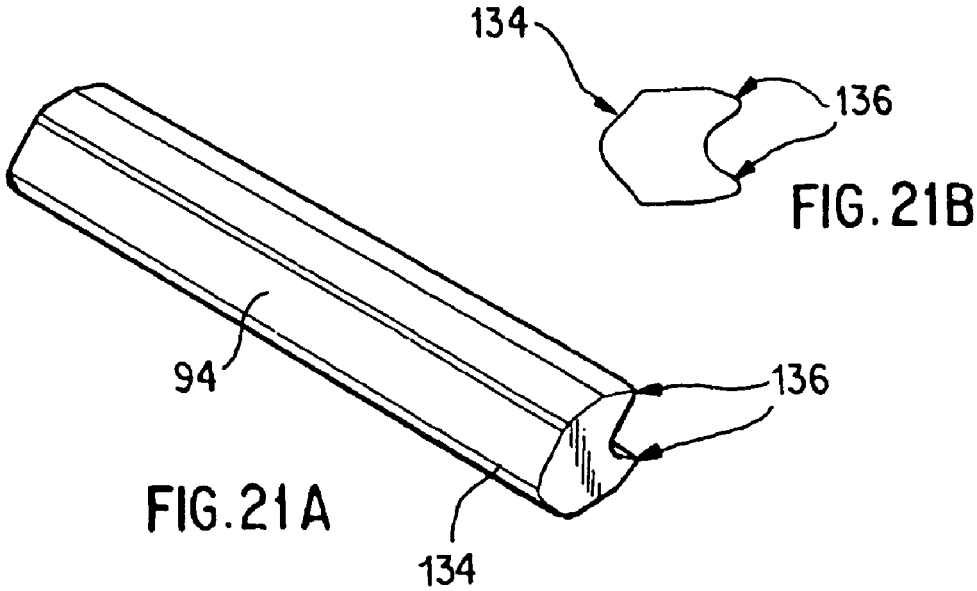
FIG. 21B
FIG. 21A

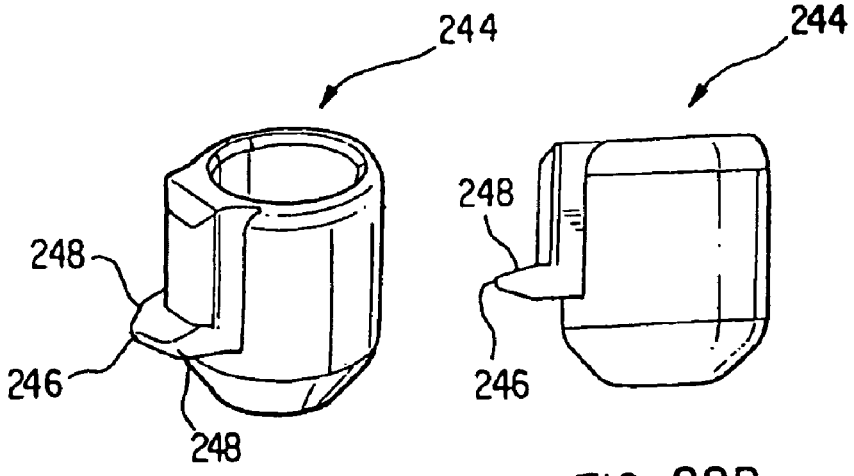
FIG. 28A
FIG. 28B
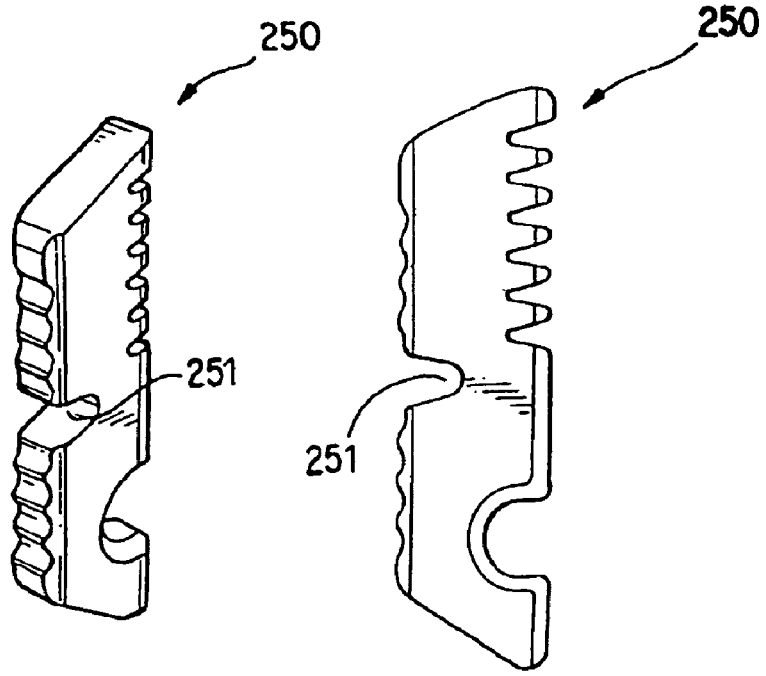
FIG. 29A
FIG. 29B

REKEYABLE LOCK CYLINDER ASSEMBLY

CROSS-REFERENCE TO RELATED APPLICATIONS

This is a continuation-in-part of U.S. patent application Ser. No. 11/923,058, filed Oct. 24, 2007, now U.S. Pat. No. 7,434,431, which is a continuation of U.S. patent application Ser. No. 11/465,921, filed Aug. 21, 2006, now U.S. Pat. No. 7,322,219, which is a division of U.S. patent application Ser. No. 11/011,530 filed Dec. 13, 2004, now U.S. Pat. No. 7,114,357, which is a continuation-in-part of U.S. patent application Ser. No. 10/256,066 filed Sep. 26, 2002, now U.S. Pat. No. 6,860,131.

BACKGROUND OF THE INVENTION

1. Field of the Invention

The present invention relates generally to a rekeyable lock cylinder assembly, and more particularly, the invention relates to a rekeyable lock cylinder assembly for use with a mortise lock.

2. Description of the Related Art

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

In addition, in one form of a master keying system, such as a pin and tumbler design, master shims are positioned in between the pins of the lock cylinder to establish a shear line for the master key and user keys. In such a previous design, for example, the consumer replaces the pins and adds shims to convert the lock cylinder to a master keyed cylinder. This may be a complicated process for some consumers.

A lock cylinder may be adapted for use with a mortise lock mechanism. A mortise lock mechanism typically includes a case provided with a lock cylinder opening adjacent to a bolt. A lock cylinder assembly of similar cross-section is positioned in the lock cylinder opening. The lock cylinder assembly has a bolt-actuating cam operated by a cylinder plug mounted in the lock cylinder. The actuating cam engages the bolt of the mortise lock mechanism to operate the bolt. In a configuration commonly referred to as a "profile" cylinder lock, for example, two lock cylinders with corresponding cylinder plugs may be located at opposite sides of the door, and the actuating cam may be operated by key actuation of either of the two cylinder plugs.

SUMMARY OF THE INVENTION

The present invention, in one form thereof, is directed to a rekeyable lock cylinder assembly that includes at least one lock cylinder and a mortise lock adapter. Each lock cylinder includes a cylinder body with a longitudinal axis. A locking bar is disposed in the cylinder body for movement transverse to, and rotationally about, the longitudinal axis. A plug assembly is disposed in the cylinder body and is rotatable about the longitudinal axis. The plug assembly has a lock face with a tool receiving aperture, and has a proximal end and a distal end separated from the proximal end with the proximal end being located nearest to the lock face. A plurality of pins and a corresponding plurality of racks are disposed in the plug assembly. The plurality of racks is configured to be selectively engaged with the plurality of pins. A first member is coupled to the plurality of racks. The first member is moveable in response to application of a force by a tool received through the tool receiving aperture. The first member is configured to simultaneously disengage all of the plurality of racks from the plurality of pins in response to the movement of the first member. The mortise lock adapter includes a housing configured with a longitudinal cavity for receiving the cylinder body of the lock cylinder. The lock cylinder is mounted to the housing. A mortise lock actuator is coupled to the plug assembly of the lock cylinder.

The present invention, in another form thereof, is directed to a rekeyable lock cylinder assembly including a first lock cylinder, a second lock cylinder, and a mortise lock adapter. Each of the first lock cylinder and the second lock cylinder includes a cylinder body with a longitudinal axis, and a plug assembly disposed in the cylinder body and being rotatable about the longitudinal axis. The plug assembly has a lock face, and has a proximal end and a distal end separated from the proximal end with the proximal end being located nearest to the lock face. The mortise lock adapter includes a housing having a longitudinal cavity defining a co-axis of rotation for the first lock cylinder and the second lock cylinder. Each of the first lock cylinder and the second lock cylinder is received in the longitudinal cavity. The housing has a cam slot located in a central portion of the housing. A mortise lock actuator has a split driver and a cam. The cam has an opening that receives the split driver in a sliding relationship. The split driver has a first drive portion rotatably coupled to a second drive portion. The split driver is positioned to be engaged by the first lock cylinder and the second lock cylinder. The cam is configured to extend through the cam slot of the housing. Direct radial support of the cam relative to the co-axis of rotation is provided only by the split driver. Direct radial support of the split driver relative to the co-axis of rotation is provided only by the distal end of the plug assembly of the first lock cylinder and the distal end of the plug assembly of the second lock cylinder.

The present invention, in another form thereof, is directed to a rekeyable lock cylinder assembly including a first lock cylinder, a second lock cylinder, and a mortise lock adapter. Each of the first lock cylinder and the second lock cylinder includes a cylinder body with a longitudinal axis, and a plug assembly disposed in the cylinder body and being rotatable about the longitudinal axis. The plug assembly has a lock face, and has a proximal end and a distal end separated from the proximal end with the proximal end being located nearest to the lock face. The mortise lock adapter includes a housing having a longitudinal cavity, and a first end spaced apart from a second end along the longitudinal cavity. The housing has a longitudinal slot parallel to and adjacent to the longitudinal cavity. The housing has a cam slot that extends perpendicular to the extent of the longitudinal cavity and the longitudinal slot in a central portion of the housing. A mortise lock actuator includes a split driver and a cam. The cam has an opening that receives the split driver in a sliding relationship. The split driver has a first drive portion rotatably coupled to a second drive portion. The cam is inserted through the cam slot of the housing into the longitudinal cavity. The split driver is inserted along the longitudinal cavity into the opening in the cam. An elongate member is configured for insertion into the longitudinal slot of the housing. The elongate member has mounting features for engaging the first lock cylinder and the second lock cylinder.

The present invention, in still another form thereof, is directed to a method for assembling a rekeyable lock cylinder assembly. The method includes providing a housing that has a first end spaced apart from a second end along a longitudinal cavity, the housing having a longitudinal slot parallel to and adjacent to the longitudinal cavity, and the housing having a cam slot that extends perpendicular to the extent of the longitudinal cavity and the longitudinal slot in a central portion of the housing; inserting a cam through the cam slot of the housing into the longitudinal cavity, the cam having an opening; inserting a split driver along the longitudinal cavity into the opening in the cam, the opening receiving the split driver in a sliding relationship, the split driver having a first drive portion rotatably coupled to a second drive portion; inserting a cylinder body of a first lock cylinder into the longitudinal cavity of the housing at the first end; inserting a cylinder body of a second lock cylinder into the longitudinal cavity of the housing at the second end, the longitudinal cavity of the housing defining a co-axis of rotation of the plug assembly of the first lock cylinder and the plug assembly of the second lock cylinder; engaging a distal end of a plug assembly of the first lock cylinder with the first drive portion of the split driver; engaging a distal end of a plug assembly of the second lock cylinder with the second drive portion of the split driver; inserting an elongate member into the longitudinal slot of the housing, the elongate member having mounting features for engaging the first lock cylinder and the second lock cylinder to hold the first lock cylinder and the second lock cylinder in the housing at a fixed location when the elongate member is inserted into the longitudinal slot; and fastening the elongate member to the housing.

Other features and advantages will become apparent from the following description when viewed in accordance with the accompanying drawings and appended claims.

BRIEF DESCRIPTION OF THE DRAWINGS

FIGS. 16A-16F are various views of the cylinder plug body for use in the present invention.

FIGS. 17A-17F are various view of the carrier for use in the present invention.

FIGS. 20A-20B are views of a pin for use in the present invention.

FIGS. 21A-21B are views of a locking bar for use in the present invention.

FIGS. 28A-28B are views of an alternative embodiment of the pin.

FIGS. 29A-29B are views of an alternative embodiment of the rack.

DETAILED DESCRIPTION OF THE DRAWINGS

Figure 1:
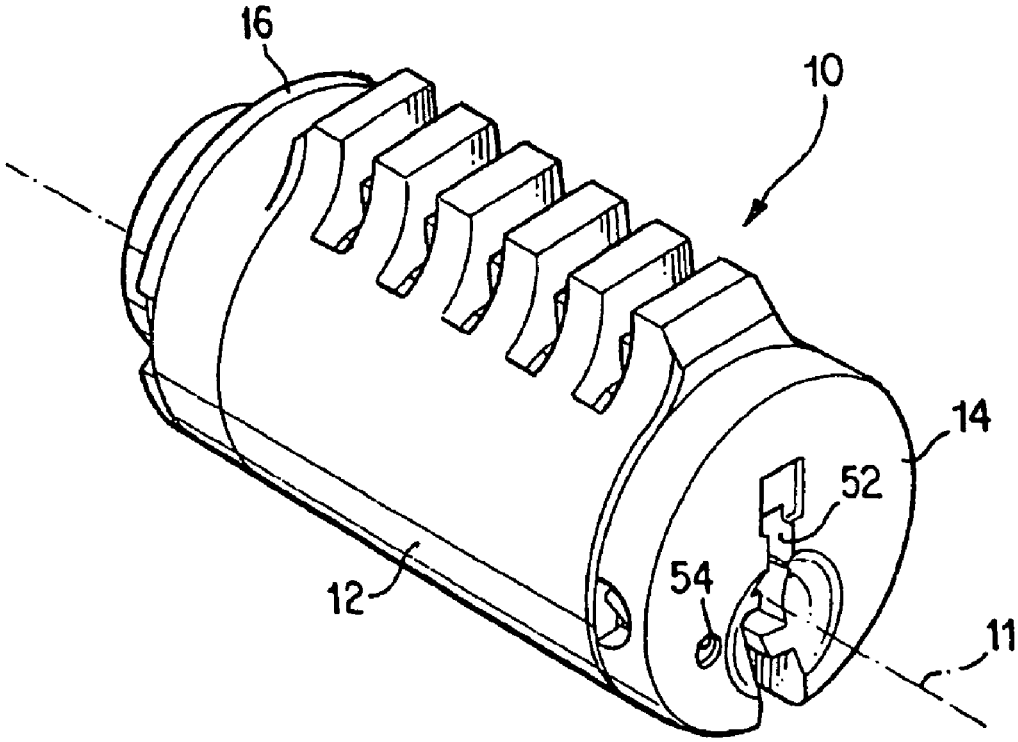
FIG. 1 illustrates a lock cylinder according to the present invention.
Figure 2:
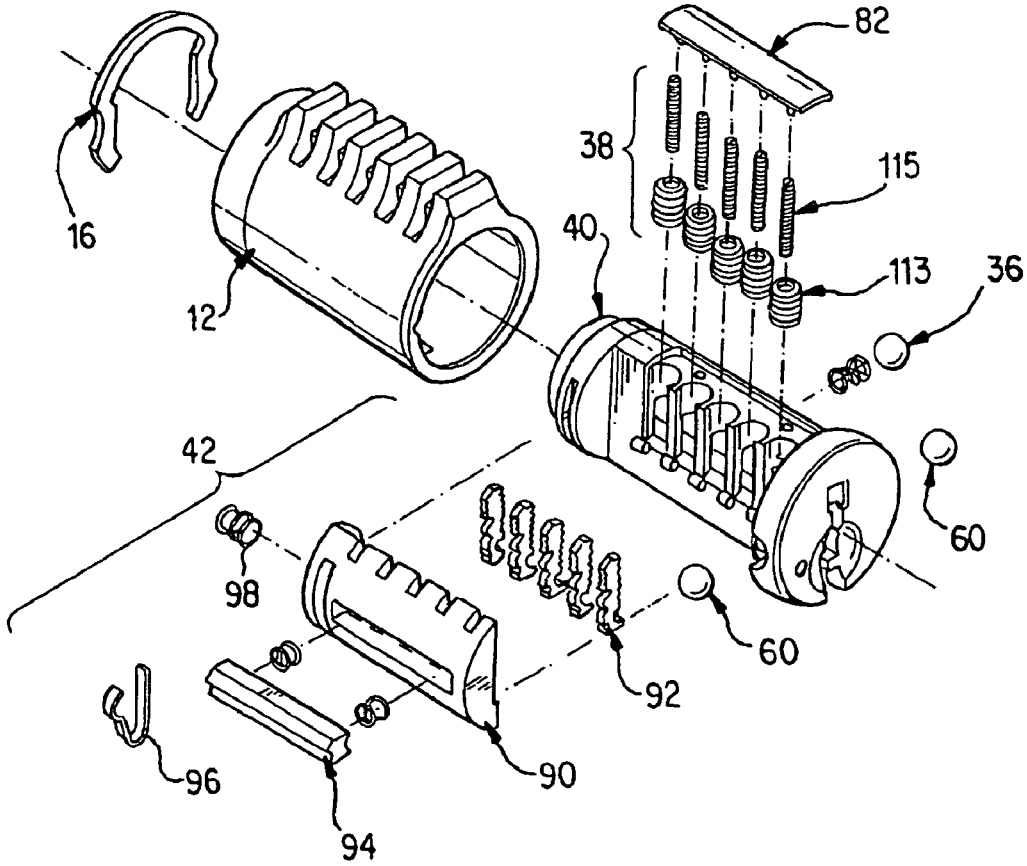
FIG. 2 is an exploded view of the lock cylinder of FIG. 1.

A lock cylinder 10 according to the present invention is illustrated in FIG. 1-2. The lock cylinder 10 includes a longitudinal axis 11, a lock cylinder body 12, a plug assembly 14 and a retainer 16. In FIG. 1, the plug assembly 14 is in the home position relative to the cylinder body 12.

The lock cylinder body 12, as seen in FIGS. 15A-15E, includes a generally cylindrical body 20 having a front end 22, a back end 24 and a cylinder wall 26 defining an interior surface 28. The cylinder wall 26 includes an interior, locking bar-engaging groove 29 and a pair of detent recesses 30, 32. The generally V-shaped locking bar-engaging groove 29 extends longitudinally along a portion of the cylinder body 12 from the front end 22. The first detent recess 30 is disposed at the back end 24 and extends to a first depth. The second detent recess 32 is disposed adjacent the first detent recess 30 and extends to a lesser depth. A detent bore 34 extends radially through the cylinder wall 26 for receiving a detent ball 36 (FIG. 2).

The plug assembly 14 includes a plug body 40, a carrier sub-assembly 42 and a plurality of spring-loaded pins 38 (FIGS. 2 and 20A-20B). The plug body 40, illustrated in FIGS. 16A-16*f*, includes a plug face 44, an intermediate portion 46 and a drive portion 50. The plug face 44 defines a keyway opening 52, a rekeying tool opening 54 and a pair of channels 56 extending radially outwardly for receiving anti-drilling ball bearings 60 (FIG. 2). The drive portion 50 includes an annular wall 62 with a pair of opposed projections 64 extending radially inwardly to drive a spindle or torque blade (neither shown). The drive portion 50 further includes a pair of slots 66 formed in its perimeter for receiving the retainer 16 to retain the plug body 40 in the cylinder body 12.

The intermediate portion 46 includes a main portion 70 formed as a cylinder section and having a first longitudinal planar surface 72 and a plurality of channels 74 for receiving the spring-loaded pins 38. The channels 74 extend transversely to the longitudinal axis of the plug body 40 and parallel to the planar surface 72. A second planar surface 76 extends perpendicular to the first planar surface 72 and defines a recess 80 for receiving a retaining cap 82 (FIGS. 2 and 22A-22D). The channels 74 extend from the second planar surface 76 partially through the plug body 40, with the sidewalls of the channels open to the first planar surface 72. The first planar surface 72 further includes a plurality of bullet-shaped, rack-engaging features 78. A bore 86 for receiving a spring-loaded detent ball 36 (FIG. 2) extends radially inwardly from opposite the first planar surface 72.

Figure 6:
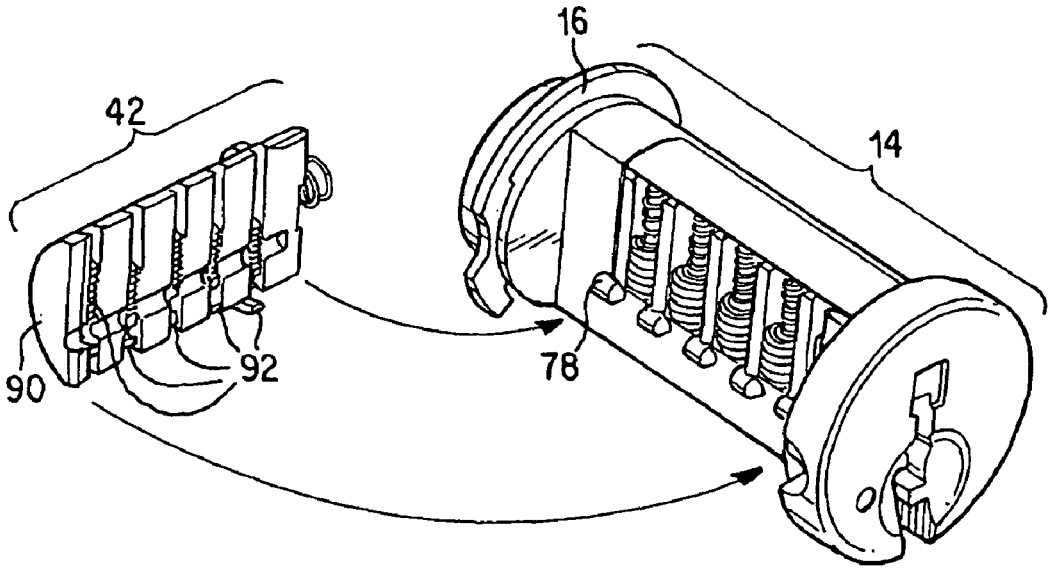
FIG. 6 is a partially exploded view of the plug assembly of FIG. 3.
Figure 10:
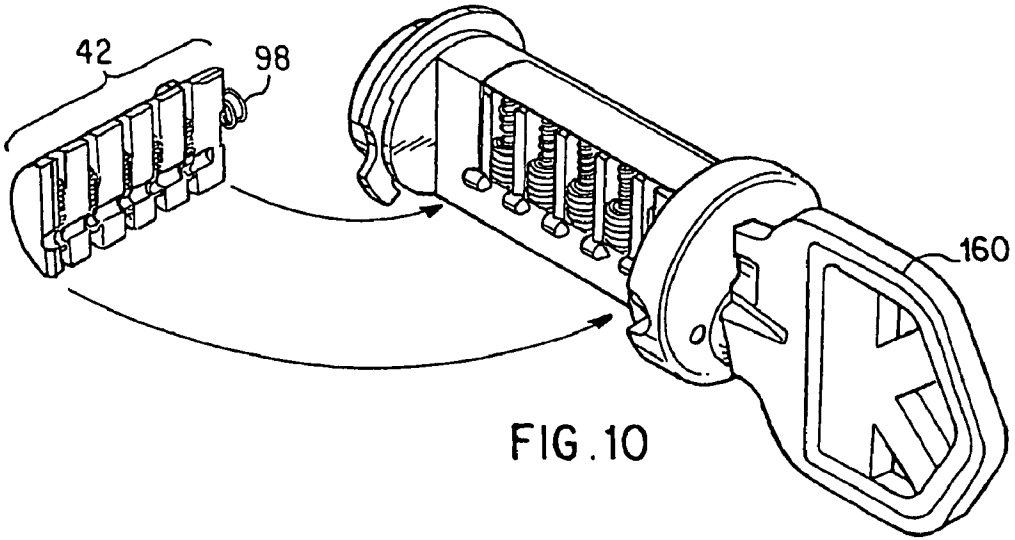
FIG. 10 is a partially broken away side view of the plug assembly of FIG. 8.
Figure 11:
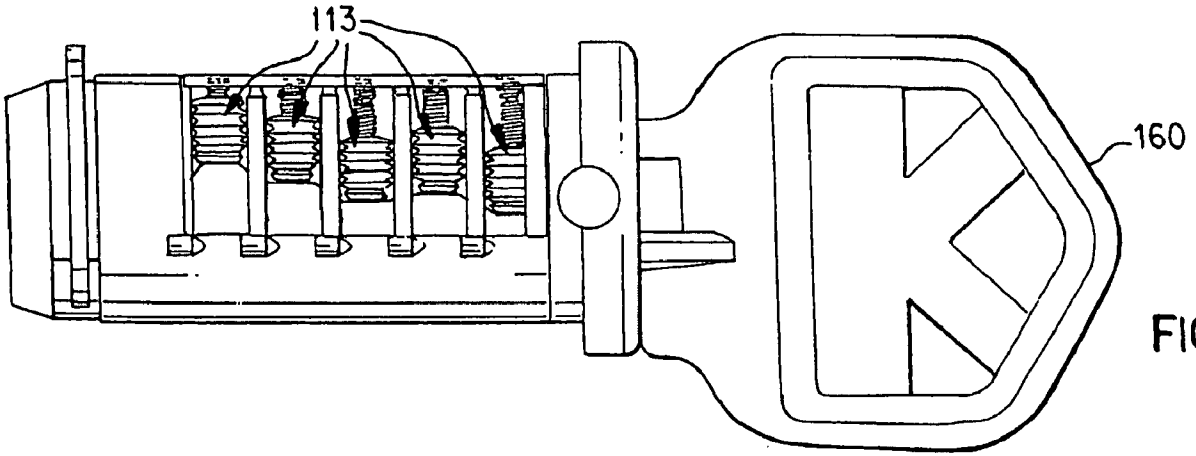
FIG. 11 is a partially exploded view of the plug assembly of FIG. 8.
Figure 18A:
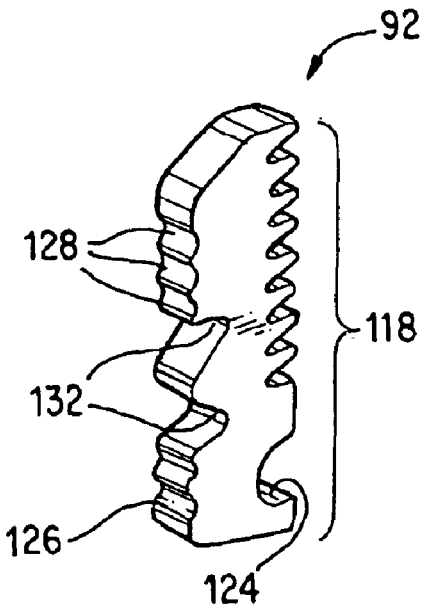
FIGS. 18A-18B are views of a rack for use in the present invention.
Figure 18B:
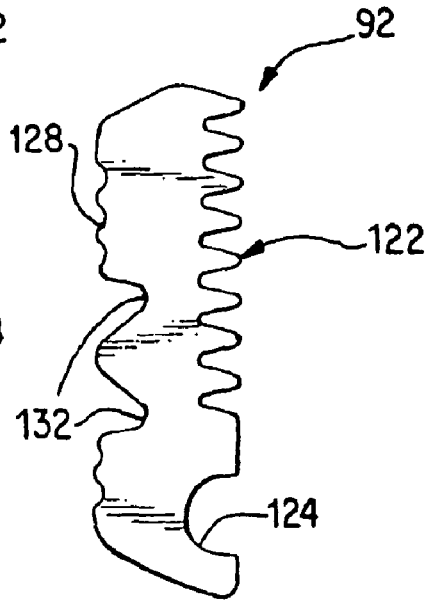
Figure 19A:
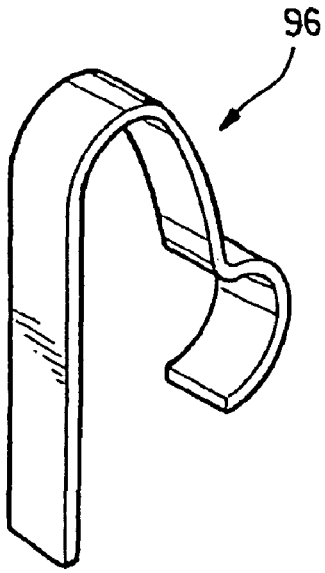
FIGS. 19A-19B are views of a spring catch for use in the present invention.
Figure 19B:
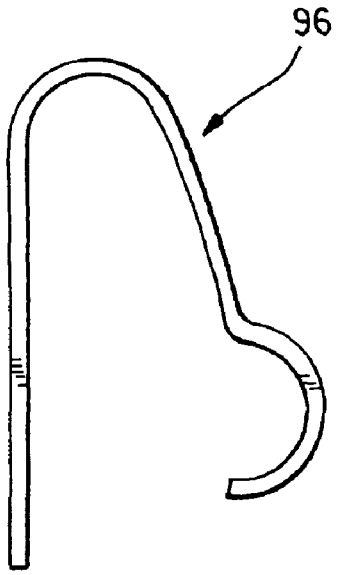
Figure 22A:
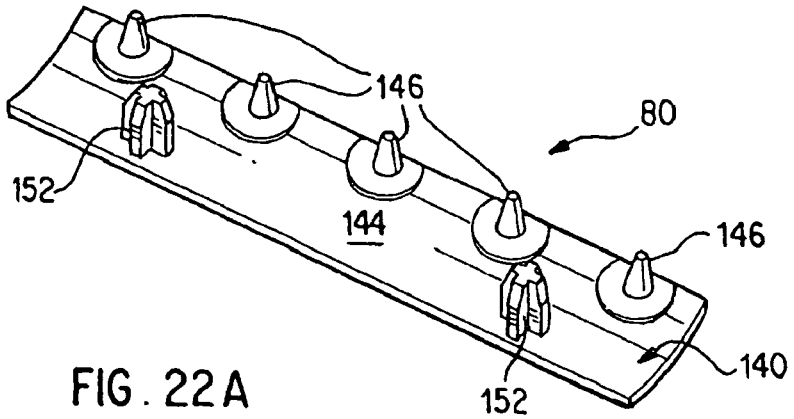
FIGS. 22A-22D are views of a spring retaining cap for use in the present invention.
Figure 22B:
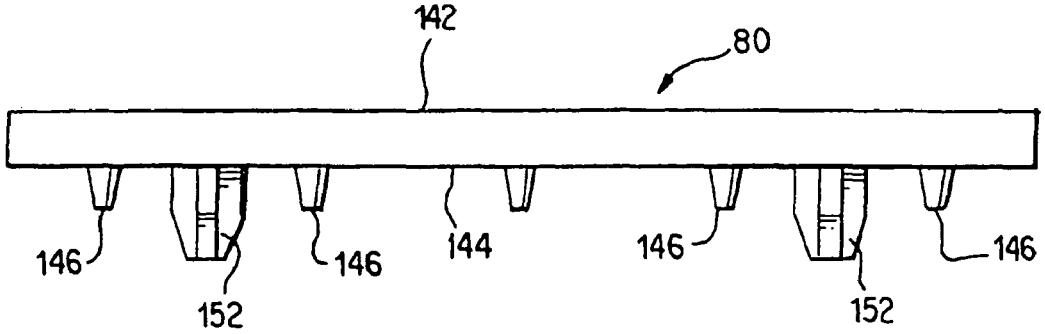
Figure 22C:
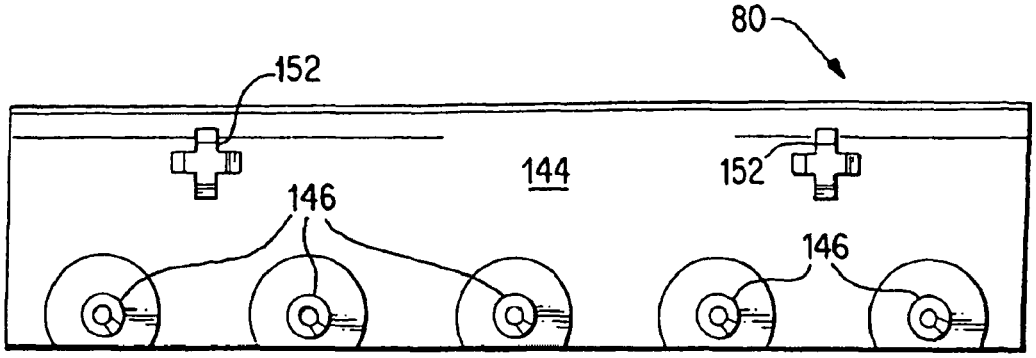
Figure 22D:
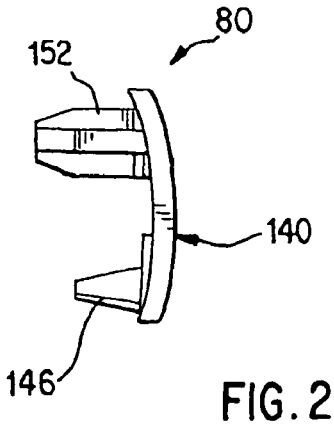

The carrier sub-assembly 42 (FIGS. 2, 6 and 10) includes a carrier 90 (FIGS. 17A-17E), a plurality of racks 92 (FIGS. 18A-18B), a spring catch 96 (FIGS. 19A-19B), a spring-loaded locking bar 94 (FIGS. 21A-21B), and a return spring 98 (FIG. 2). The carrier 90 includes a body 100 in the form of a cylinder section that is complementary to the main portion 70 of the plug body 40, such that the carrier 90 and the main portion 70 combine to form a cylinder that fits inside the lock cylinder body 12. The carrier 90 includes a curved surface 102 and a flat surface 104. The curved surface 102 includes a locking bar recess 106 and a spring catch recess 108. The locking bar recess 106 further includes a pair of return spring-receiving bores 109 (FIG. 17C) for receiving the locking bar return springs. The flat surface 104 includes a plurality of parallel rack-receiving slots 103 extending perpendicular to the longitudinal axis of the carrier. A semi-circular groove 111 extends along the flat surface 104 parallel to the longitudinal axis of the carrier 90. The back end of the carrier 90 includes a recess 112 for receiving the return spring 98.

Figure 7:
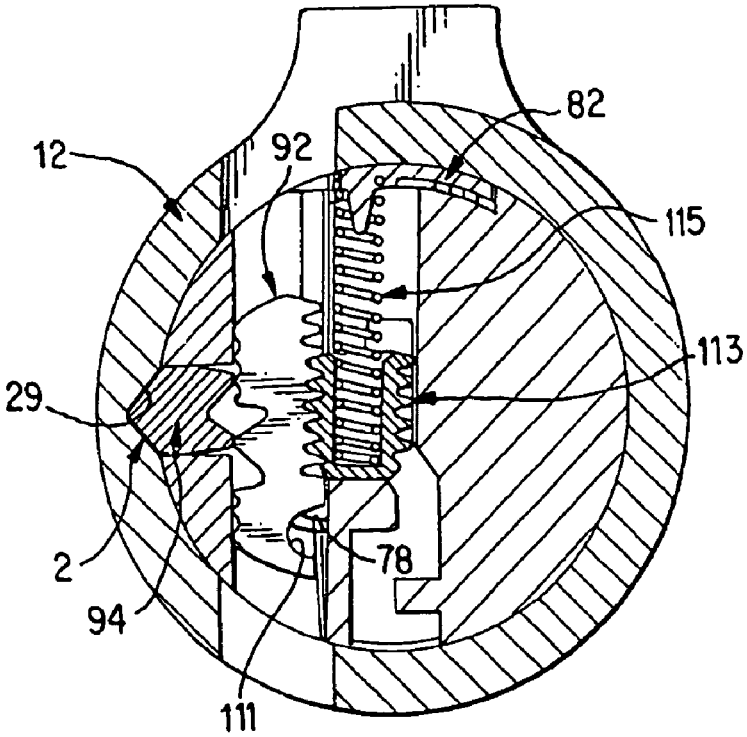
FIG. 7 is a section view through the plug assembly of FIG. 3 and a cylinder body, the section being taken transversely at one of the pins and illustrating the positioning of the pin, a rack, and the locking bar relative to each other and the cylinder body in a locked configuration.
Figure 12:
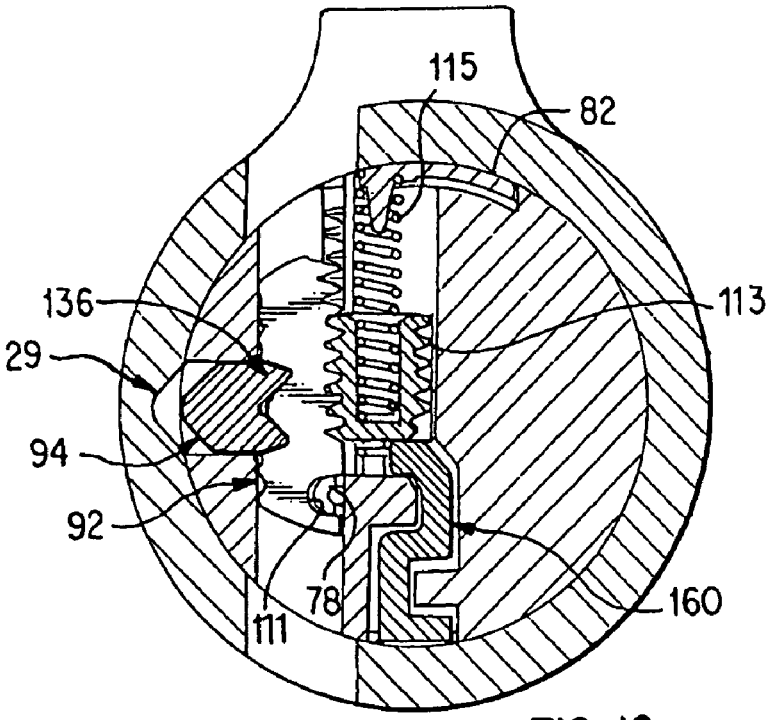
FIG. 12 is a section view through the plug assembly of FIG. 8 and a cylinder body, the section being taken transversely at one of the pins and illustrating the positioning of the pin, the rack, and the locking bar relative to each other and the cylinder body in an unlocked configuration.

Each spring-loaded pin 38 includes a pin 113 and a biasing spring 115. The pins 113, illustrated in FIGS. 20A-20B, are generally cylindrical with annular gear teeth 114 and a central longitudinal bore 116 for receiving biasing springs 115 (FIG. 2). The racks 92, illustrated in FIGS. 18A-18B, include a pin-engaging surface 118 having a plurality of gear teeth 122 configured to engage the annular gear teeth 114 on the pins 113, as illustrated in FIGS. 7 and 12, and a semi-circular recess 124 for engaging the bullet-shaped, rack-engaging features 78 on the planar surface 72, as illustrated in FIG. 12. The racks 92 further include a second surface 126 that includes a plurality of anti-pick grooves 128 and a pair of locking bar-engaging grooves 132.

The spring-loaded locking bar 94, illustrated in FIGS. 21A-22B, is sized and configured to fit in the locking bar recess 106 in the carrier 90 and includes a triangular edge 134 configured to fit in the V-shaped locking bar-engaging groove 29. Opposite the triangular edge 134, the locking bar 94 includes a pair of longitudinally extending gear teeth 136 configured to engage the locking bar-engaging grooves 132 formed in the racks 92, as illustrated in FIG. 12.

The spring-retaining cap 82, illustrated in FIGS. 22A-22D, includes a curvilinear portion 140 having an upper surface 142 and a lower surface 144. The thickness of the curvilinear portion 140 is set to allow the curvilinear portion 140 to fit in the recess 80 with the upper surface 142 flush with the intermediate portion 46 of the plug body 40, as illustrated in FIGS. 7 and 12. A plurality of spring alignment tips 146 extend from the lower surface 144 to engage the springs 115. In addition, a pair of cap retaining tips 152 extend from the lower surface 144 to engage alignment openings 154 formed in the plug body 40 (FIGS. 16E-16F).

Figure 3:
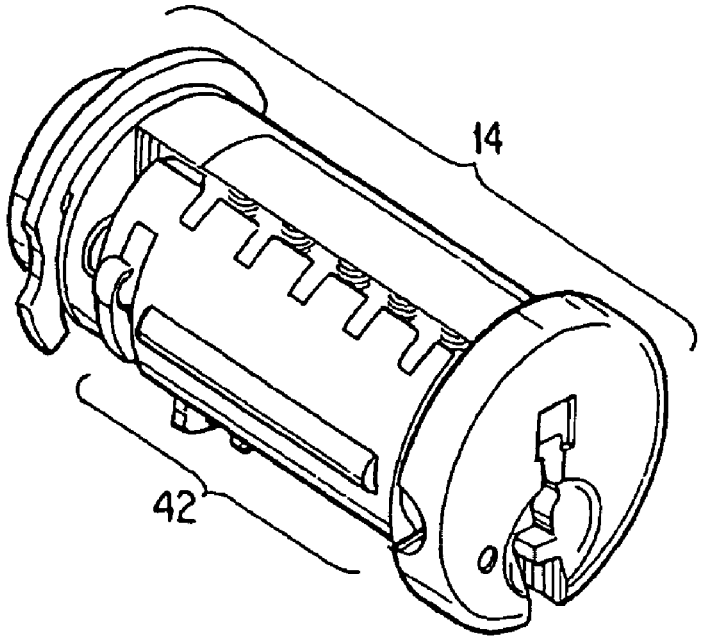
FIG. 3 is a perspective view of a plug assembly illustrating a carrier sub-assembly with a locking bar disposed in a locking position to lock the plug assembly in a lock cylinder body.

To assemble the lock cylinder 10, the pins 113 and spring 115 are disposed in the channels 74 of the plug body 40. The spring-retaining cap 82 is placed in the recess 80, with the cap retaining tips 152 disposed in the alignment openings 154 and the spring alignment tips 146 engaged with the springs 115. The carrier sub-assembly 42 is assembled by placing the racks 92 into the slots 103 and the spring-loaded locking bar 94 into the locking bar recess 106, with the gear teeth 136 engaging the locking bar-engaging grooves 132 formed in the racks 92. The spring catch 96 is disposed in the spring catch recess 108 of the carrier 90. A valid key 160 is inserted into the keyway 52, the return spring 98 is compressed into the return spring recess 112, and the carrier sub-assembly is placed adjacent the plug body 40, as illustrated in FIG. 3. The plug assembly 14 is placed in the lock cylinder body 12 and the retainer 16 is disposed in the slots 66 formed in the plug body 40 to retain the plug assembly 14 in the cylinder body 12. The lock cylinder 10 is now keyed to the valid key 160.

Figure 4:
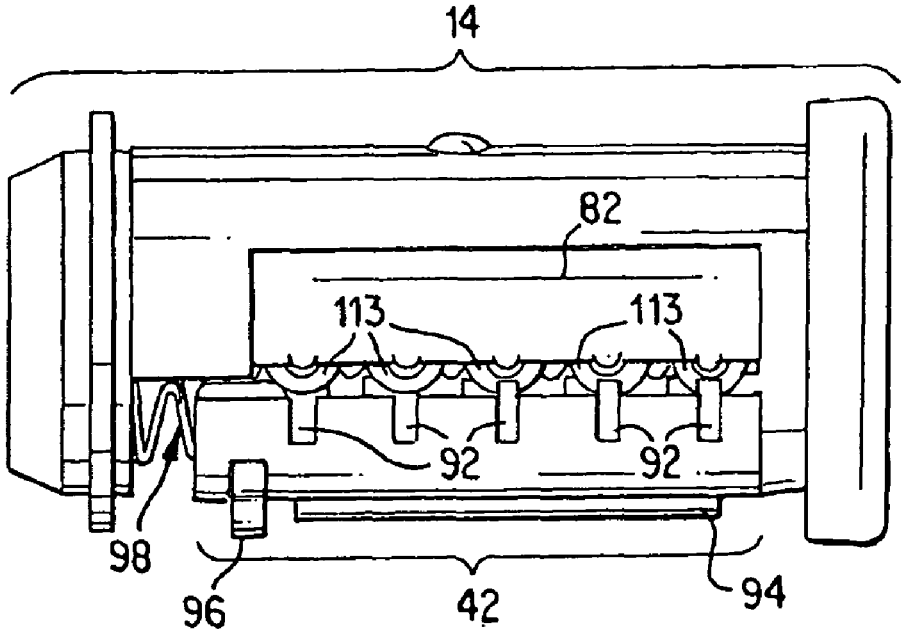
FIG. 4 is a top plan view of the plug assembly of FIG. 3.
Figure 5:
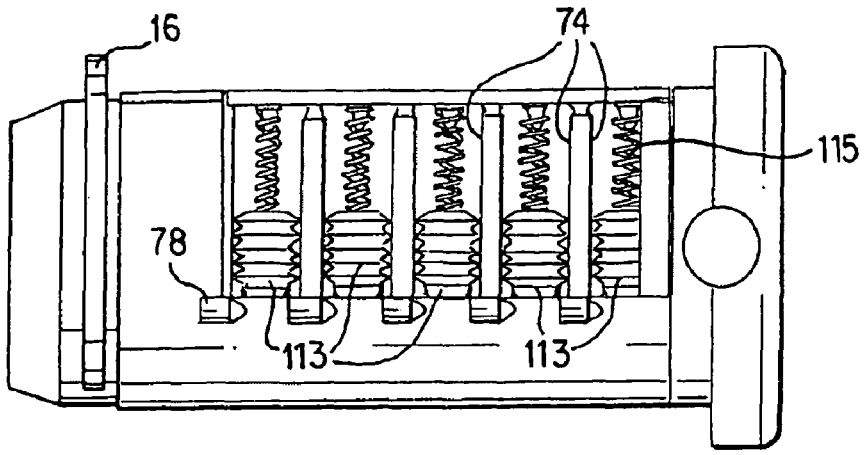
FIG. 5 is a partially broken away side view of the plug assembly of FIG. 3.

The properly keyed lock cylinder 10, without the key 160 inserted, is illustrated in FIGS. 4-7. The pins 113 are biased to the bottom of the channels 74 and, based on the cut of the key 160, the racks 92 are disposed at various positions in the slots 103 of the carrier 90. In this configuration, the locking bar 94 extends from the carrier 90 to engage the groove 29 in the cylinder body 12 to prevent the plug assembly 14 from rotating in the cylinder body 12 and the racks 92 engage the pins 113, as illustrated in FIG. 4. In addition, the bullet-shaped features 78 are misaligned with the groove 111 in the racks 92 and therefore interfere with movement of the racks 92 parallel to the longitudinal axis of the lock cylinder 10, preventing the lock cylinder 10 from being rekeyed.

Figure 8:
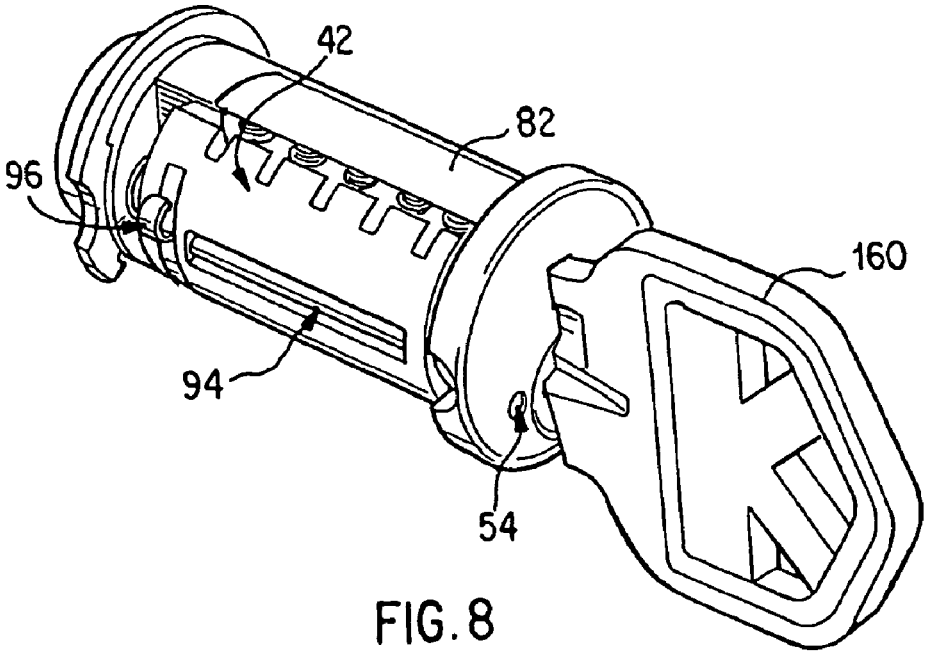
FIG. 8 is a perspective view of the plug assembly of FIG. 3 with a valid key inserted therein and illustrating the locking bar disposed in an unlocking position to allow the plug assembly to rotate in the lock cylinder body.
Figure 9:
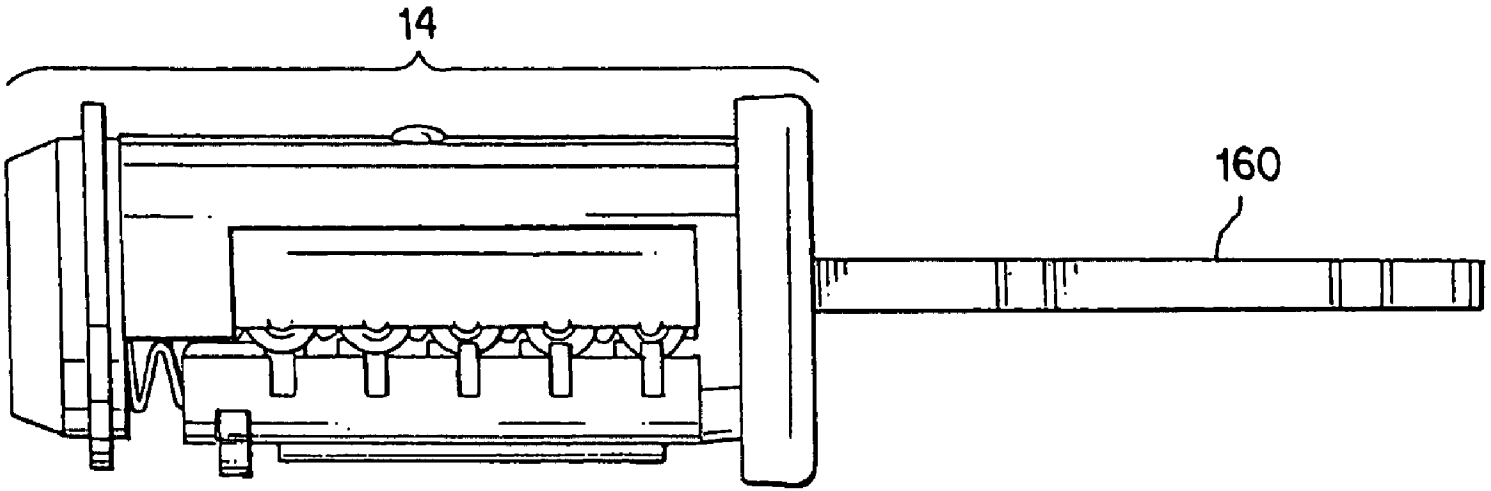
FIG. 9 is a top plan view of the plug assembly of FIG. 8.

The internal configuration of a lock cylinder 10 with the valid key 160 inserted therein at the home position is illustrated in FIGS. 8-12. In this configuration, the locking bar 94 is free to cam out of the groove 29 in the cylinder body 12, as depicted in FIGS. 8, 9 and 12. The bits of the key 160 lift the pins 113 in the channels 74 and thereby re-position the racks 92 in the slots 103. When repositioned, the racks 92 are disposed to align the locking bar-engaging grooves 132 with the extended gear teeth 136 on the locking bar 94. The locking bar 94 is free to cam out of the groove 29 as the key 160 is rotated. At the same time, the bullet-shaped features 78 are aligned with the groove 111 in the racks 92, as illustrated in FIG. 12, allowing the racks 92, and the carrier 90, to move parallel to the longitudinal axis of the lock cylinder 10.

Figure 13:
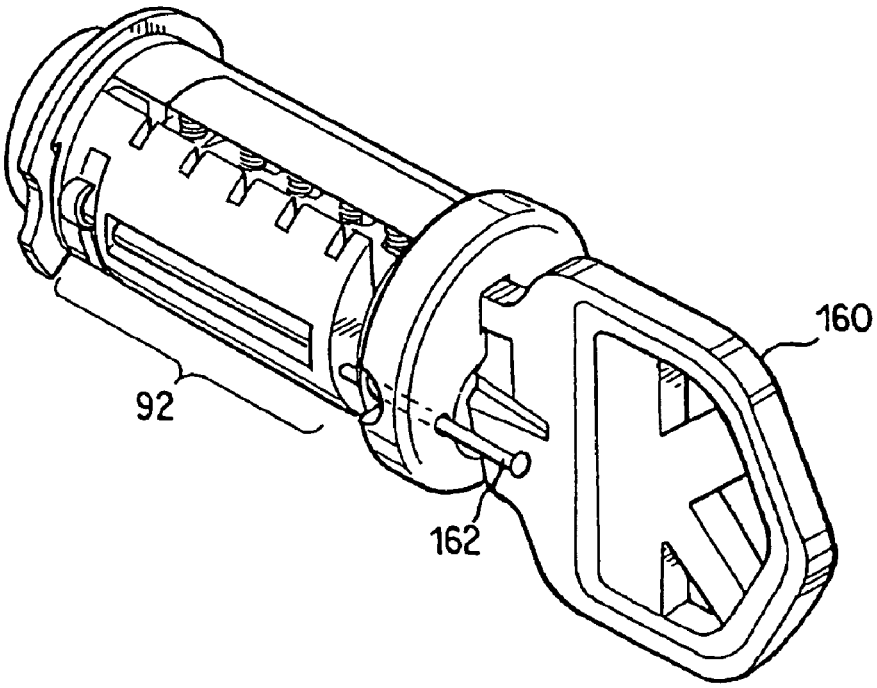
FIG. 13 is a perspective view similar to FIG. 8 but with the carrier assembly moved axially to a rekeying position.
Figure 14:
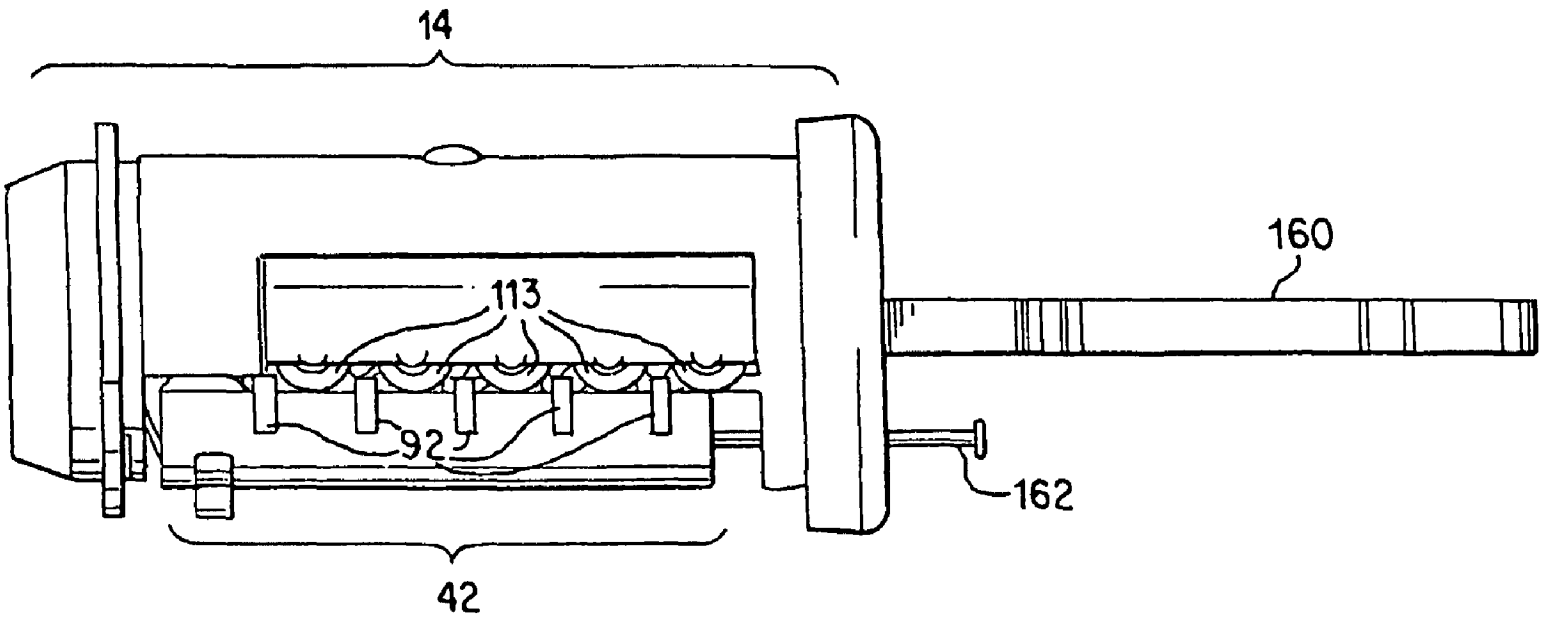
FIG. 14 is a top plan view of the plug assembly of FIG. 13.
Figure 15C:
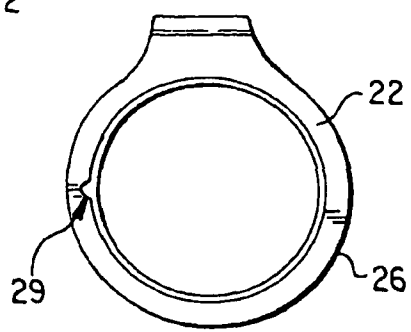
FIGS. 15A-15E are various views of a cylinder body for use in the present invention.
Figure 15B:
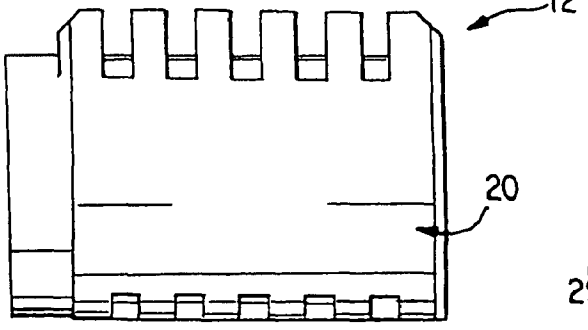
Figure 15A:
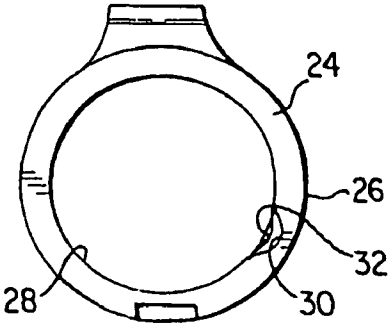
Figure 15E:
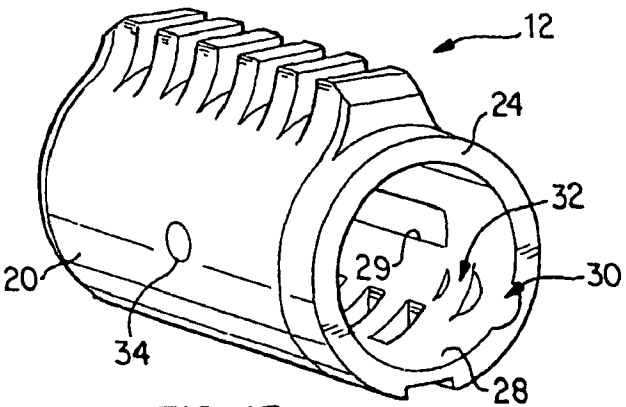
Figure 15D:
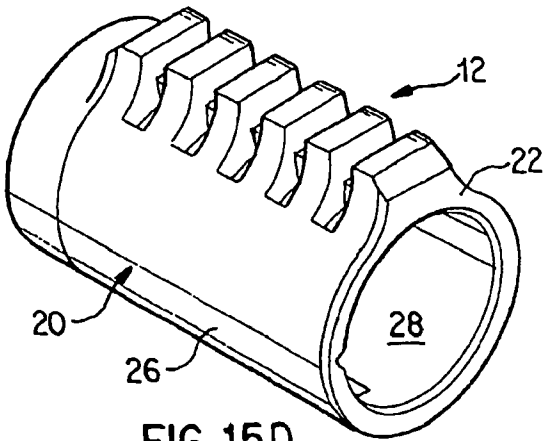
Figure 16A:
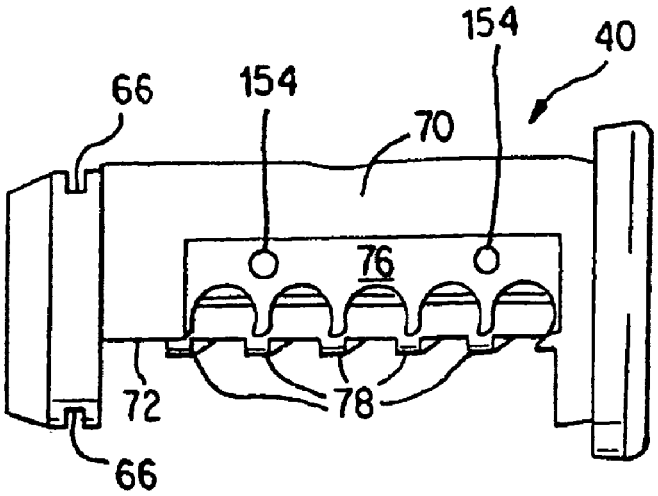
Figure 16B:
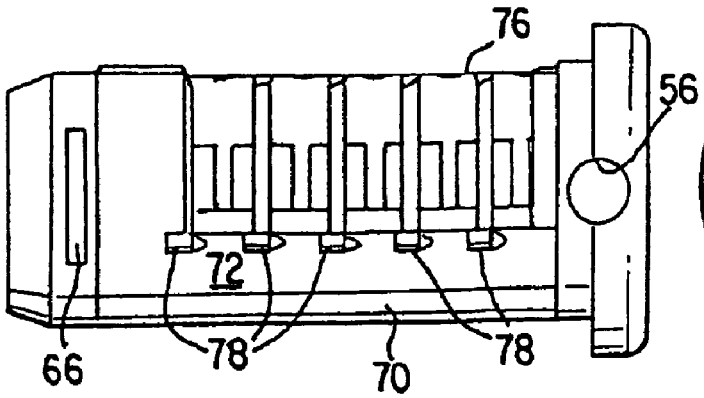
Figure 16C:
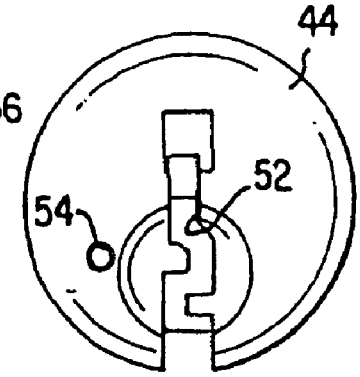

To rekey the lock cylinder 10, the valid key 160 is inserted into the keyway 52, as illustrated in FIGS. 13-14 and rotated approximately 45° counterclockwise from the home position until the spring catch 96 moves into the second detent recess 32 formed in the cylinder body 12. A paperclip or other pointed device 162 is inserted into the tool opening 54 and pushed against the carrier 90 to move the carrier 90 parallel to the longitudinal axis of the lock cylinder 10 until the spring catch 96 moves into the first detent recess 30, and the pointed device 162 is removed. With the spring catch 96 disposed in the first detent recess 30, the racks 92 are disengaged from the pins 113, as illustrated in FIG. 14. The valid key 160 is removed and a second valid key is inserted and rotated clockwise to release the spring catch 96. As the spring catch 96 leaves the first detent recess 30, the carrier 90 is biased toward the plug face 44 by the return spring 98, causing the racks 92 to re-engage the pins 113. At this point, the lock cylinder 10 is keyed to the second valid key and the first valid key 160 no longer operates the lock cylinder 10. The lock cylinder 10 can be rekeyed to fit a third valid key by replacing the first and second valid keys in the above procedures with the second and third valid keys, respectively.

Figure 23:
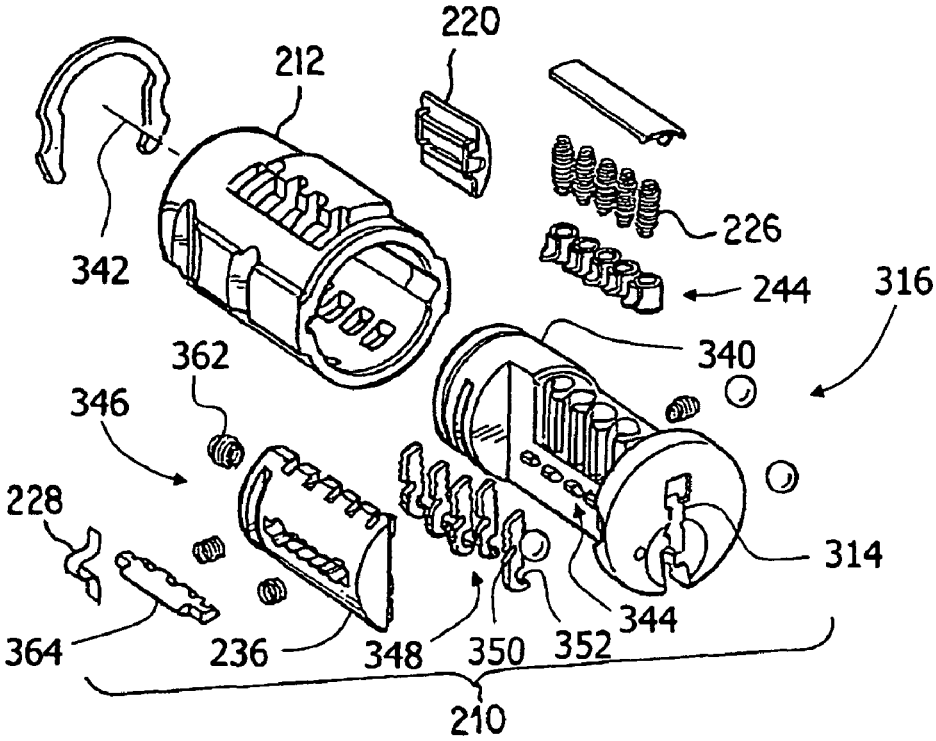
FIG. 23 is an exploded perspective view of an alternative embodiment of the invention.
Figure 24A:
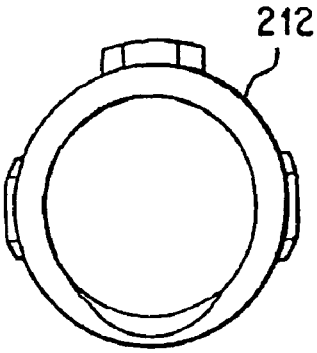
FIGS. 24A-24E are views of an alternative embodiment of the lock cylinder housing.
Figure 24B:
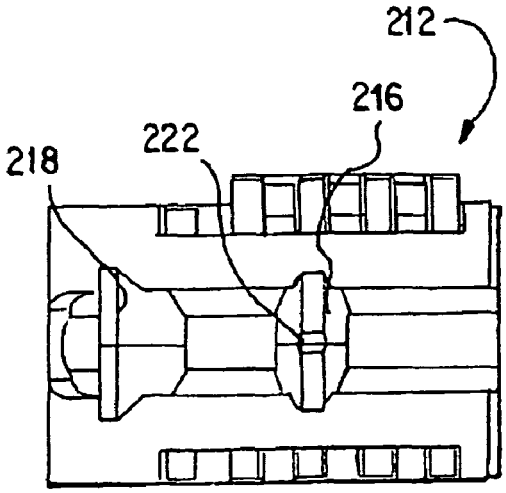
Figure 24C:
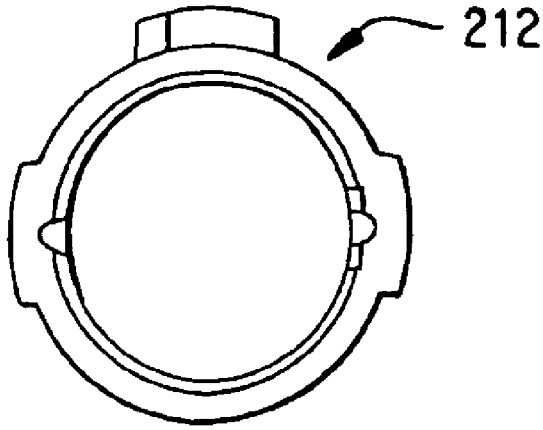
Figure 24D:
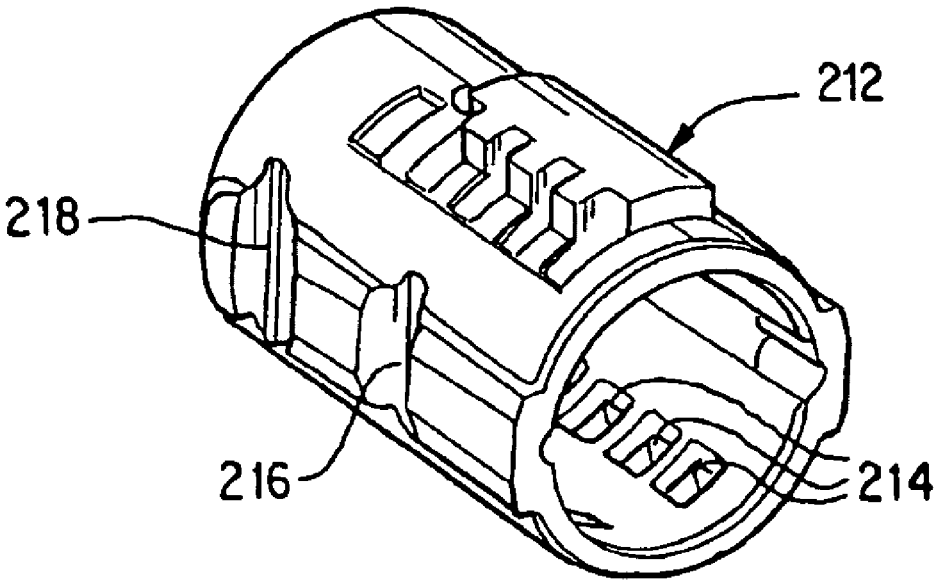
Figure 24E:
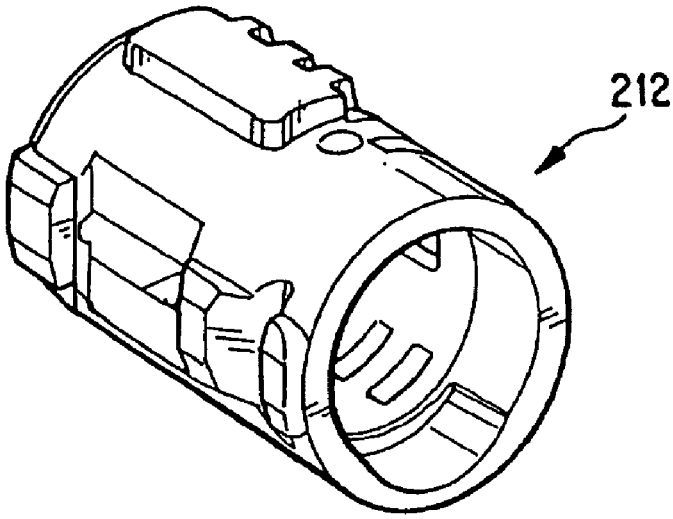

An alternative embodiment 210 of the invention is illustrated in FIGS. 23-29. The alternative embodiment includes the same components, as illustrated in FIG. 23, but several of the components have been modified. Functionally, both embodiments are the same.

The modified housing 212, illustrated in FIGS. 23 and 24, includes a plurality of apertures 214 running longitudinally along the bottom thereof and a pair of vertical grooves 216, 218 formed in the housing sidewall. In addition, the sidewall includes a removable side panel 220. The rectangular holes 214 are positioned to allow the use of a manual override tool. The center groove 216 includes an aperture 222 extending through the housing sidewall. The aperture 222 allows a user to move the locking bar during a manual override operation. The side panel 220 provides access for performing certain operations while changing the master key of the lock cylinder.

Figure 25:
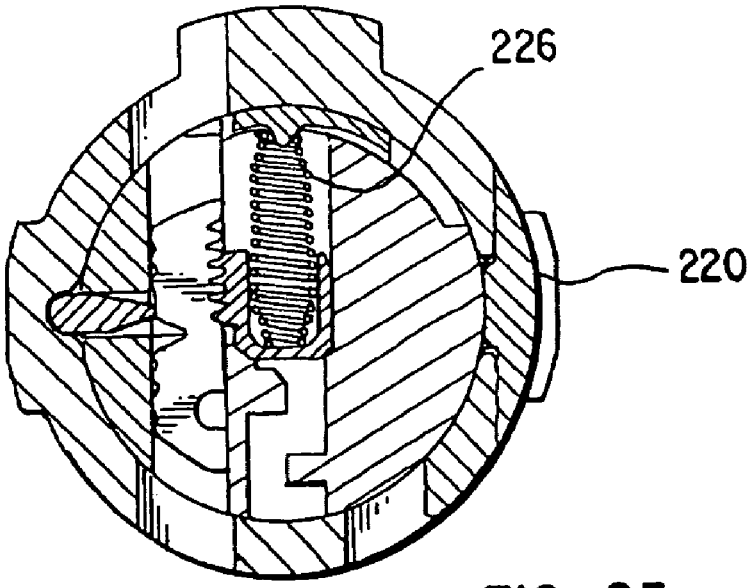
FIG. 25 is a transverse section view taken through an alternative embodiment of the present invention.

The modified pin biasing springs 226, illustrated in FIGS. 23 and 25, include a non-constant diameter, with the last few coils at each end of the springs 226 having a reduced diameter. The tapering allows for a greater spring force in a smaller physical height.

Figure 26A:
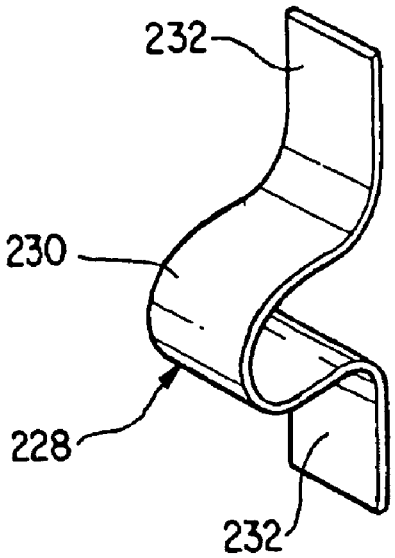
FIGS. 26A-26B are views of an alternative embodiment of the spring catch.
Figure 26B:
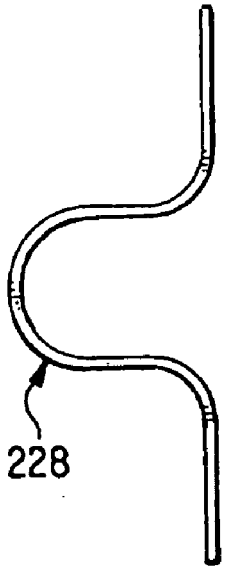
Figure 27A:
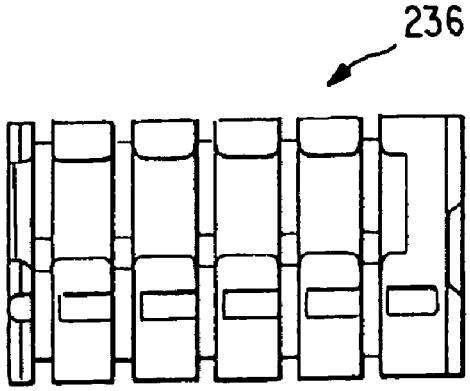
FIGS. 27A-27E are views of an alternative embodiment of the carrier.
Figure 27B:
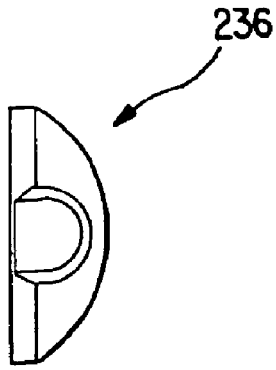
Figure 27C:
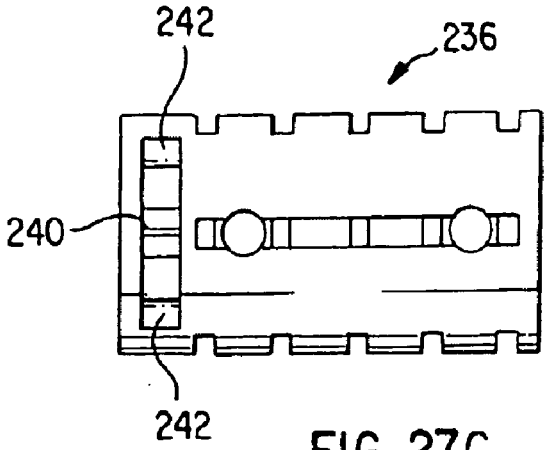
Figure 27D:
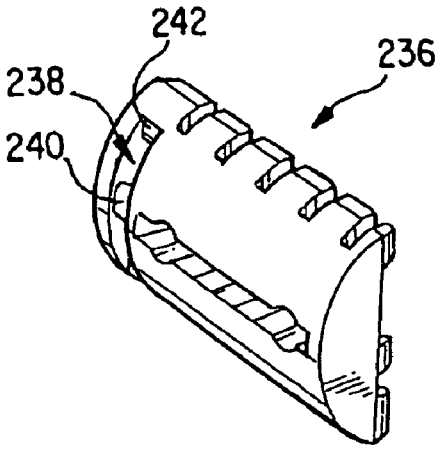
Figure 27E:
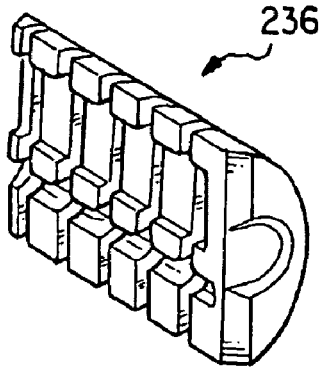

The modified spring catch 228, illustrated in FIGS. 23 and 26, includes a central U-shaped portion 230 and a pair of arms 232 extending from the U-shaped portion 230.

The modified carrier 236, illustrated in FIGS. 23 and 27, includes means for retaining the spring catch 228 in the spring catch recess 238. In the illustrated embodiment, this includes a guide 240 projecting outwardly in the center of the spring catch recess 238 and a pair of anchors 242 radially offset from the guide 240. The guide 240 prevents the spring catch 228 from moving transversely in the recess 238 while permitting it to move radially outwardly to engage the housing 12, 212 as described above. The anchors 242 engage the arms 232 of the spring catch 228 and prevent the arms 232 from splaying outwardly, thereby directing the compressive force of the spring catch 228 to extend the U-shaped portion 230 outwardly to engage the housing 12, 212.

The modified pins 244, illustrated in FIGS. 23 and 28, include a single gear tooth 246 instead of the plurality of gear teeth of the pins 113 described above. The single gear tooth 246, which preferably includes beveled sides 248, provides for a smoother engagement with the racks during the rekeying process.

The modified racks 250, illustrated in FIGS. 23 and 29, include beveled gear teeth to improve the engagement with the pins during the rekeying process. In addition, the pair of locking bar-engaging grooves 132 in the racks 92 are replaced with a single locking bar-engaging groove 251.

Figure 30A:
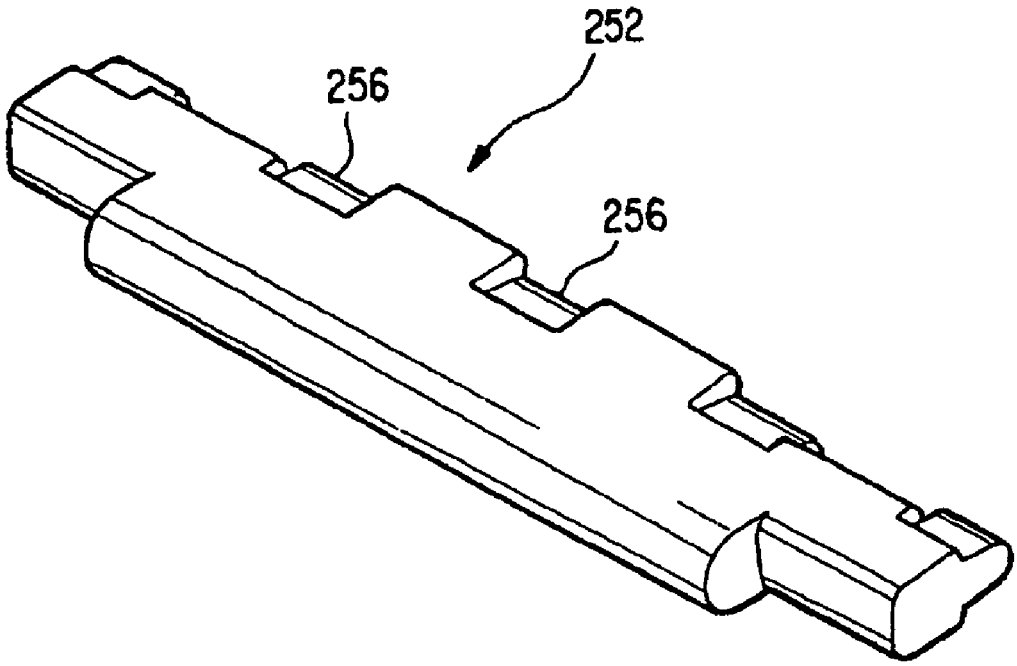
FIGS. 30A-30B are views of an alternative embodiment of the locking bar.
Figure 30B:
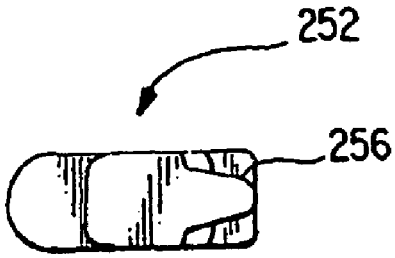

The modified locking bar 252, illustrated in FIGS. 23 and 30, is thinner than locking bar 94 and replaces the pair of gear teeth 136 with a single gear tooth 256 and rounds out the triangular edge 134. The thinner design reduces any rocking of the locking bar 252 in the locking bar recess 106.

A kit may be provided that facilitates the rekeying of a lock cylinder with respect to a master keying system. The kit may include, for example, a rack carrier moving tool 162, such as an elongate pin, e.g., a straightened portion of a paper clip, for moving a rack carrier, such as for example carrier 236, in a longitudinal direction of the lock cylinder, such as that of the lock cylinder 210 of the alternative embodiment. Alternatively, the rack carrier moving tool 162 may be provided by the user.

Figure 31:
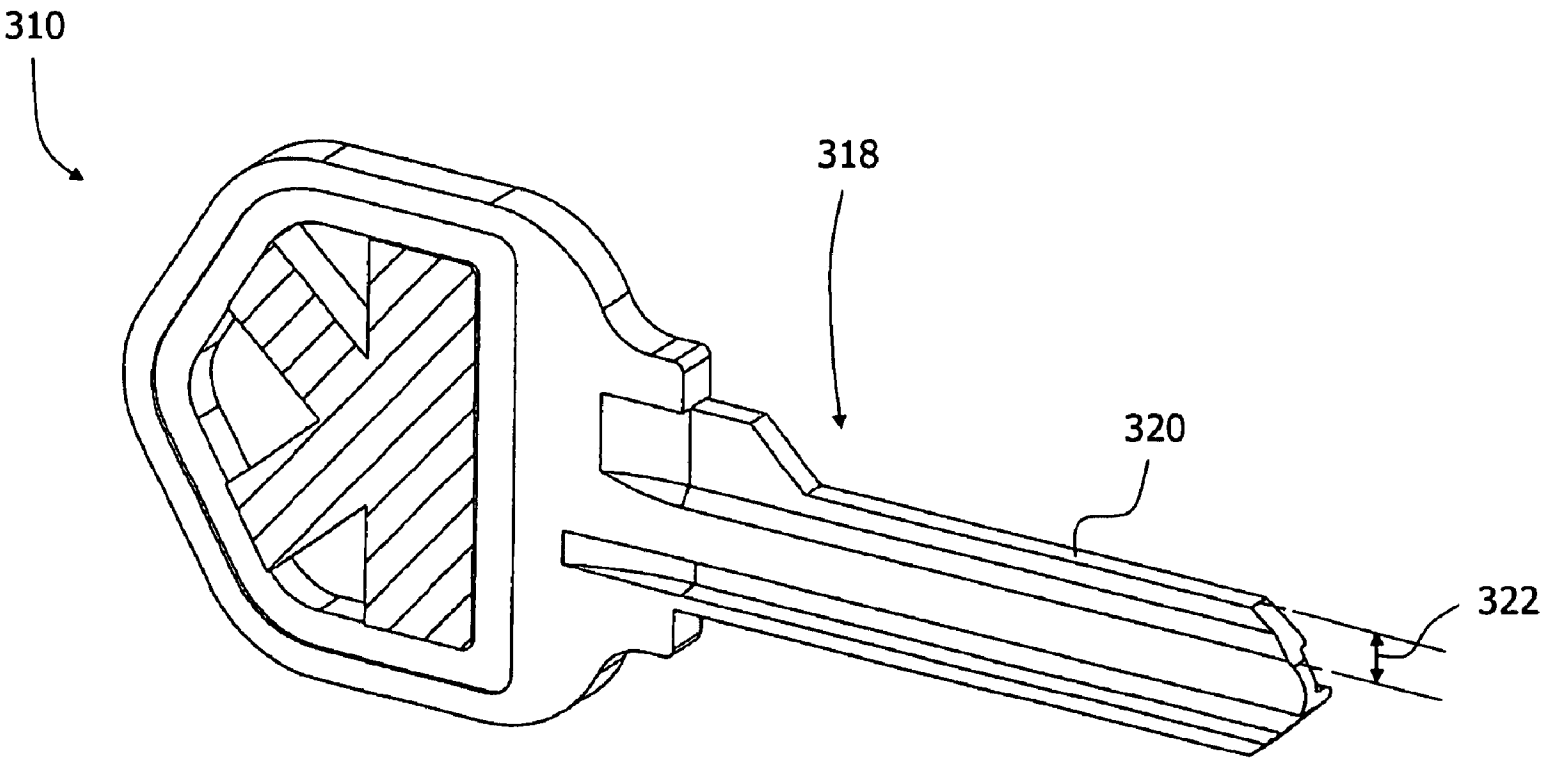
FIG. 31 shows a rack removal key in accordance with the present invention.
Figure 32:
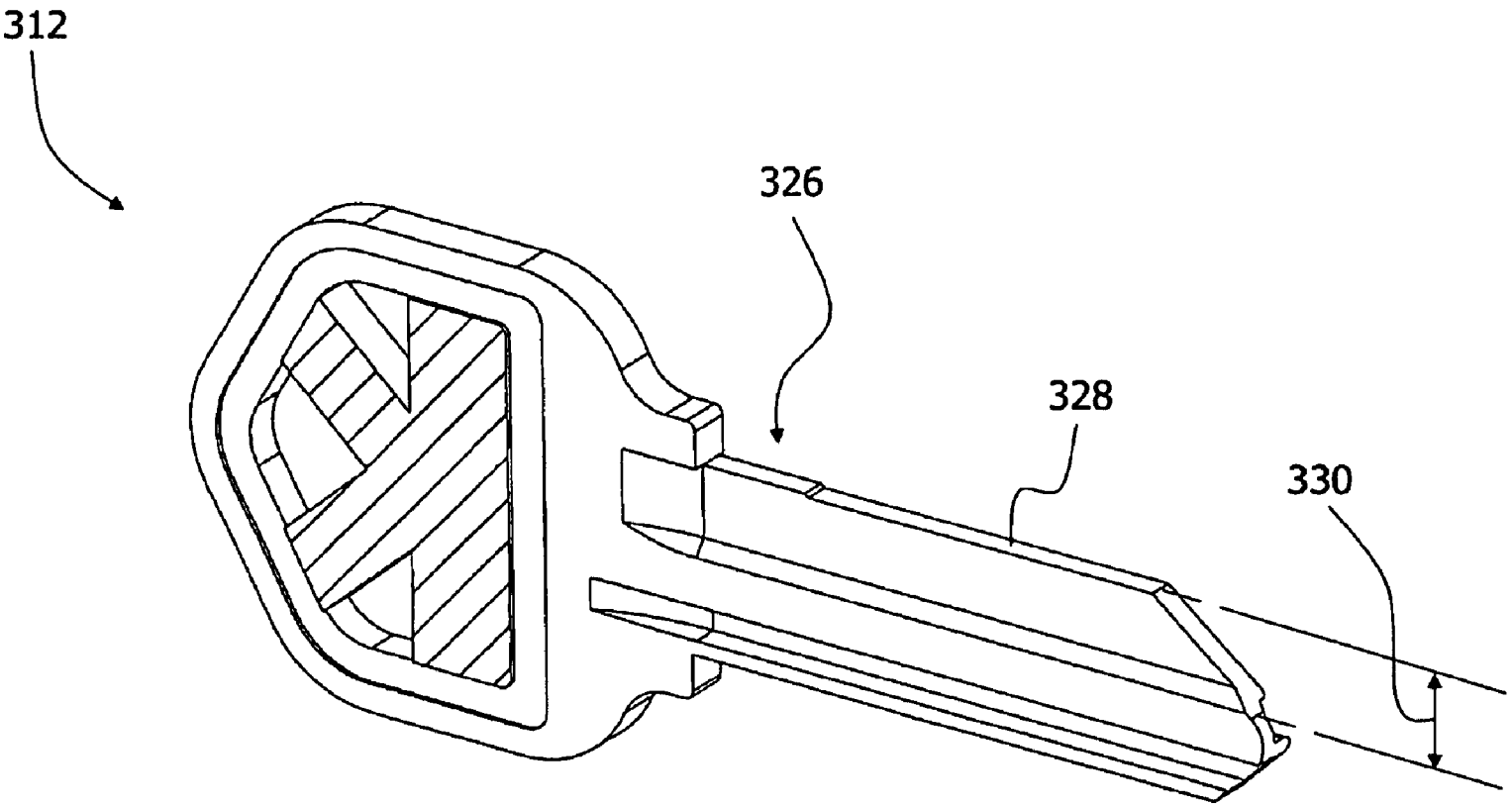
FIG. 32 shows a rack removal tool in accordance with the present invention.

The kit includes a rack removal key 310 (shown in FIG. 31) and a rack removal tool 312 (shown in FIG. 32). The rack removal key 310 is configured for insertion into a keyway, such as the keyway 314 of the plug assembly 316 shown in FIG. 33. The rack removal key 310 has a first cut 318 defining a surface 320 having a first lift amount 322 for lifting the pins, e.g., pins 244, and in turn, the racks, e.g., racks 250, which may be installed in the lock cylinder 210, and more precisely, installed in the plug assembly 316. The rack removal tool 312 is also configured for insertion into the keyway 314. The rack removal tool 312 has a second cut 326 defining a surface 328 having a second lift amount 330 for lifting the pins, e.g., pins 244, and in turn, the racks, e.g., racks 250, which may be installed in the lock cylinder 210, and more precisely, installed in the plug assembly 316. The second lift amount 330 of the rack removal tool 312 is greater than the first lift amount 322 of the rack removal key 310.

Figure 34:
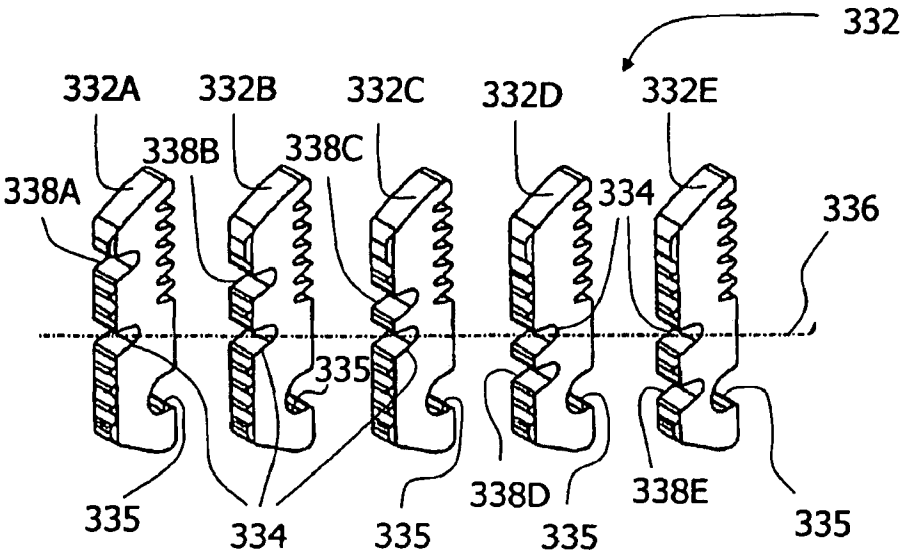
FIG. 34 shows a plurality of master racks in accordance with the present invention.

Referring to FIG. 34, the kit further includes a plurality of master racks 332, which may be replacement master racks, including, for example, individual master racks 332A-332E. In the embodiments shown, each master rack of the plurality of master racks 332 has a first locking bar-receiving groove 334. The first locking bar-receiving groove 334 is located along a neutral axis 336. At least a second locking bar-receiving groove 338A, 338B, 338C, 338D, 338E, respectively, may be variously spaced from the neutral axis 336. Also, each master rack of the plurality of replacement master racks has a protrusion groove 335 for receiving the protrusion features, e.g., rack engaging features, 344, on the plug body 340 of the plug assembly 316 (see FIG. 23), and which are spaced a common distance from neutral axis 336. The configuration of the plurality of master racks 332, and the various spacing of the second locking bar-receiving grooves, e.g., 338A, 338B, 338C, 338D, 338E, respectively, from the neutral axis 336 for each master rack 332A-332E may be correlated to a particular master key. The second locking bar-receiving groove 338A-338E may be anywhere above or below the first locking bar-receiving groove 334. The purpose of the second locking bar-receiving groove 338A-338E is for the master keying capability of the lock cylinder 210.

Figure 35:
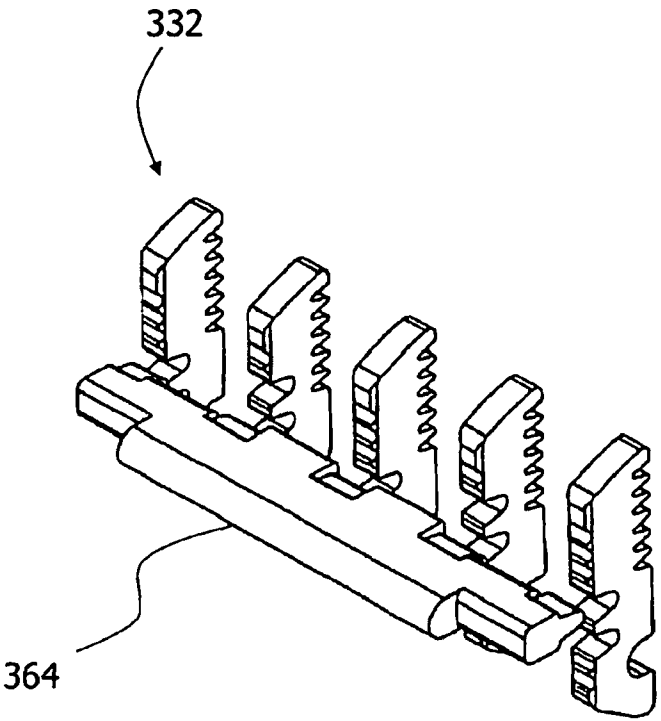
FIG. 35 shows the position of the plurality of master racks when a tenant key is inserted into the keyway.

FIG. 35 shows the position of the plurality of master racks 332 when a tenant key has been inserted in the keyway 314 of the plug assembly 316. The plug assembly 316 is still able to rotate in the cylinder body 212, with the locking bar 364 engaging individual grooves of the plurality of master racks 332. However, with the plurality of master racks 332 not having lined up along the neutral axis 336, the lock cylinder 210 cannot be rekeyed.

Figure 36A:
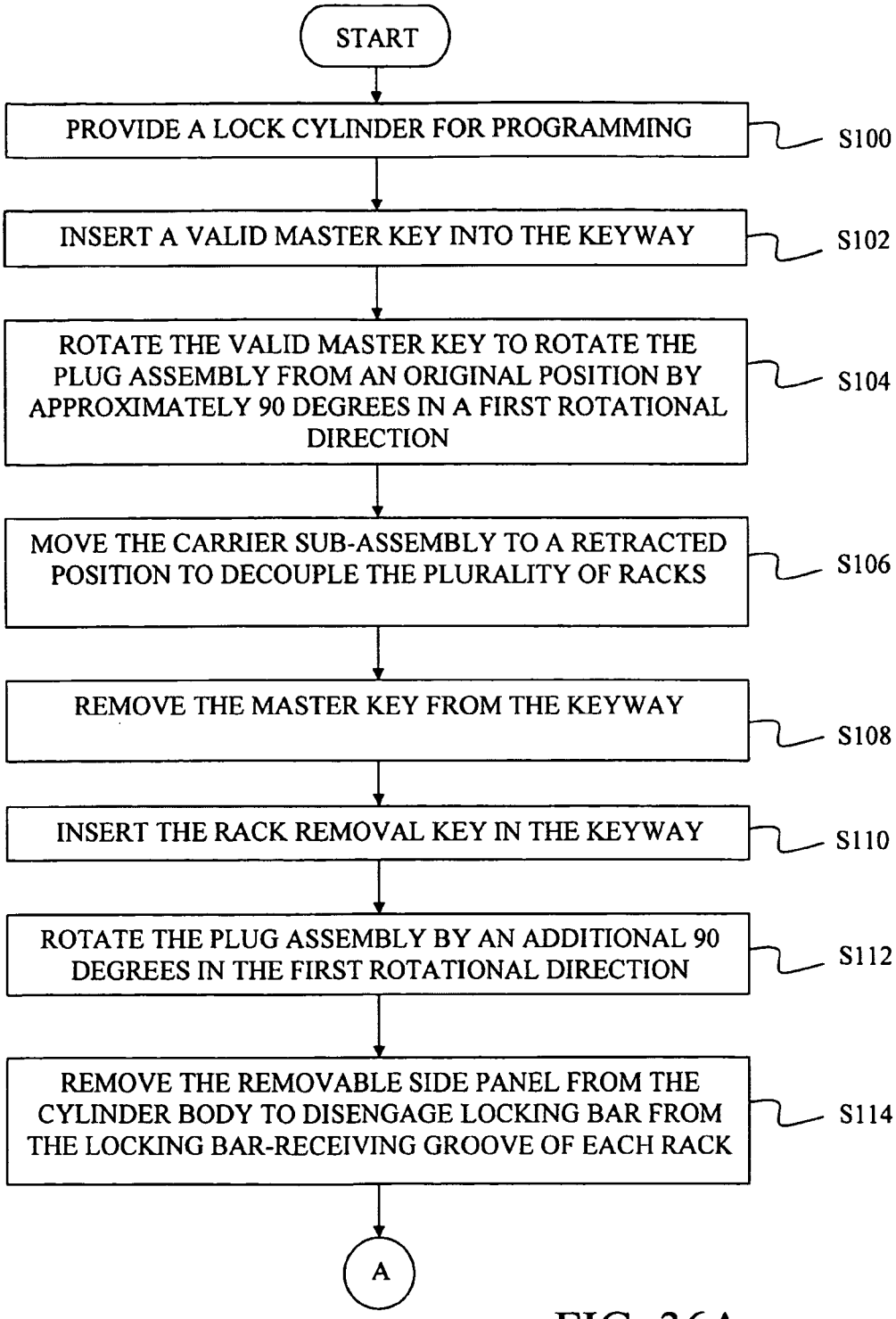
FIGS. 36A-36C show a detailed flowchart of one embodiment of a method for rekeying a lock cylinder of the master keying system in accordance with the present invention.
Figure 36B:
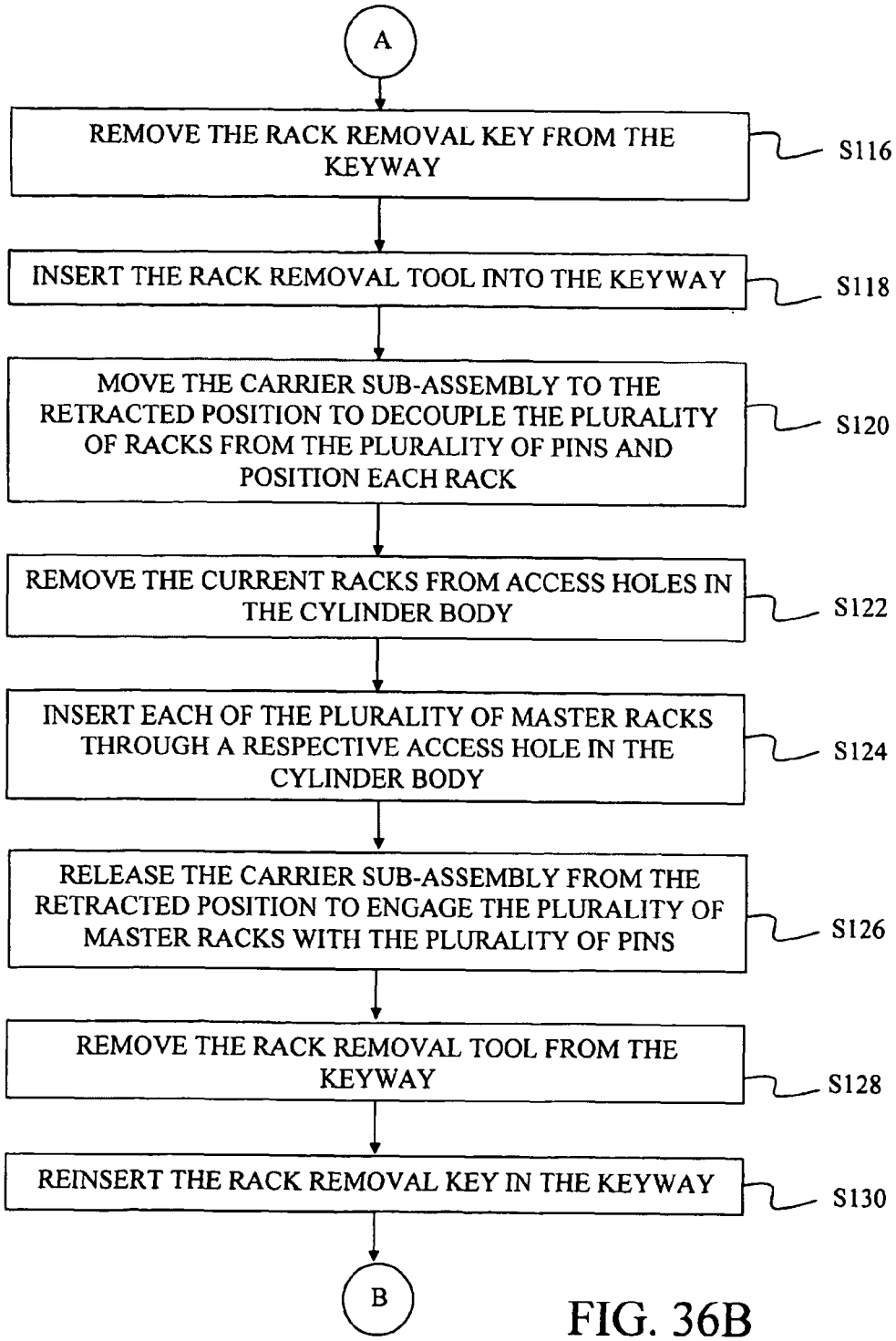
Figure 36C:
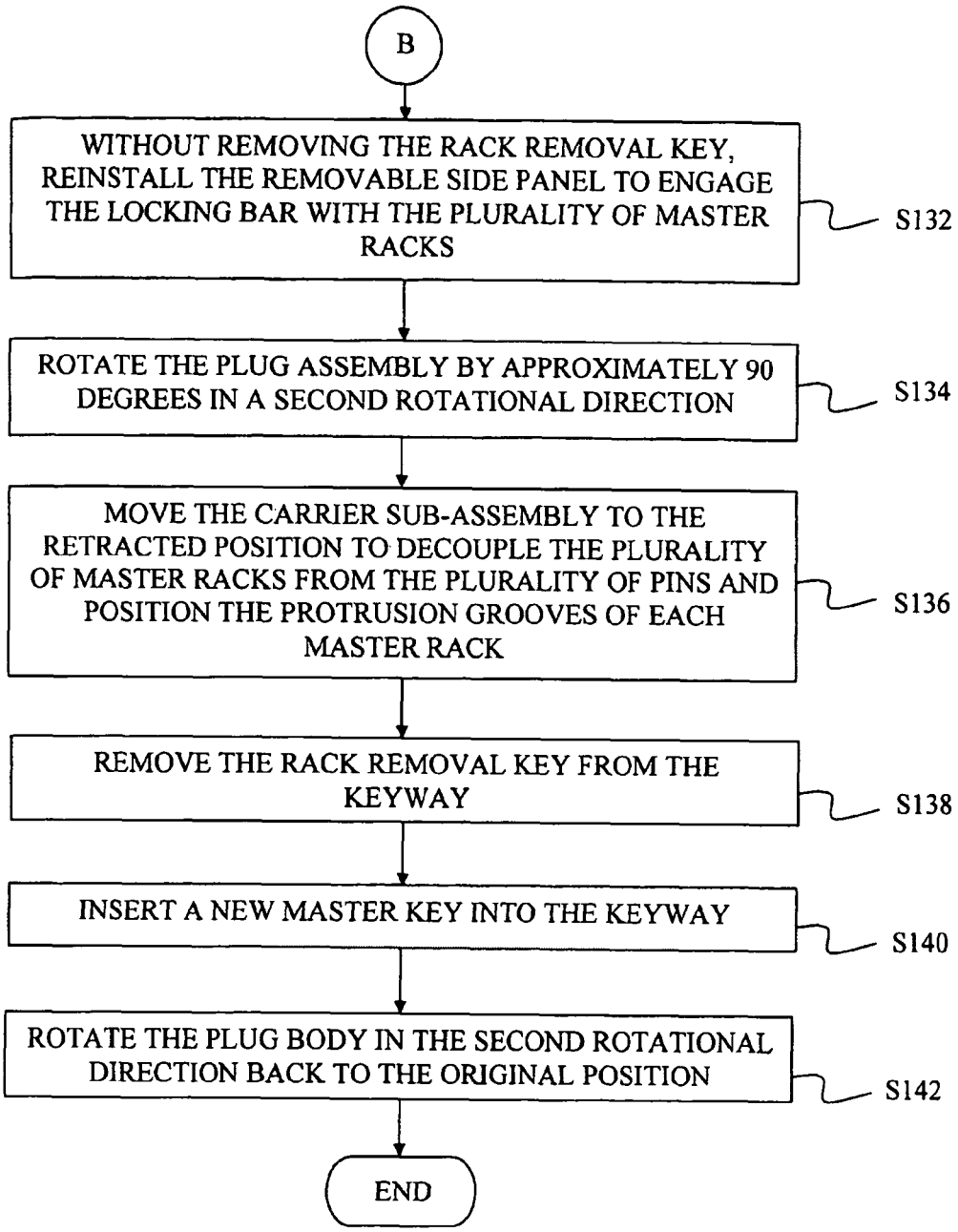

FIGS. 36A-36C show a detailed flowchart of one embodiment of a method for rekeying the lock cylinder 210 of the master keying system, which may utilize components of the kit described above in relation to FIGS. 31-35. This method will be described with further reference to FIGS. 37-52.

Figure 33:
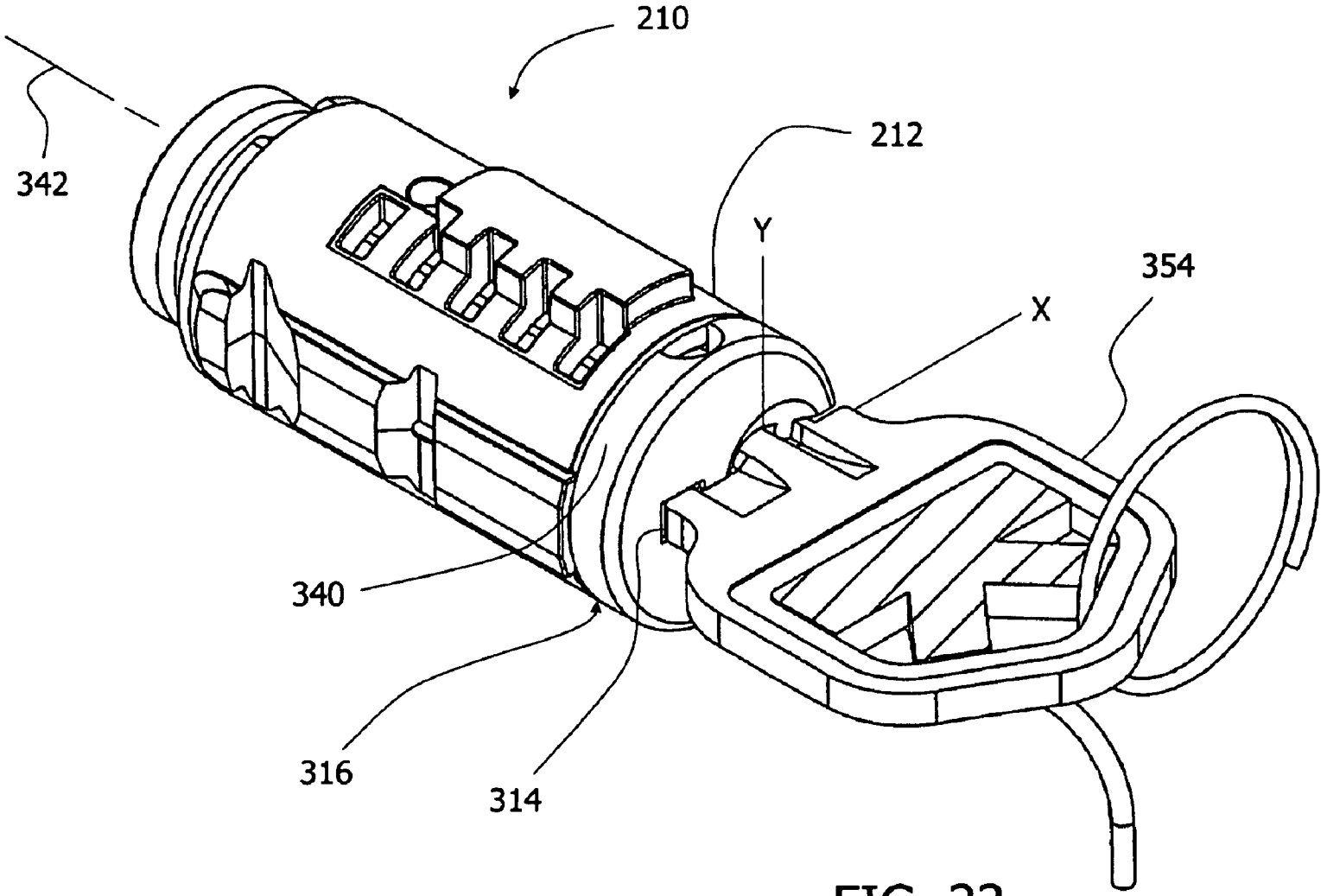
FIG. 33 shows a lock cylinder having a plug assembly and keyway.

At step S100, and with reference to FIGS. 23 and 33, a lock cylinder 210 is provided for rekeying. The lock cylinder 210 includes a cylinder body 212 with a longitudinal axis 342, and with the plug assembly 316 disposed in the cylinder body 212. The plug assembly 316 includes the keyway 314, the plug body 340 having the plurality of protrusion features 344, and a carrier sub-assembly 346 disposed adjacent the plug body 340. The carrier sub-assembly 346 is moveable parallel to the longitudinal axis 342 of the cylinder body 212 between a first position, e.g., an initial position, and a second position, e.g., a retracted position. The plug assembly 316 includes the plurality of pins 244 and the plurality of racks 348, as shown in FIG. 23, or alternatively the plurality of master racks 332, as shown in FIG. 34, for engaging the pins 244. Each rack of the plurality of racks 348 has a locking bar-receiving groove 350 and a protrusion groove 352.

At step S102, a valid master key 354 is inserted into the keyway 314.

At step S104, as depicted in FIG. 33, the valid master key 354 is rotated to rotate the plug assembly 316 from an original position along the x-axis by approximately 90 degrees in a first rotational direction, e.g., counterclockwise, respective to the X-axis.

Figure 37:
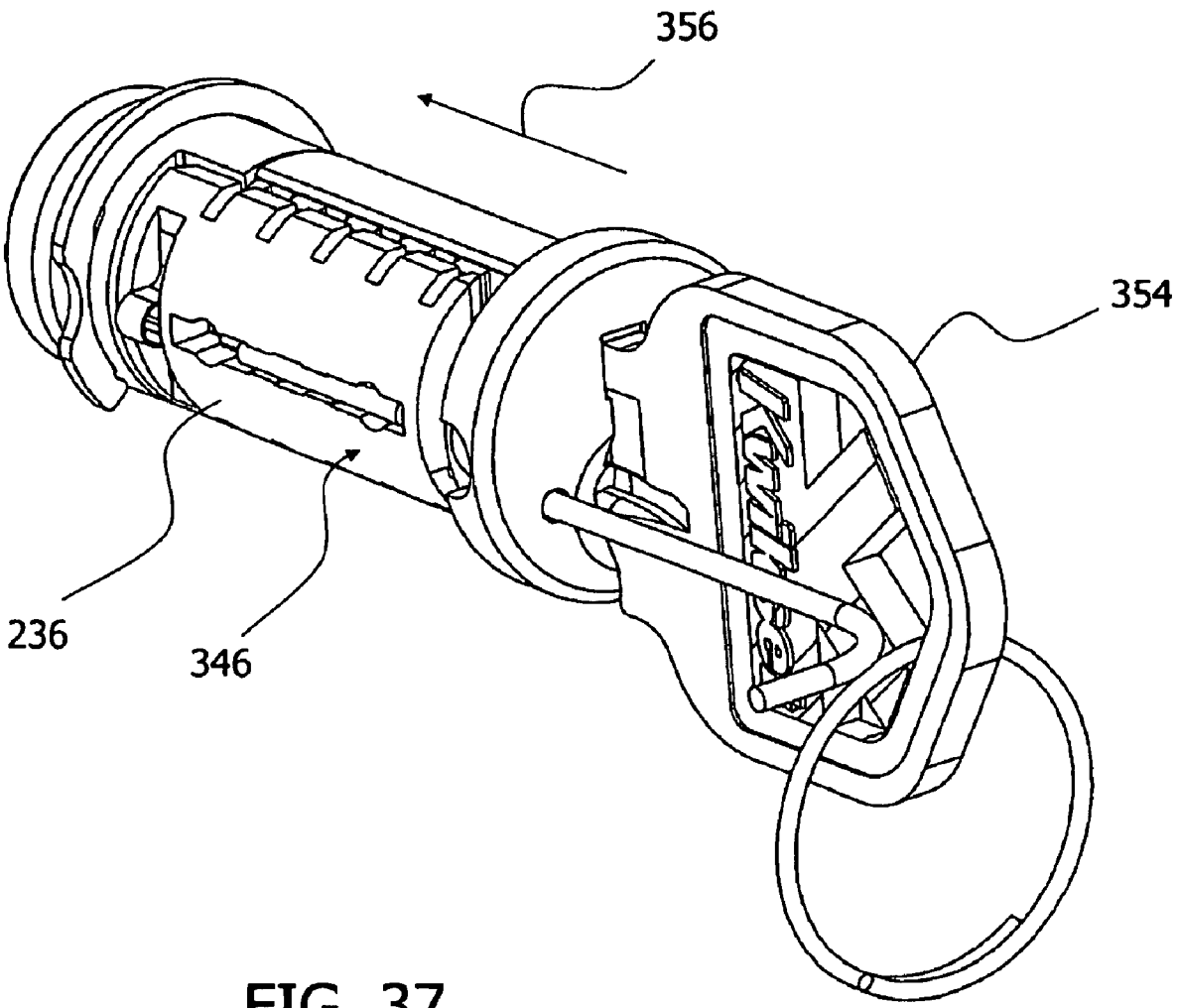
FIG. 37 shows the position of the carrier sub-assembly as it is pushed to the retracted position.
Figure 38:
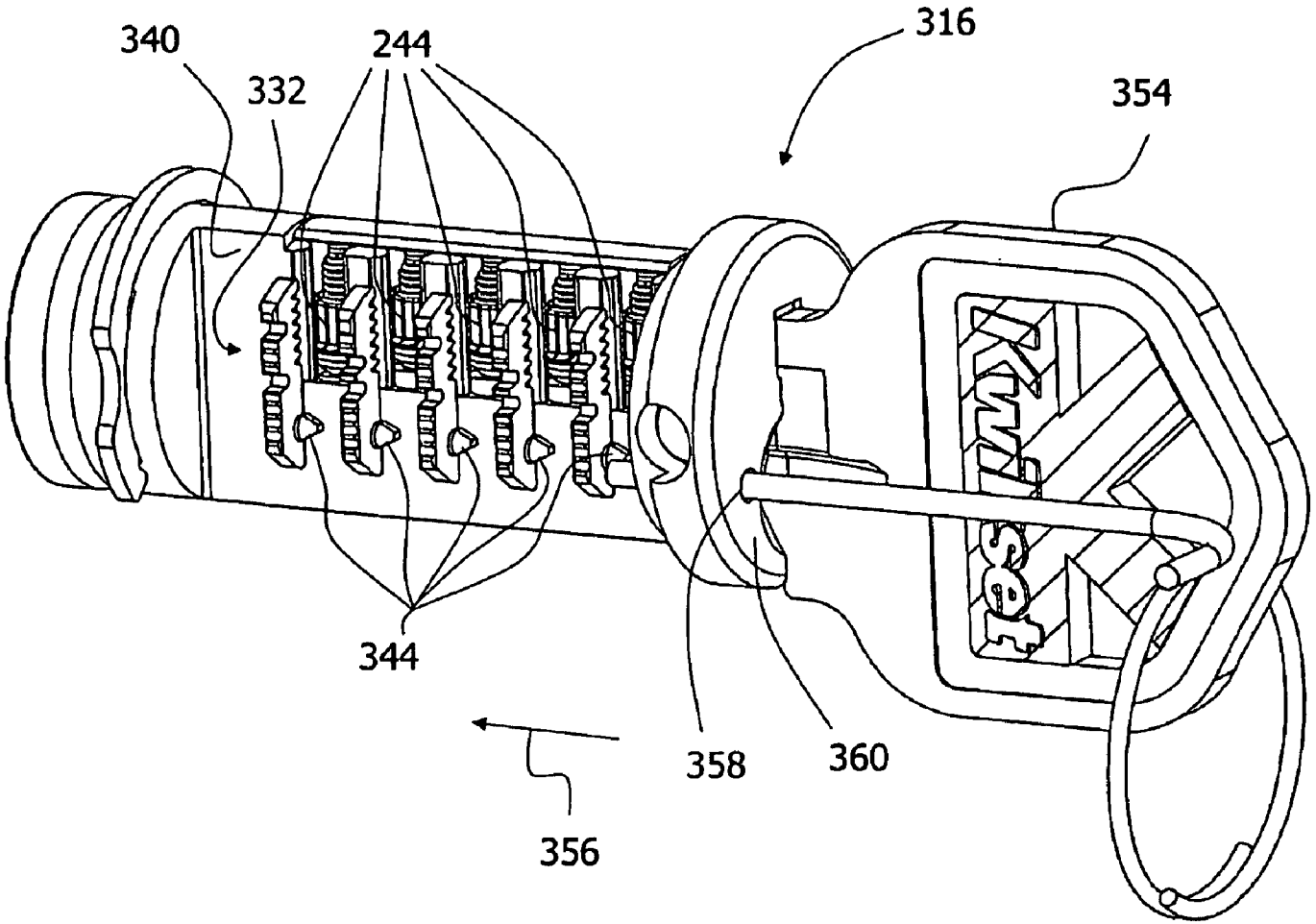
FIG. 38 shows the placement of the master racks after the carrier sub-assembly is pushed to the retracted position.

At step S106, with reference to FIGS. 37 and 38, the carrier sub-assembly 346, which includes master racks 332 in the configuration of FIG. 38, is moved in a direction 356 to a retracted position to decouple the plurality of master racks 332, as shown, from the plurality of pins 244 and position the protrusion groove 335 of each rack 332A-332E over a corresponding protrusion feature 344 (see also FIG. 34) on the plug body 340. The movement of carrier sub-assembly 346 may be effected by rack carrier moving tool 162 by inserting tool 162 into the rekeying tool opening 358 in the plug face 360 of the plug assembly 316. FIG. 37 shows the position of the carrier sub-assembly 346, which includes the plurality of master racks 332, as it is pushed backwards by tool 162 to the retracted position. FIG. 38 shows the placement of the plurality of master racks 332 after carrier sub-assembly 346 is pushed back to the retracted position. As shown, the protrusion engaging groove of each of the master racks 332 rides up over the corresponding protrusion feature 344 on the plug body 340.

Figure 39:
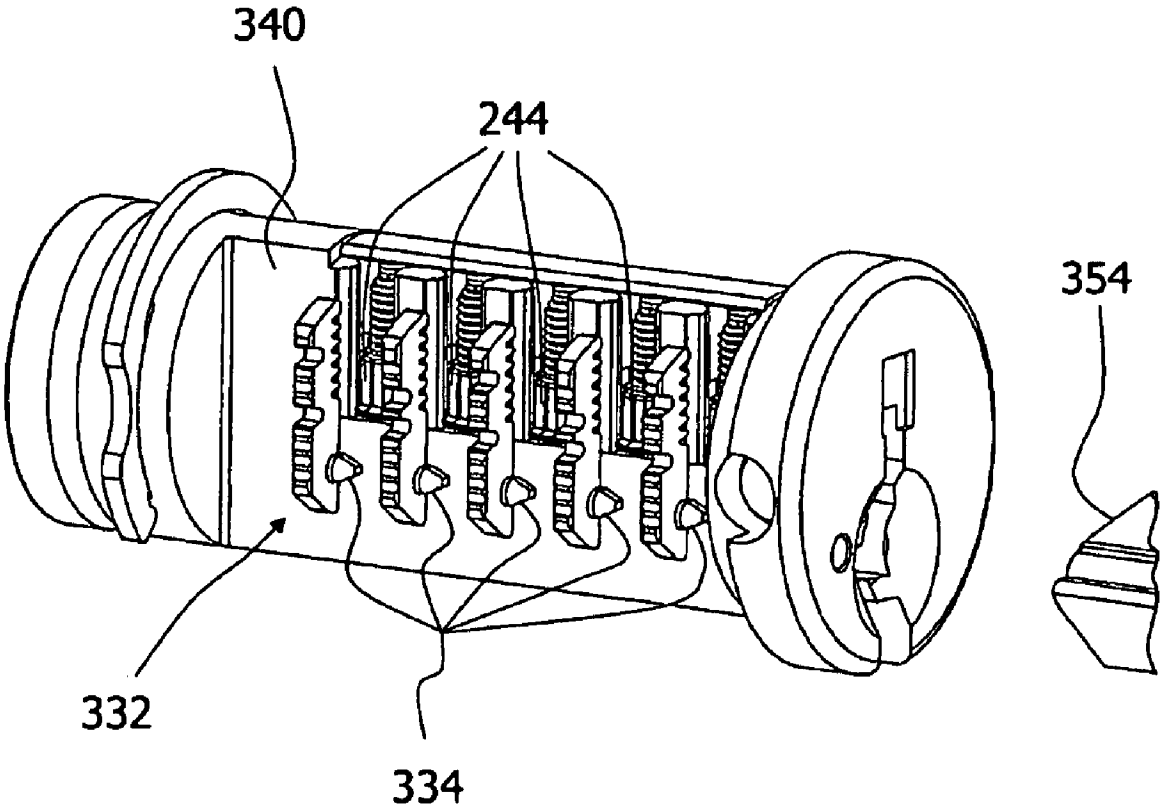
FIG. 39 shows the placement of the master racks with the master key removed from the keyway.

At step S108, the valid master key 354 is removed from the keyway 314. Referring to FIG. 39, once the master key 354 is removed, the protrusion groove 335 of each of the plurality of master racks 332 will remain over the corresponding protrusion feature 344 on the plug body 340, and the pins 244 will ride up against a ledge of the plug body 340.

Figure 40:
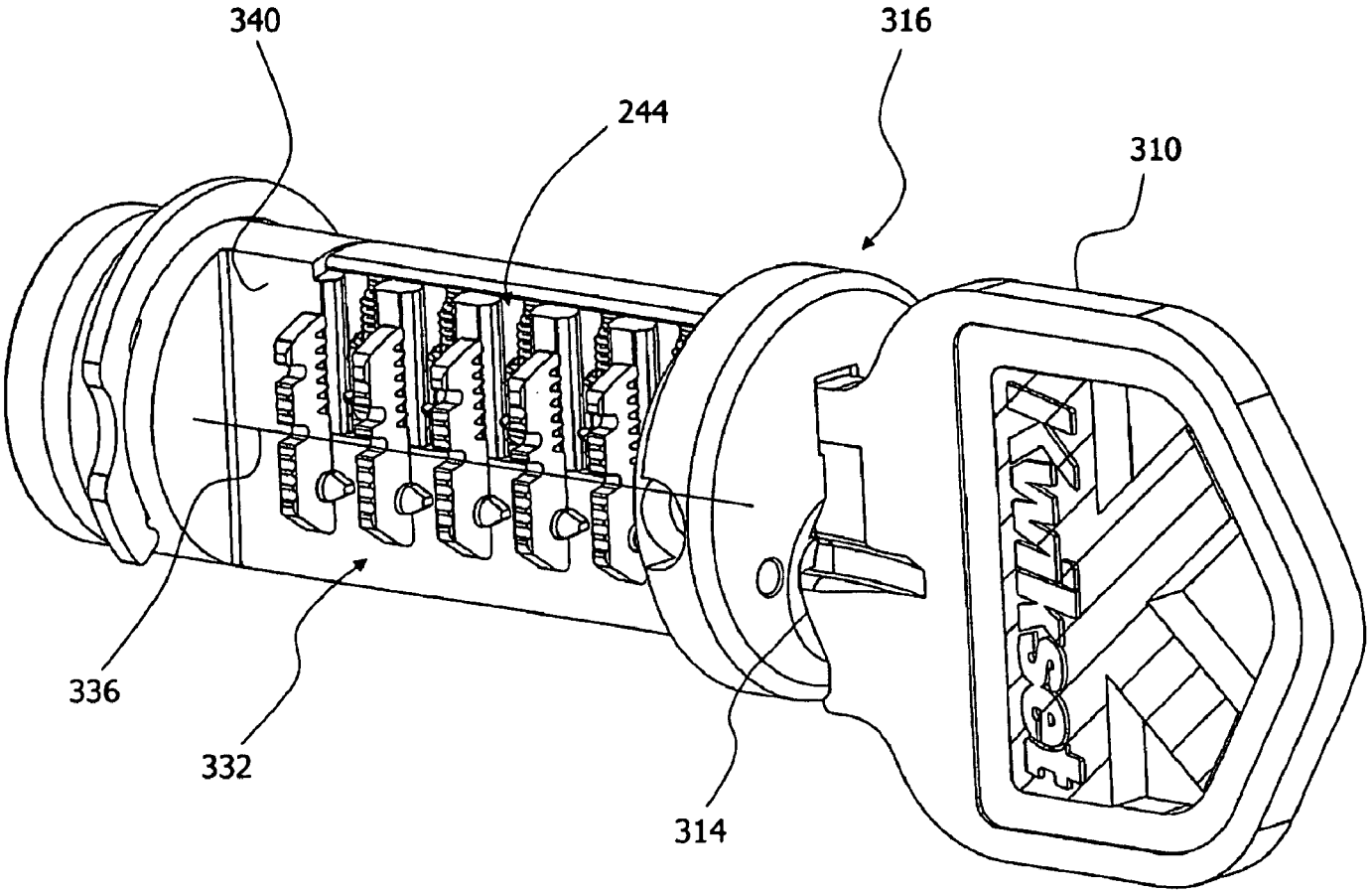
FIG. 40 shows the rack removal key inserted in the keyway of the plug assembly.
Figure 41:
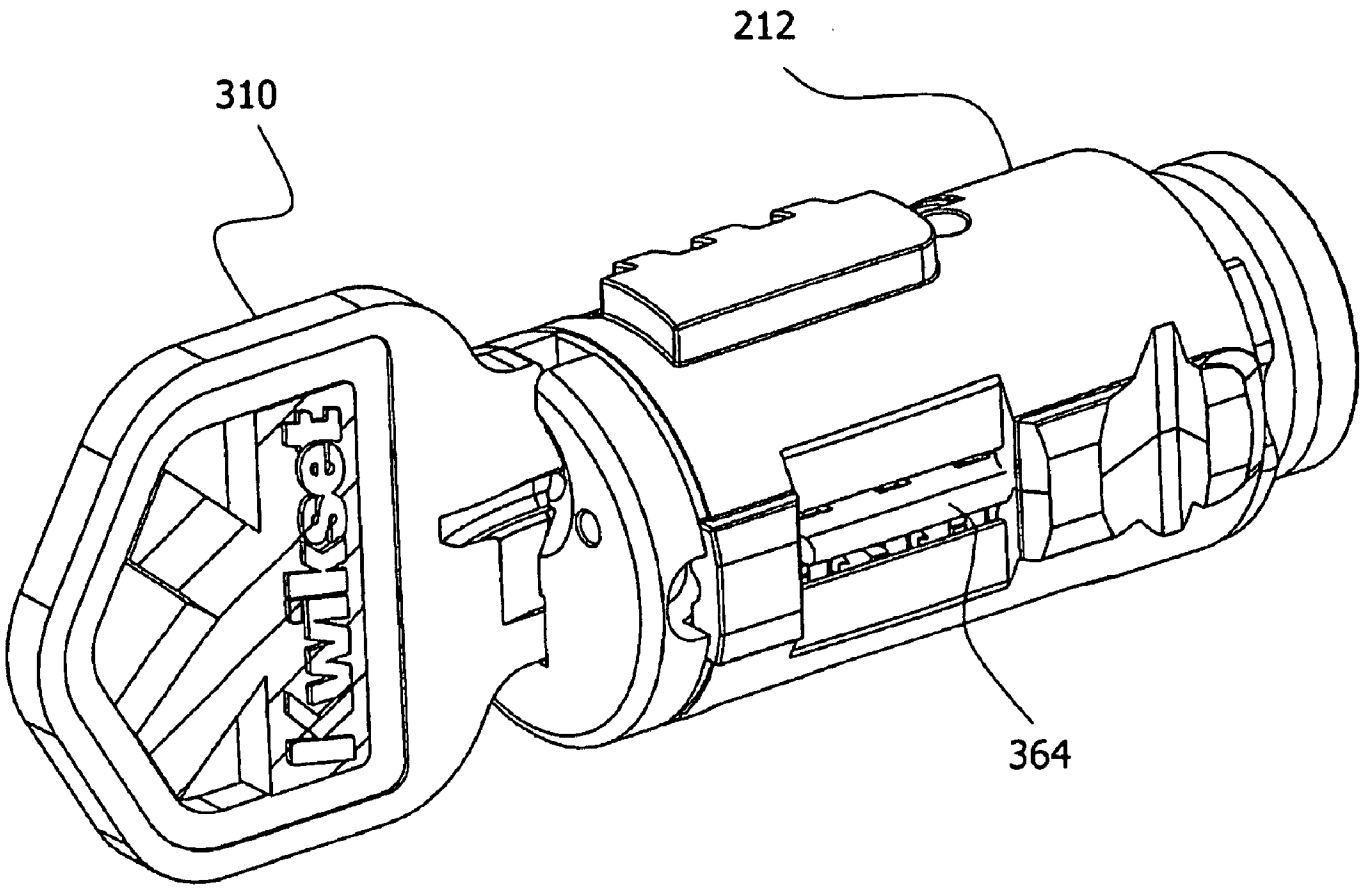
FIG. 41 shows the removable side panel removed from the cylinder body, exposing the locking bar.

At step S110, the rack removal key 310 is inserted in the keyway 314, as shown in FIG. 40. As described above, the rack removal key 310 has a cut 318 that lifts the plurality of pins 244 by a first amount, and in turn lifts the plurality of master racks 332. The relatively low cut 318 of rack removal key 310, in comparison to the cut 326 of the rack removal tool 312, is selected to locate all the racks at the neutral axis 336.

At step S112, the plug assembly 316 is rotated by an additional 90 degrees in the first rotational direction, e.g., counterclockwise, by a corresponding rotation of the rack removal key 310, so as to release the carrier sub-assembly 346 from the retracted position to reengage the plurality of master racks 332 with the plurality of pins 244. For example, as shown in FIG. 23, the plug catch 228 disengages from the slot (not shown) on the cylinder body 212 allowing the carrier spring 362 to push the carrier 236 of the carrier sub-assembly 346 forward to the first position, e.g., the initial position. As a result, in the present embodiment, the plurality of master racks 332 are reengaged with the tooth, or teeth, of the respective plurality of pins 244.

Figure 42:
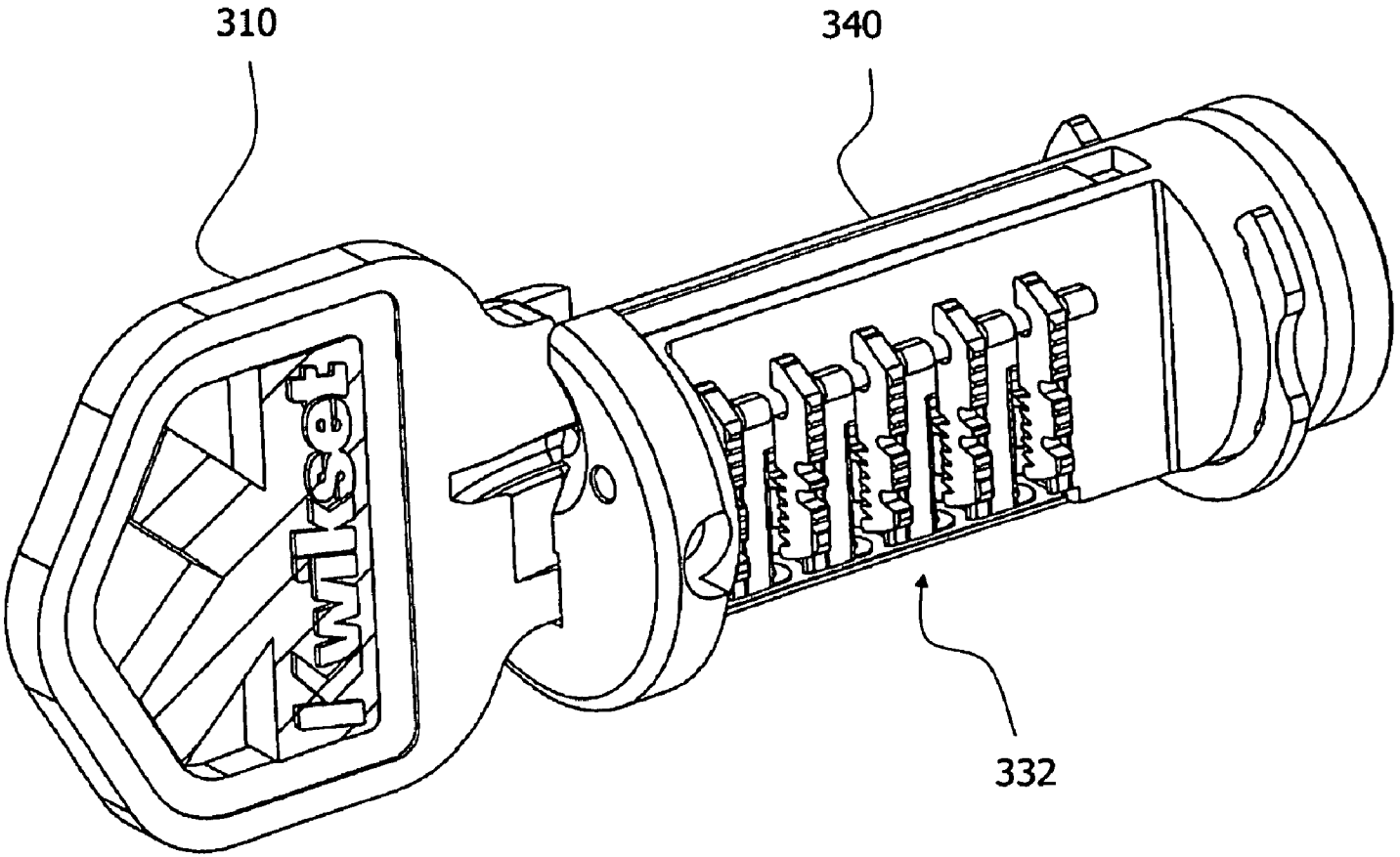
FIG. 42 shows the position of the plurality of master racks with the rack removal key inserted in the keyway.

At step S114, a removable side panel 220 is removed (see FIG. 23) from the cylinder body 212 to disengage the locking bar 364 (see FIG. 41) from the locking bar-receiving groove of each rack 332A-332E, thereby decoupling all of the plurality of master racks 332 from each other rack. The position of the plurality of master racks 332 is as shown in FIG. 42.

At step S116, the rack removal key 310 is removed from the keyway 314.

At step S118, the rack removal tool 312 is inserted into the keyway 314. As described above, the rack removal tool 312 has a cut 326 that lifts the plurality of pins 244 by a second amount greater than the first amount associated with the cut 318 of the rack removal key 310. The rack removal tool 312 lifts the plurality of master racks 332 to a position such that the entirety of the plurality of master racks 332, including the protrusion grooves 335, will be above the protrusion features 344 on the plug body 340.

Figure 43:
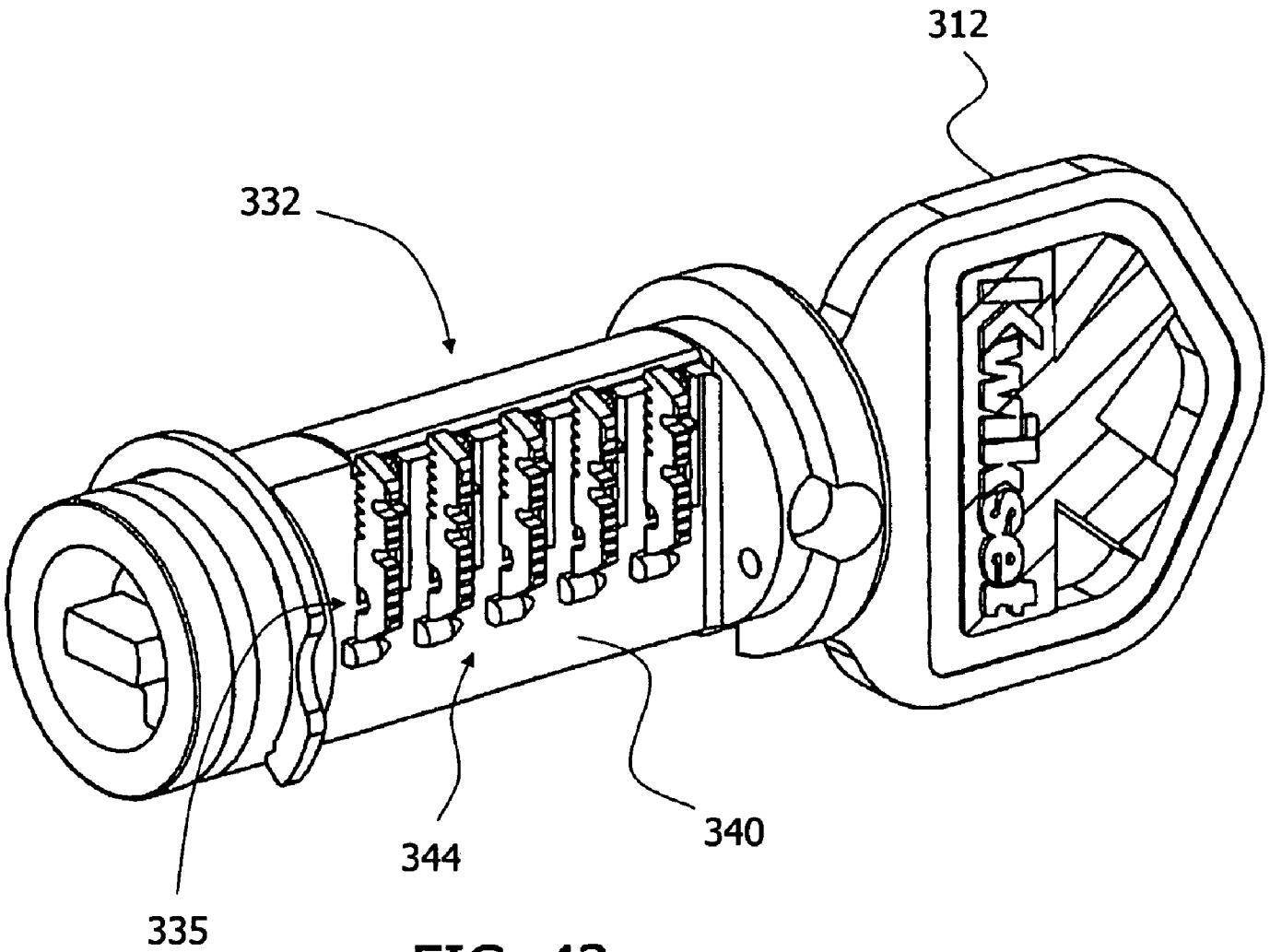
FIG. 43 shows the plurality of master racks positioned above the corresponding protrusion feature of the plug body.

At step S120, the carrier sub-assembly 346 is subsequently moved to the retracted position to decouple the plurality of master racks 332 from the plurality of pins 244 and position each rack 332A-332E above the corresponding protrusion feature 344 on the plug body 340, as shown in FIG. 43. The movement of carrier sub-assembly may be effected by rack carrier moving tool 162, by inserting tool 162 into the rekeying tool opening 358 in the plug face 360 of the plug assembly 316.

Figure 44:
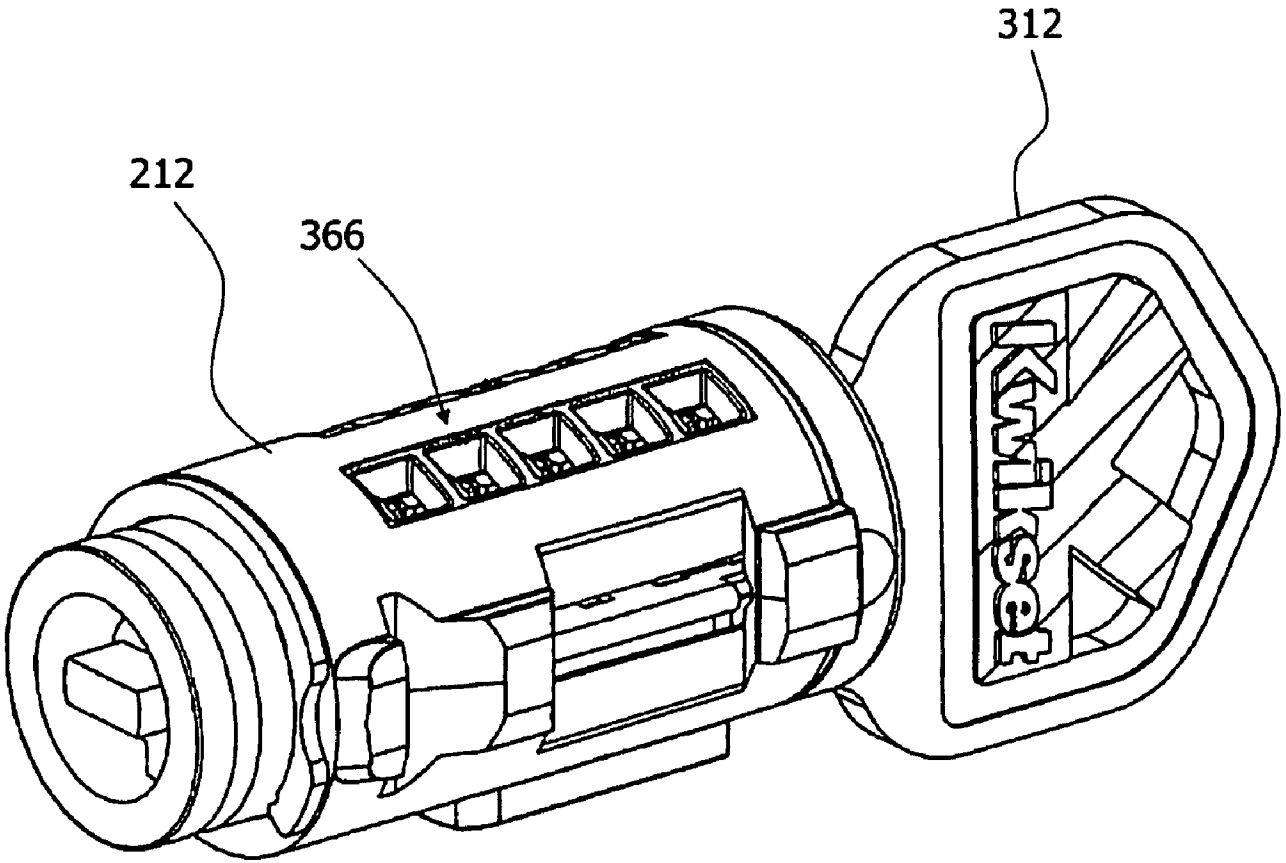
FIG. 44 shows the rack access holes in the cylinder body.
Figure 45:
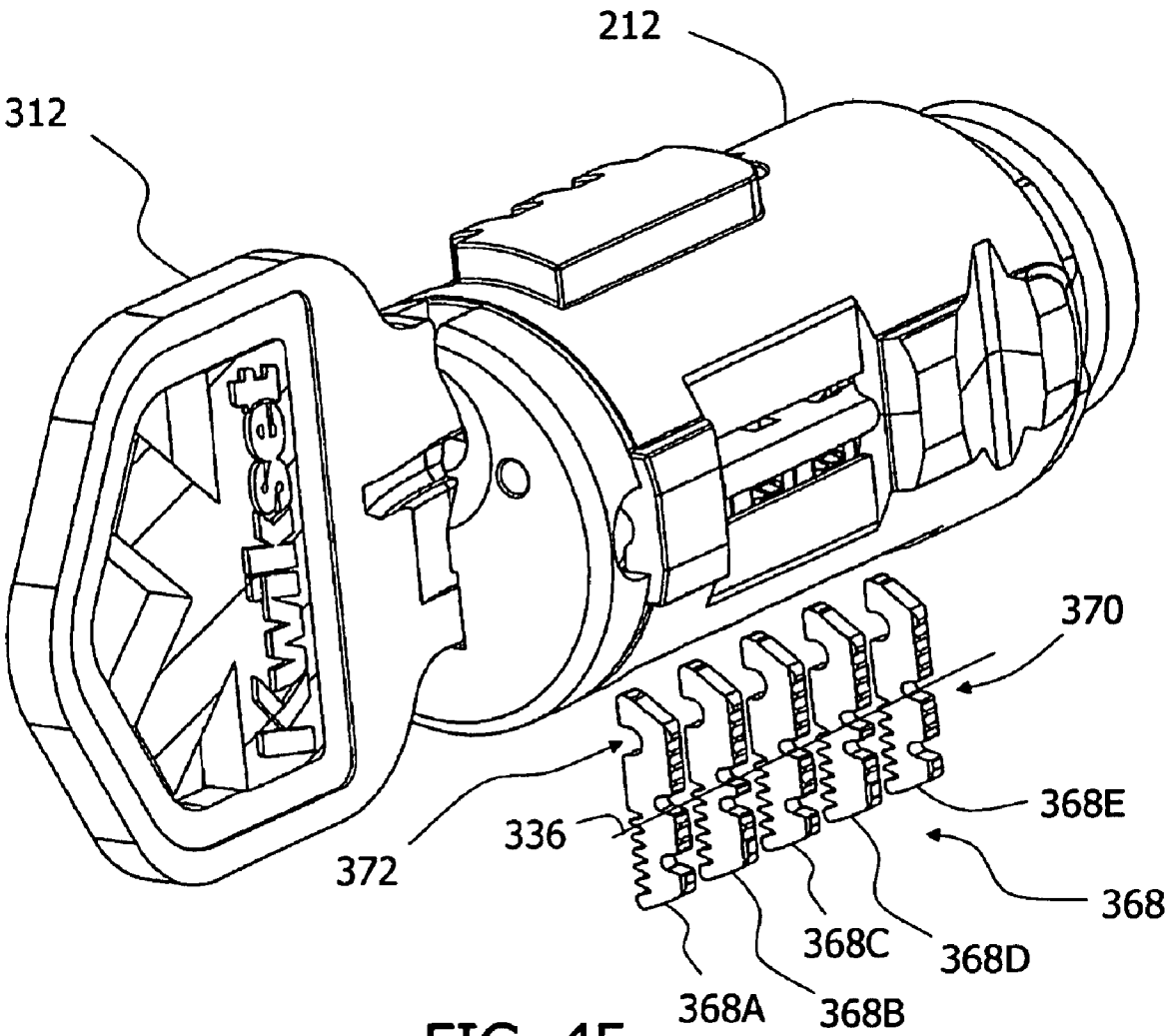
FIG. 45 shows a plurality of replacement master racks.

At step S122, one or more of the current plurality of master racks 332A-332E may now be removed from access holes 366 in the cylinder body 212 (see FIG. 44). In some cases, as in this example, each of the plurality of master racks 332 will be replaced by a corresponding plurality of replacement master racks 368 shown in FIG. 45, individually identified as 368A-368E.

At step S124, each of the plurality of replacement master racks 368 is inserted through a respective access hole 366 in cylinder body 212. The position of the plurality of replacement master racks 368 after the master racks 368 are inserted through the access holes 366 will be substantially like that of the plurality of master racks 332 shown in FIG. 43, wherein the plurality of replacement master racks 368 will be above, e.g., sitting on top of, the protrusion features 344 of the plug body 340.

Figure 46:
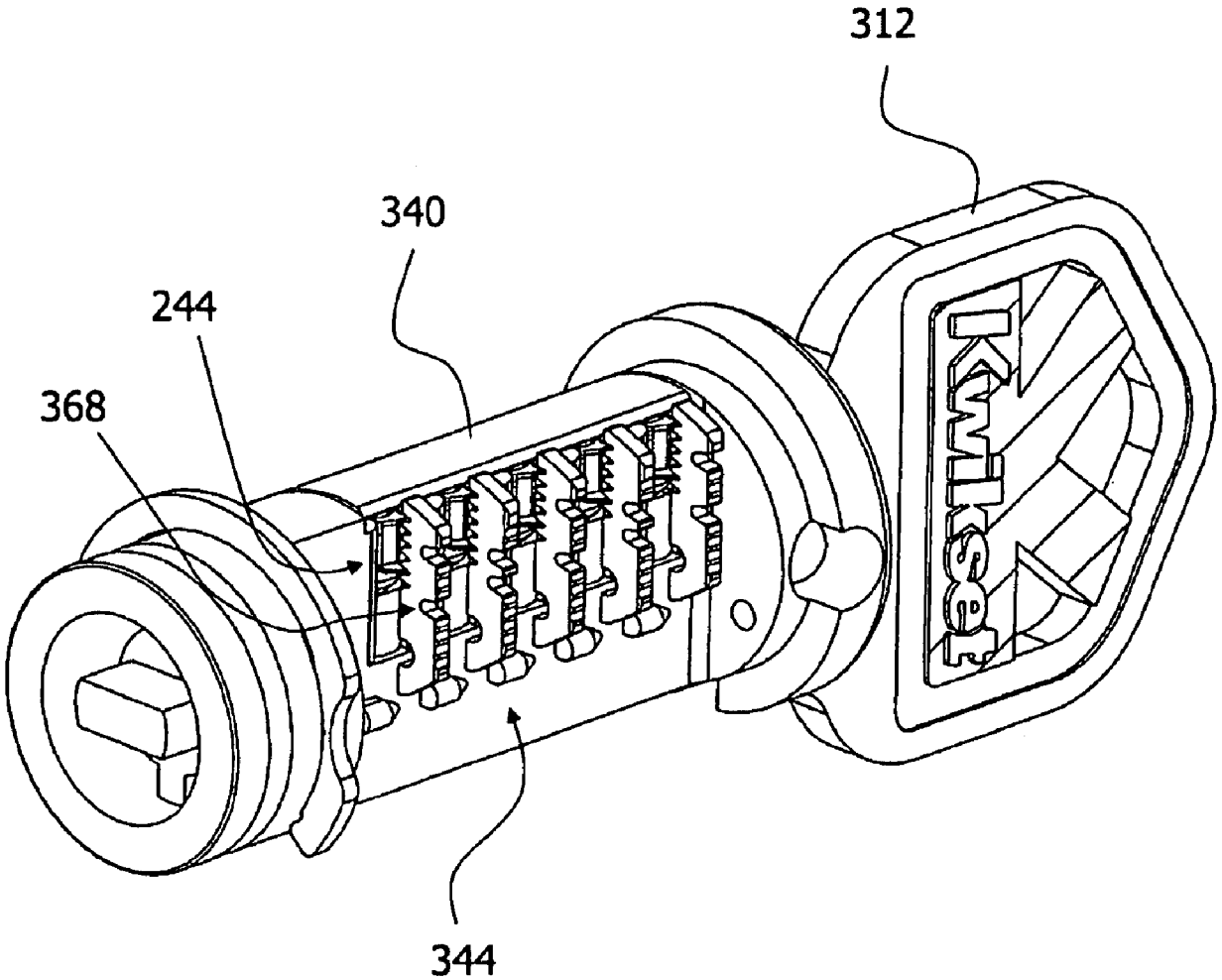
FIG. 46 shows the carrier sub-assembly released from the retracted position to engage the plurality of replacement master racks with the plurality of pins.

At step S126, the carrier sub-assembly 346 is released from the retracted position to engage the plurality of replacement master racks 368 with the plurality of pins 244, as shown in FIG. 46. Since no detent is provided in this example to hold the carrier sub-assembly 346 in the retracted position when the plug body 340 has been rotated by approximately 180 degrees, the carrier sub-assembly 346 is manually held in the retracted position, and manually released from the retracted position to move the plurality of replacement master racks 368 forward to clear the protrusion features 344 on plug body 340.

At step S128, the rack removal tool 312 is removed from the keyway 314.

Figure 47:
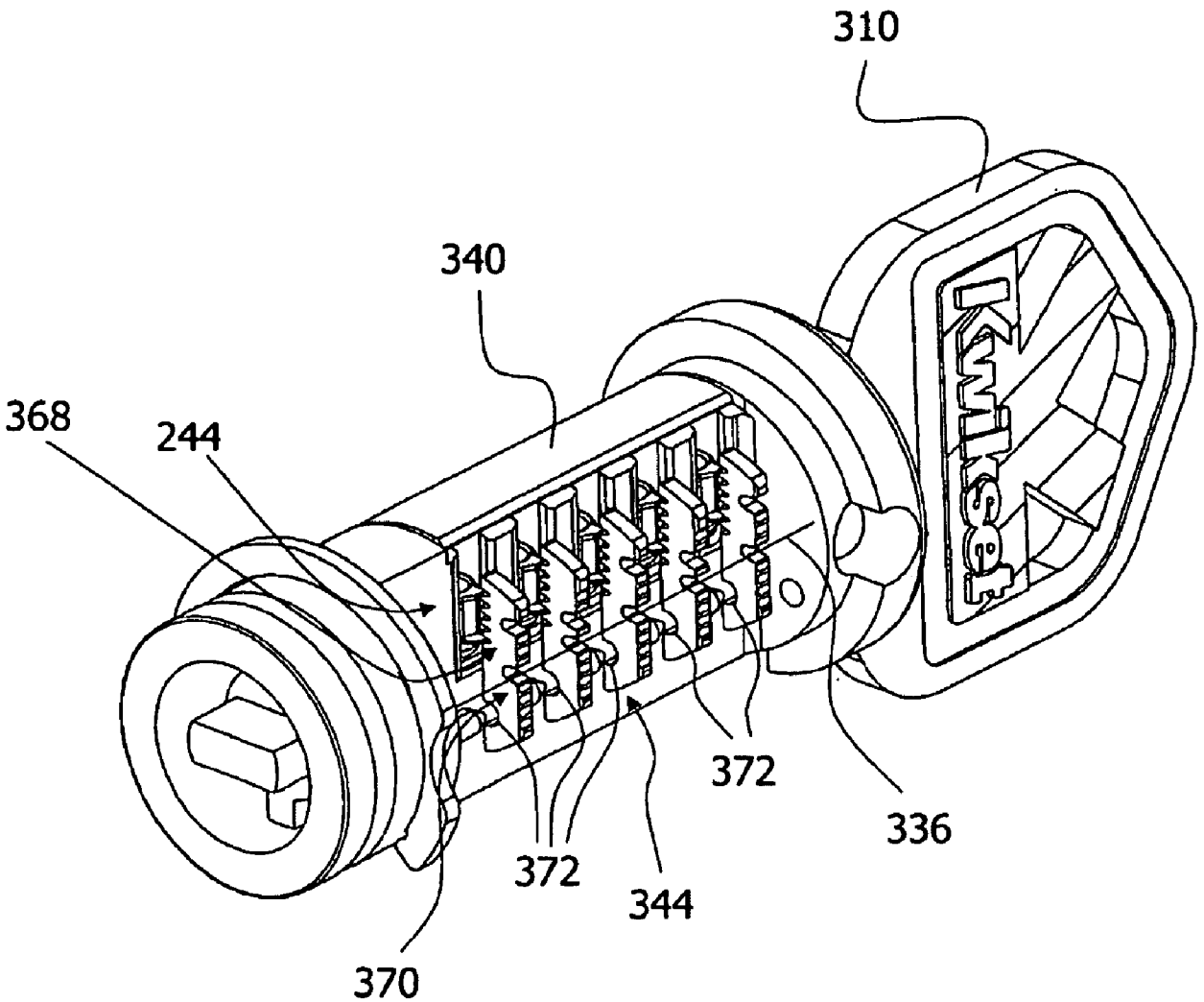
FIG. 47 shows the plurality of replacement master racks with the corresponding protrusion grooves lined up with the corresponding protrusion features on the plug body.
Figure 48:
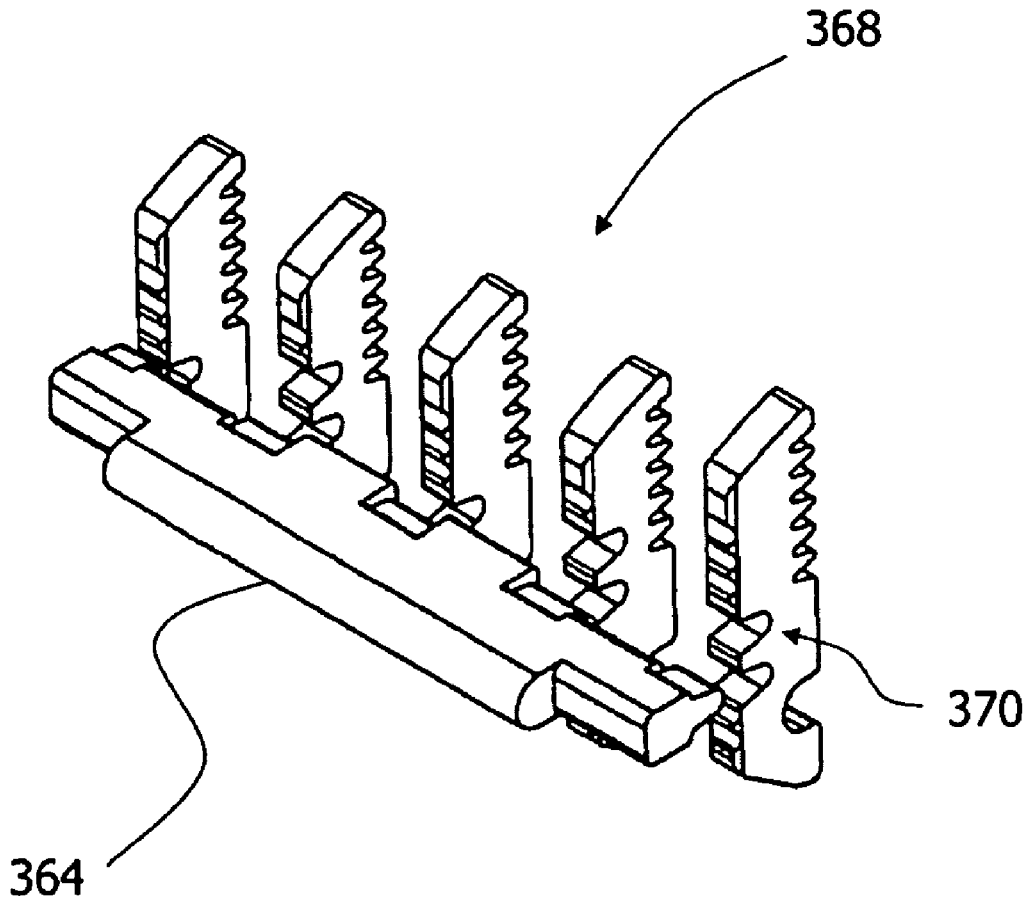
FIG. 48 shows the master locking bar-receiving grooves of the master racks positioned to receive the locking bar.

At step S130, the rack removal key 310 is reinserted in the keyway 314. This sets the position of the plurality of pins 244 and in turn lines up the master locking bar-receiving grooves 370 (see FIG. 45) along the neutral axis 336 of each of the plurality of replacement master racks 368, and in turn lines up the corresponding protrusion grooves 372 with the corresponding protrusion feature 344 on the plug body 340, as shown in FIG. 47. The master locking bar-receiving grooves of the master racks are now positioned to receive the locking bar 364, as shown in FIG. 48.

Figure 49:
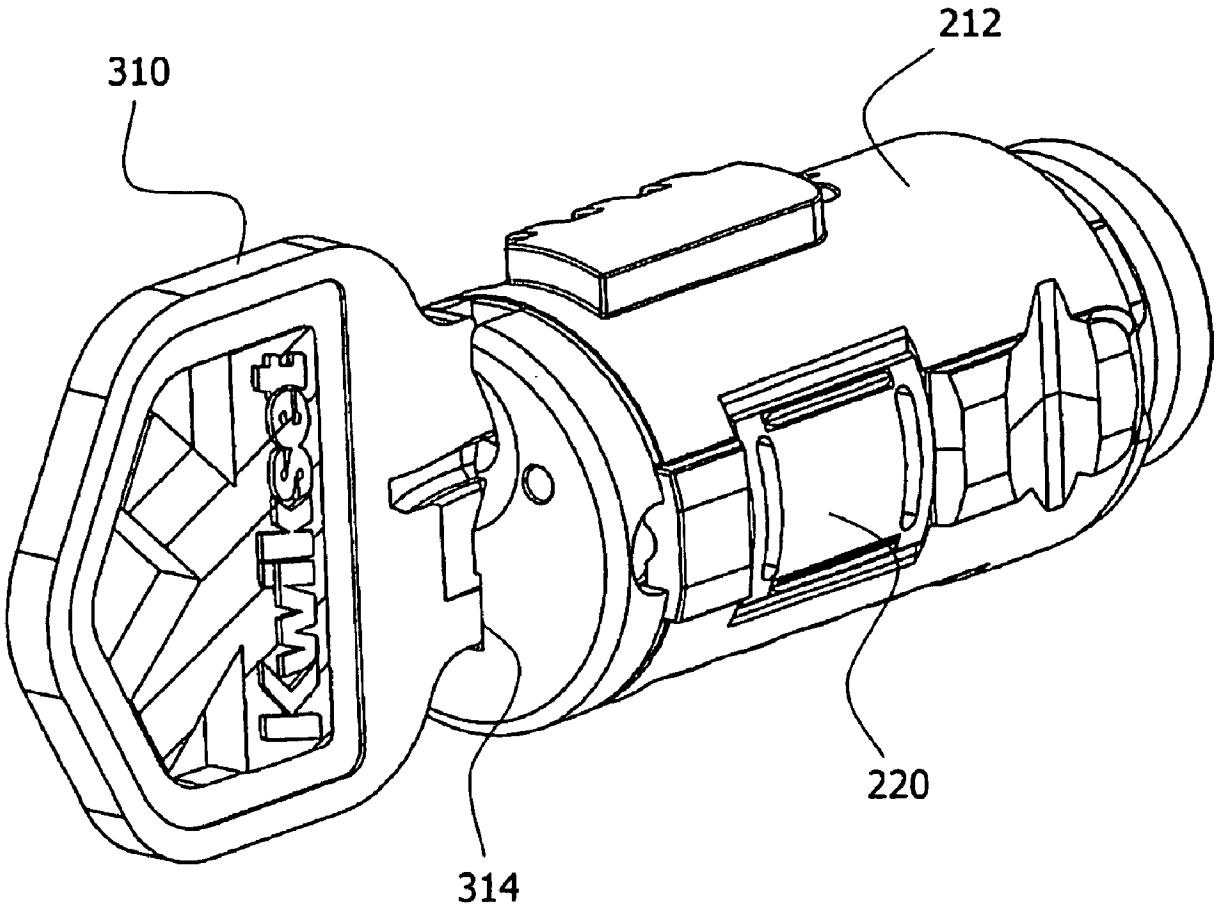
FIG. 49 shows the removable side panel reinstalled on the cylinder body.

At step S132, without removing the rack removal key 310, the removable side panel 220 is reinstalled as shown in FIG. 49 on to the cylinder body 212 so that the locking bar 364 engages with the master locking bar-receiving groove 370 of each replacement master rack 368A-368E of the plurality of replacement master racks 368, thereby coupling all of the plurality of replacement master racks 368 together.

Figure 50:
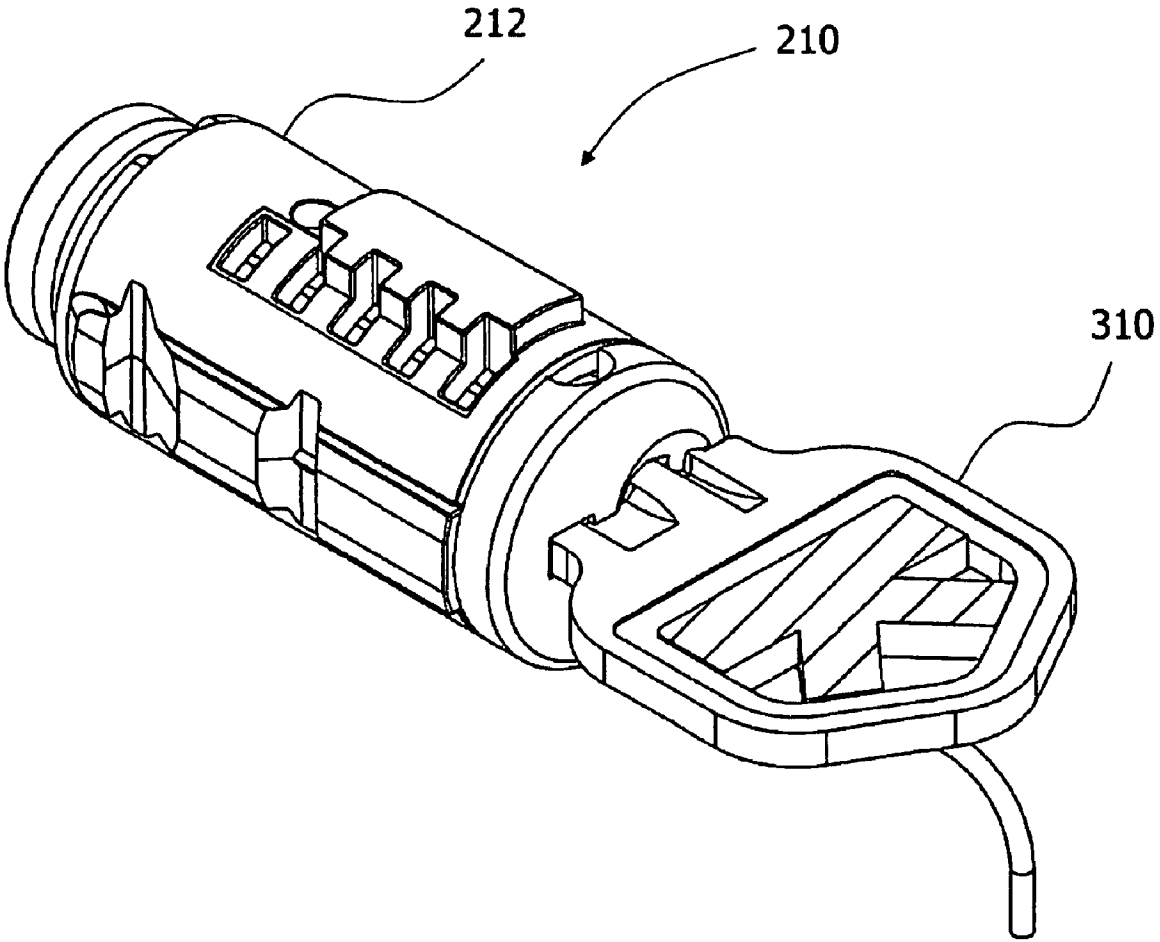
FIG. 50 shows the plug assembly in the learn mode position.

At step S134, the plug assembly 316 is rotated by approximately 90 degrees in a second rotational direction, e.g., clockwise, opposite to the first rotational direction, by a corresponding rotation of rack removal key 310. This places the plug assembly in the learn mode position, as shown in FIG. 50.

Figure 51:
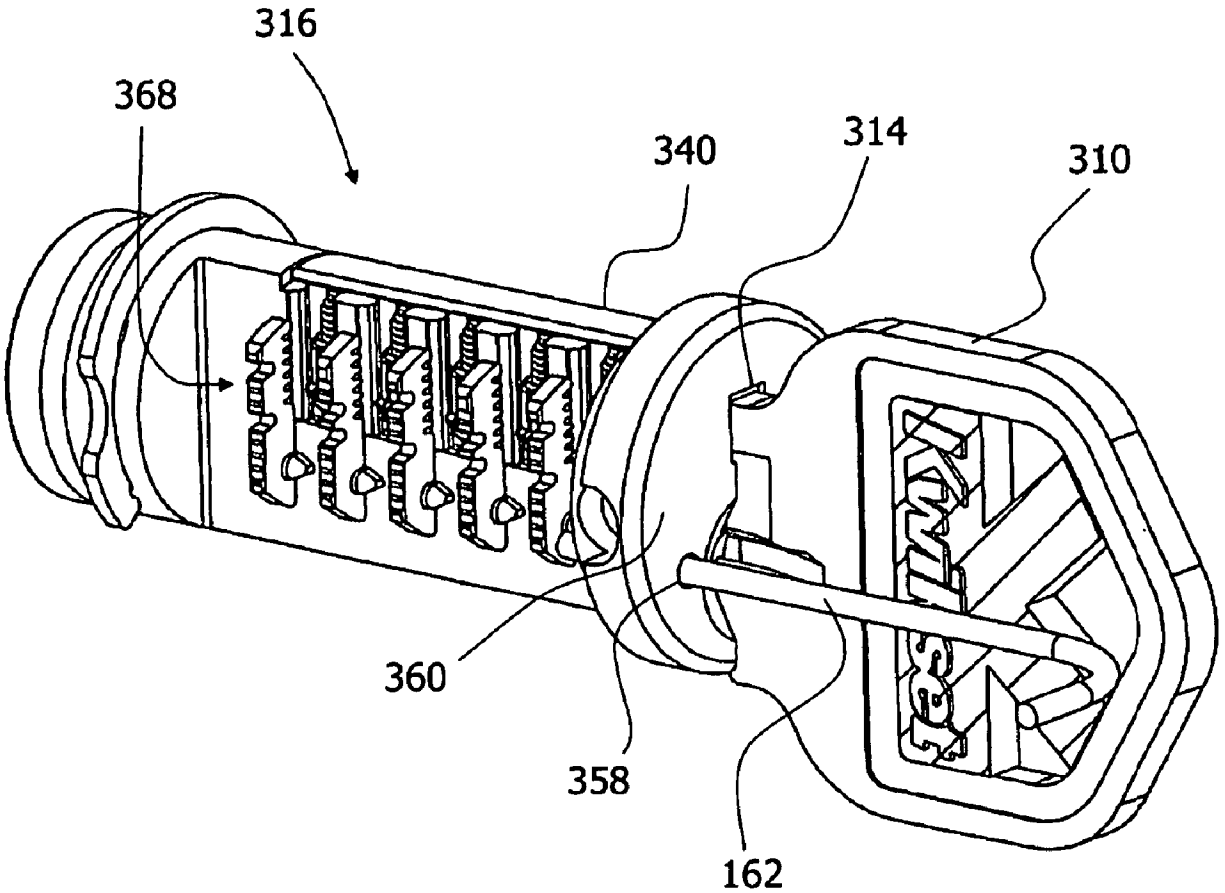
FIG. 51 shows the individual positions of each of the plurality of replacement master racks when the carrier sub-assembly is moved to the retracted position.

At step S136, the carrier sub-assembly 346 is subsequently moved to the retracted position to decouple the plurality of replacement master racks 368 from the plurality of pins 244 and position the protrusion grooves 372 of each replacement master rack 368A-368E over a corresponding protrusion feature 344 on the plug body 340. The movement of carrier sub-assembly may be effected by the rack carrier moving tool 162, by inserting the tool 162 into the rekeying tool opening 358 in the plug face 360 of the plug assembly 316. The individual positions of each of the plurality of replacement master racks 368 is shown in FIG. 51.

At step S138, the rack removal key 310 is removed from the keyway 314.

Figure 52:
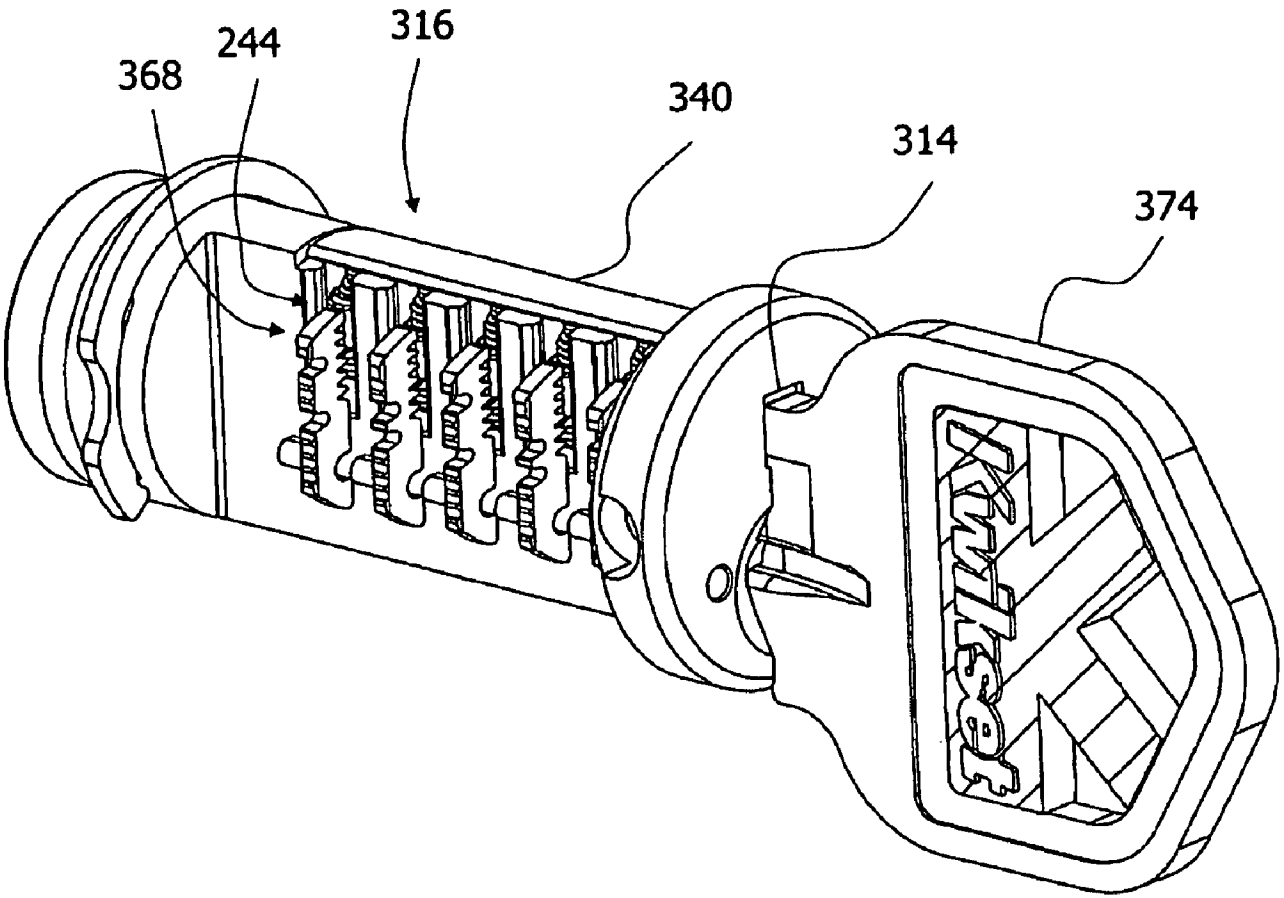
FIG. 52 shows the plug body rotated by a new master key in the second rotational direction back to the original position so as to reengage the plurality of replacement master racks with the plurality of pins.

At step S140, a new master key 374 is inserted into the keyway 314, as shown in FIG. 52.

At step S142, the plug body 340 is rotated in the second rotational direction back to the original position, as shown in FIG. 52, by a corresponding rotation of the new master key 374, to release the carrier sub-assembly 346 from the retracted position to reengage the plurality of replacement master racks 368 with the plurality of pins 244, to thereby learn the cut of the new master key 374, thereby completing the rekeying of lock cylinder 210 to the new master key 374.

In the embodiments that are depicted in FIGS. 53-61B, each of lock cylinder 10 and lock cylinder 210, described above, may be converted for use in a mortise lock mechanism application. In the discussion that follows, reference will be made to a lock cylinder 410 with respect to a single lock cylinder embodiment of FIGS. 53-55, and reference will be made to lock cylinders 510-1 and 510-2 with respect to the two lock cylinder embodiment of FIGS. 56-61B. It is to be understood that each of lock cylinders 410, 510-1 and 510-2 may be configured with the components and operational characteristics described above with respect to either of lock cylinder 10 or lock cylinder 210 so as to facilitate rekeying, and such description is incorporated by reference for use in association with each of lock cylinders 410, 510-1 and 510-2. Thus, for ease of discussion, the description of the internal components and rekeying aspects of lock cylinders 410, 510-1 and 510-2 will not be repeated here.

Figure 53:
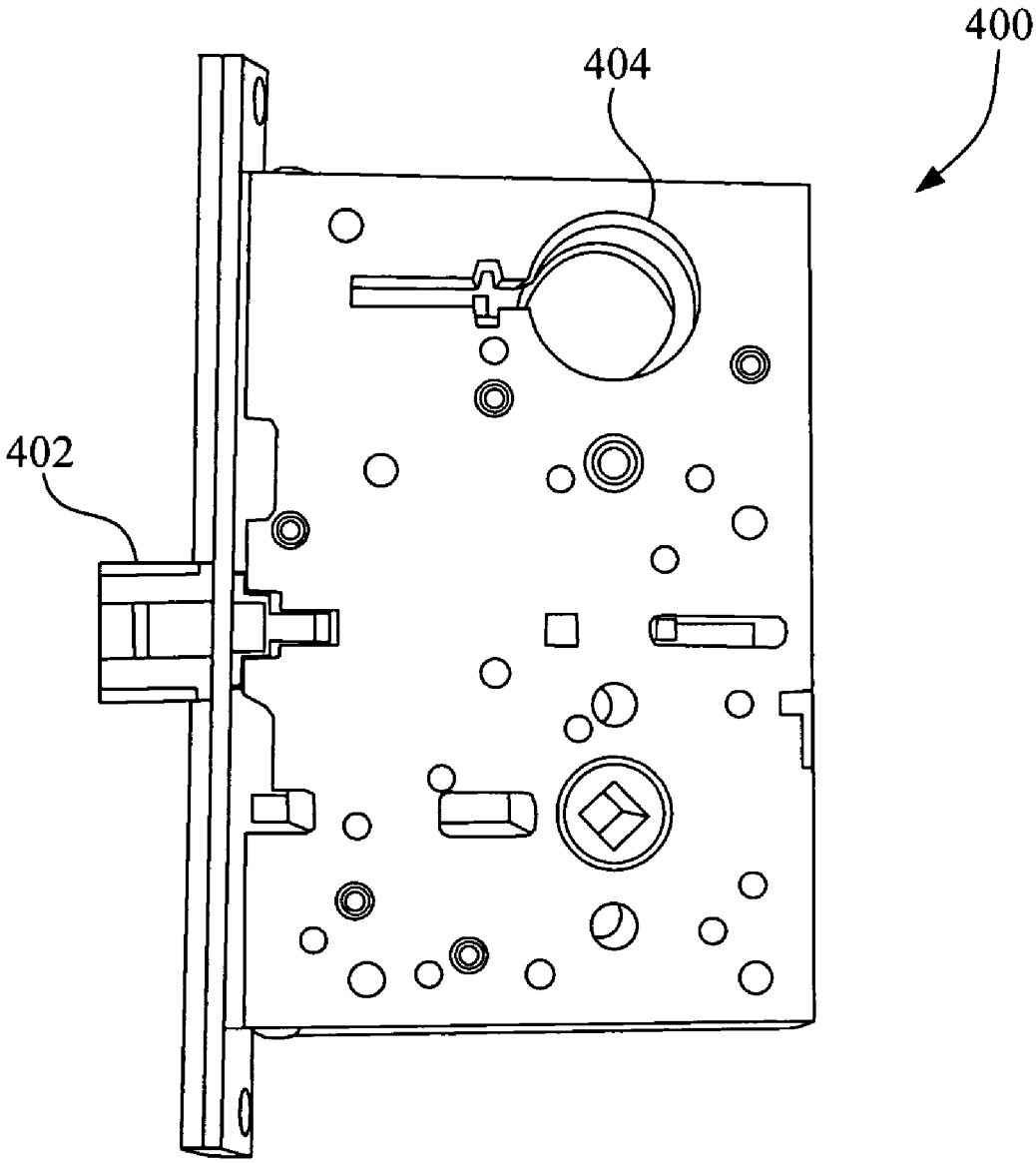
FIG. 53 is a perspective view of a mortise lock having an opening for receiving a rekeyable lock cylinder assembly configured in accordance with an embodiment of the present invention.
Figure 54:
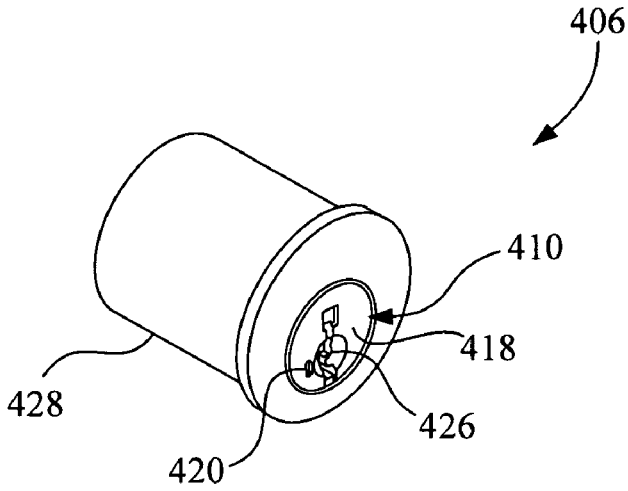
FIG. 54 is a perspective view of a rekeyable lock cylinder assembly configured for use with the mortise lock of FIG. 53.

Referring to FIG. 53, there is shown a mortise lock 400 of a type well known in the art having bolt 402, and an opening 404. Referring also to FIG. 54, there is shown a rekeyable lock cylinder assembly 406 in accordance with an embodiment of the present invention, which is configured and sized to be received in opening 404 of mortise lock 400.

Figure 55:
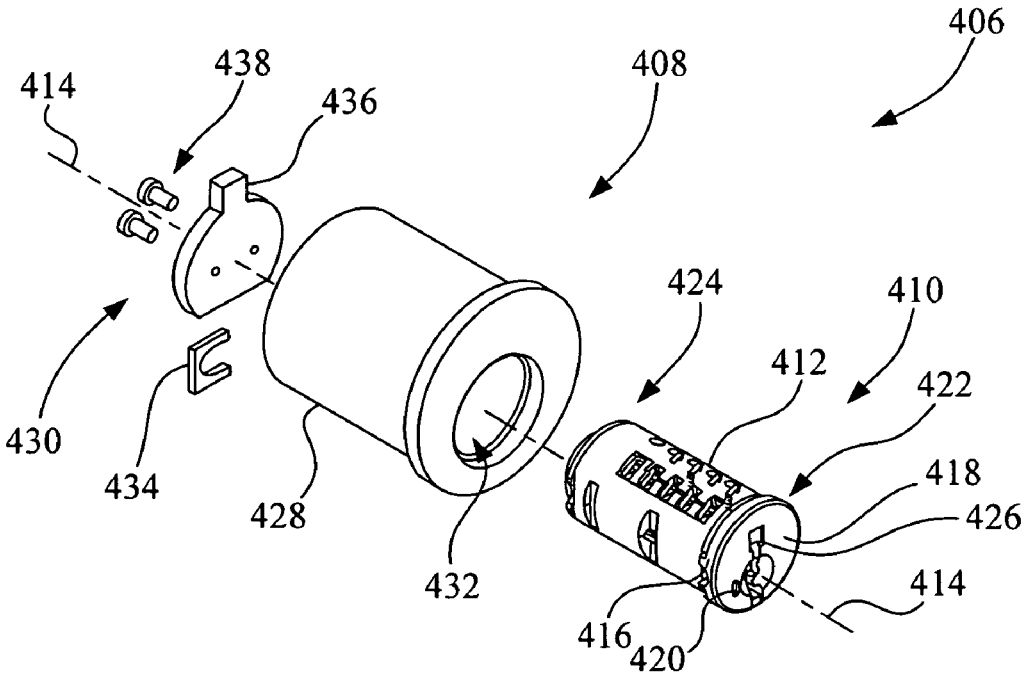
FIG. 55 is an exploded perspective view of the rekeyable lock cylinder assembly of FIG. 54.

Referring also to FIG. 55, rekeyable lock cylinder assembly 406 includes a mortise lock adapter 408 for adapting lock cylinder 410 for use with mortise lock 400. Lock cylinder 410 includes a cylinder body 412 with a longitudinal axis 414. A plug assembly 416 is disposed in cylinder body 412 and is rotatable about longitudinal axis 414. Plug assembly 416 has a lock face 418 with a tool receiving aperture 420. Plug assembly 416 has a proximal end 422 and a distal end 424 separated from the proximal end 422, with the proximal end 422 being located nearest to lock face 418. Plug assembly 416 has a keyway 426 extending from proximal end 422 toward distal end 424 that is configured for receiving a key, such as for example key 160 (FIG. 8) or key 354 (FIG. 33).

Mortise lock adapter 408 includes a housing 428 and a mortise lock actuator 430.

Housing 428 is configured with a longitudinal cavity 432 for receiving cylinder body 412 of lock cylinder 410. Lock cylinder 410 may be mounted to housing 428 using a fastener 434, such as for example, a clip, or one or more screws.

Mortise lock actuator 430 is coupled to distal end 424 of plug assembly 416 of lock cylinder 410. In the present embodiment, mortise lock actuator 430 is a cam 436 that is attached to distal end 424 of plug assembly 416 by fasteners 438, such as screws.

When rekeyable lock cylinder assembly 406 (see FIG. 54) is inserted into opening 404 of mortise lock 400 (see FIG. 53), cam 436 (see FIG. 55) may be engaged with a linking device (not shown) to selectively operate bolt 402 of mortise lock 400.

Figure 56:
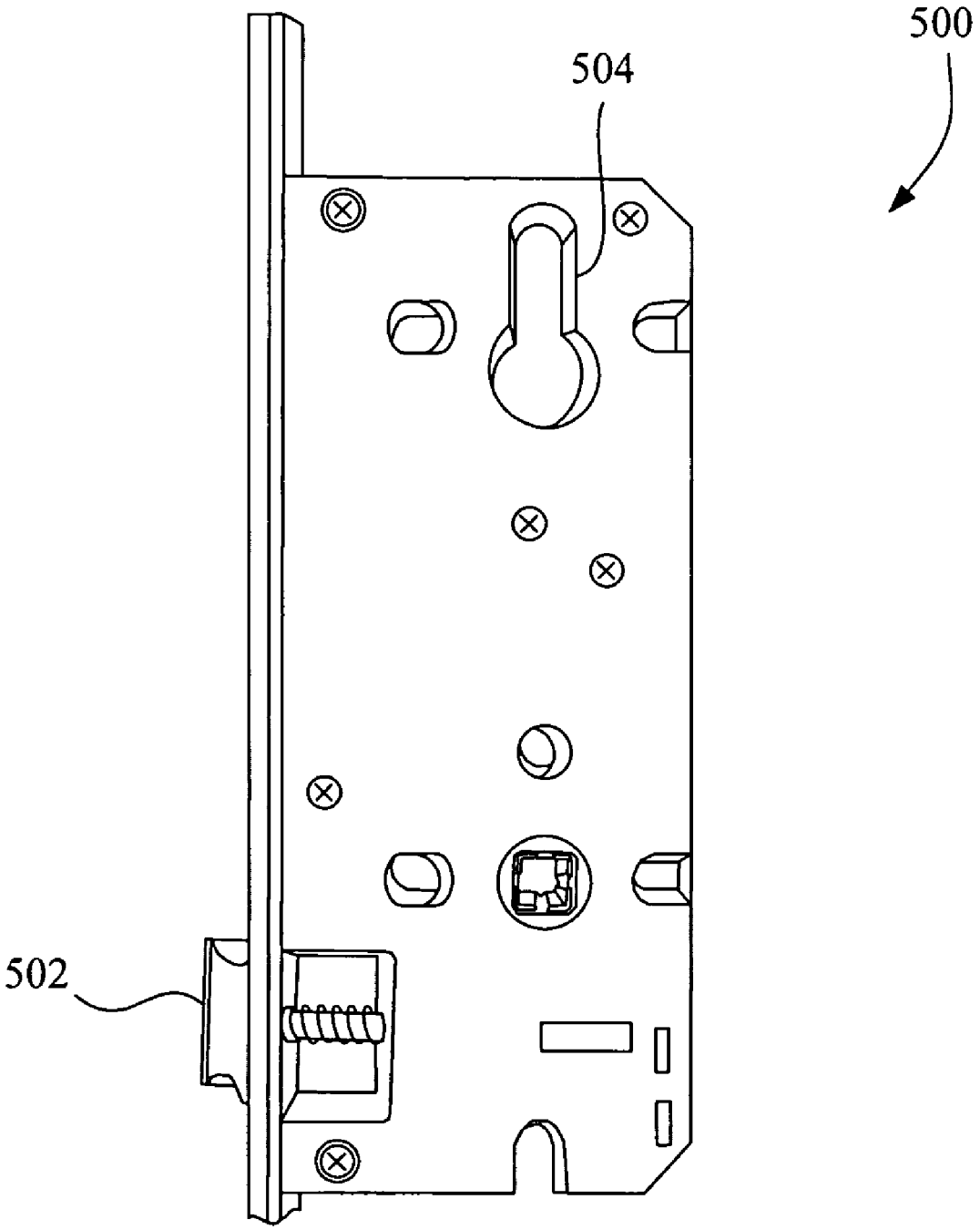
FIG. 56 is a perspective view of another mortise lock having an opening for receiving a rekeyable lock cylinder assembly configured in accordance with an embodiment of the present invention.
Figure 57:
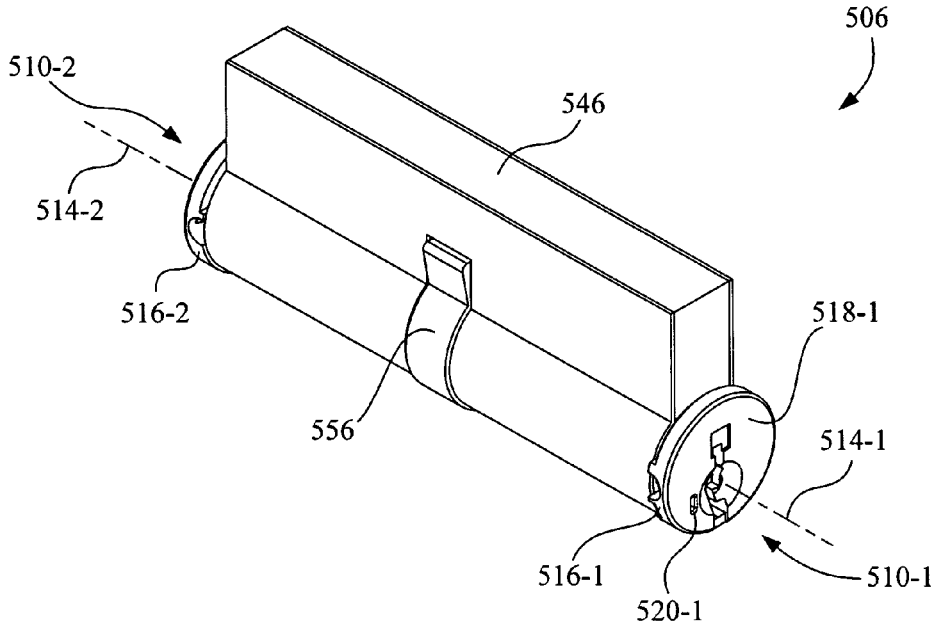
FIG. 57 is a perspective view of a rekeyable lock cylinder assembly configured for use with the mortise lock of FIG. 56.
Figure 58:
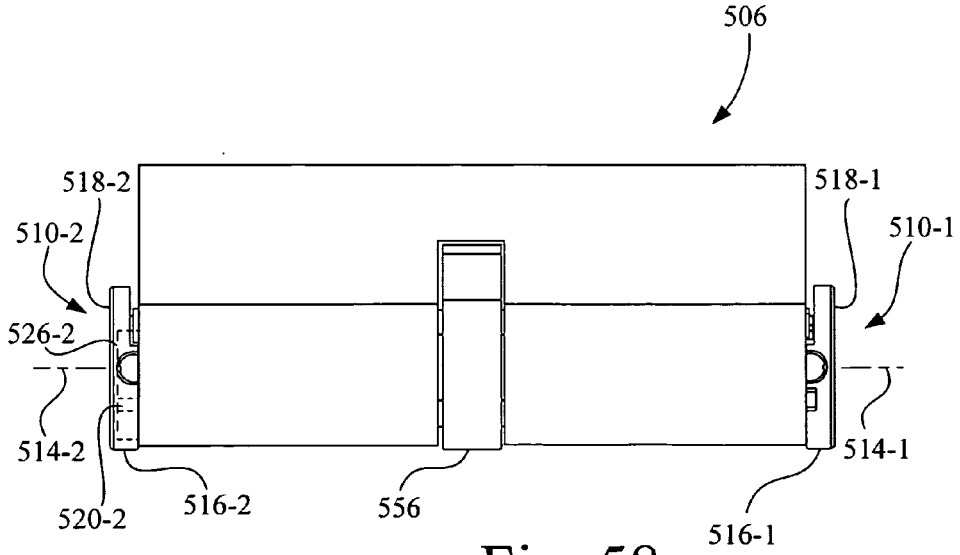
FIG. 58 is a side view of the rekeyable lock cylinder assembly of FIG. 57.

Referring to FIG. 56, there is shown another mortise lock 500 of a type well known in the art having bolt 502, and an opening 504 shaped to receive a profile lock cylinder. Referring also to FIGS. 57 and 58, there is shown a rekeyable lock cylinder assembly 506 in accordance with an embodiment of the present invention, which is configured and sized to be received in opening 504 of mortise lock 500.

Figure 59:
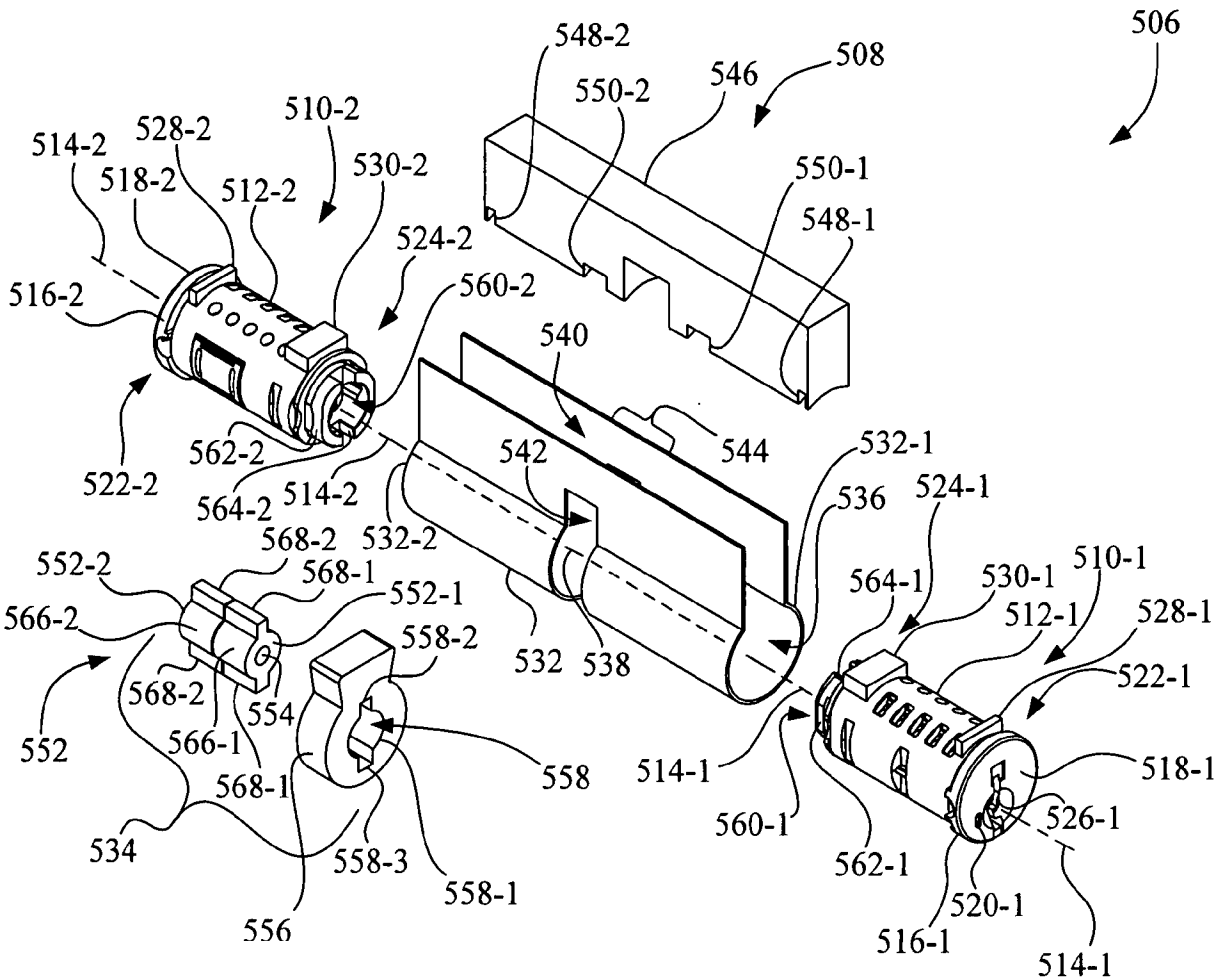
FIG. 59 is an exploded perspective view of the rekeyable lock cylinder assembly of FIGS. 57 and 58.

Referring also to FIG. 59, rekeyable lock cylinder assembly 506 includes a mortise lock adapter 508 for adapting lock cylinders 510-1 and 510-2 for use with mortise lock 500.

First lock cylinder 510-1 includes a cylinder body 512-1 with a longitudinal axis 514-1. A plug assembly 516-1 is disposed in cylinder body 512-1 and is rotatable about longitudinal axis 514-1. Plug assembly 516-1 has a lock face 518-1 with a tool receiving aperture 520-1. Plug assembly 516-1 has a proximal end 522-1 and a distal end 524-1 separated from the proximal end 522-1, with the proximal end 522-1 being located nearest to lock face 518-1. Plug assembly 516-1 has a keyway 526-1 extending from proximal end 522-1 toward distal end 524-1 that is configured for receiving a key, such as for example key 160 (FIG. 8) or key 354 (FIG. 33).

Cylinder body 512-1 includes a mounting feature 528-1 and a mounting feature 530-1, which are spaced apart along the longitudinal extent of cylinder body 512-1 along longitudinal axis 514-1. Mounting features 528-1 and 530-1 may be configured, for example, as a pair of upwardly extending rectangular protrusions. Those skilled in the art will recognize that mounting features 528-1 and 530-1 may be of other shapes and exterior profiles, such as cylindrical, and may alternatively be a recessed area in cylinder body 512-1. Also, the number of mounting features may be one or more.

Second lock cylinder 510-2 includes a cylinder body 512-2 with a longitudinal axis 514-2. A plug assembly 516-2 is disposed in cylinder body 512-2 and is rotatable about longitudinal axis 514-2. As best shown in FIG. 58, plug assembly 516-2 has a lock face 518-2 with a tool receiving aperture 520-2. Referring again to FIG. 59, plug assembly 516-2 has a proximal end 522-2 and a distal end 524-2 separated from the proximal end 522-2, with the proximal end 522-2 being located nearest to lock face 518-2. Referring to FIGS. 58 and 59, plug assembly 516-2 has a keyway 526-2 extending from proximal end 522-2 toward distal end 524-2 that is configured for receiving a key, such as for example key 160 (FIG. 8) or key 354 (FIG. 33).

Cylinder body 512-2 includes a mounting feature 528-2 and a mounting feature 530-2, which are spaced apart along the longitudinal extent of cylinder body 512-2 along longitudinal axis 514-2. Mounting features 528-2 and 530-2 may be configured, for example, as a pair of upwardly extending rectangular protrusions. Those skilled in the art will recognize that mounting features 528-2 and 530-2 may be of other shapes and exterior profiles, such as cylindrical, and may alternatively be a recessed area in cylinder body 512-2. Also, the number of mounting features may be one or more.

Mortise lock adapter 508 includes a housing 532 and a mortise lock actuator 534.

Housing 532 is configured with a longitudinal cavity 536 for receiving first lock cylinder 510-1 and second lock cylinder 510-2. Longitudinal cavity 536 defines a co-axis of rotation 538 for first lock cylinder 510-1 and second lock cylinder 510-2, which corresponds to longitudinal axis 514-1 of plug assembly 516-1 of first lock cylinder 510-1 and to longitudinal axis 514-2 of plug assembly 516-2 of second lock cylinder 510-2.

Housing 532 has a first end 532-1 spaced apart from a second end 532-2 along longitudinal cavity 536. Cylinder body 512-1 of first lock cylinder 510-1 is received into longitudinal cavity 536 of housing 532 at first end 532-1. Cylinder body 512-2 of second lock cylinder 510-2 is received into longitudinal cavity 536 of housing 532 at second end 532-2. Housing 532 has a longitudinal slot 540 that is parallel to and adjacent to longitudinal cavity 536. Housing 532 has a cam slot 542 that extends perpendicular to the extent of longitudinal cavity 536 and longitudinal slot 540 in a central portion 544 of housing 532.

Mortise lock adapter 508 also includes an elongate member 546 configured for insertion into longitudinal slot 540 of housing 532. Elongate member 546 has mounting features 548-1 and 550-1 configured for engaging the corresponding mounting features 528-1 and 530-1 of first lock cylinder 510-1, and has mounting features 548-2 and 550-2 configured for engaging the corresponding mounting features 528-2 and 530-2 of second lock cylinder 510-2. Mounting features 548-1, 550-1, 548-2 and 550-2 of elongate member 546 hold first lock cylinder 510-1 and second lock cylinder 510-2 in housing 532 at a fixed location when elongate member 546 is mounted in longitudinal slot 540. The mounting of elongate member 546 in longitudinal slot 540 may be accomplished, for example, by heat staking or mechanically staking elongate member 546 to housing 532.

Mortise lock actuator 534 includes a split driver 552 and a cam 556. Split driver 552 has a first drive portion 552-1 rotatably coupled to a second drive portion 552-2. The rotatable coupling of first drive portion 552-1 and second drive portion 552-2 may be accomplished, for example, by pin/hole arrangement 554.

Figure 60:
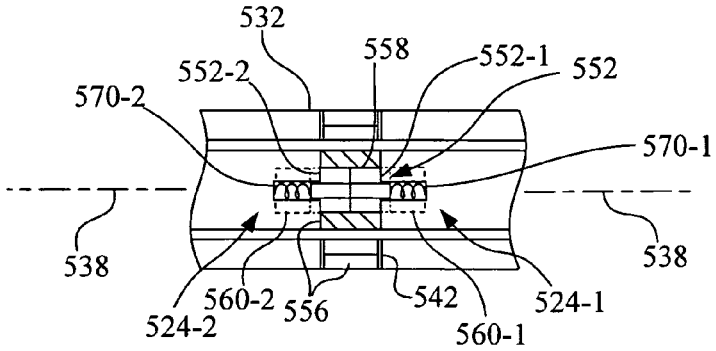
FIG. 60 is a top view of a central portion of the rekeyable lock cylinder assembly of FIG. 57, with the elongate member removed and a portion of the cam sectioned away to expose the split driver in its normal position.

Cam 556 has an opening 558 that receives split driver 552 in a sliding relationship. Opening 558 has an end view profile corresponding to that of the end view exterior shape of split driver 552. In the present embodiment, for example, opening 558 has a cylindrical bore 558-1, with diametric slots 558-2, 558-3 extending radially outwardly from cylindrical bore 558-1. Referring also to FIG. 60, opening 558 facilitates lateral movement of split driver 552 along co-axis of rotation 538 independent of cam 556, while facilitating a driving interaction between split driver 552 and cam 556 in a rotational direction around co-axis of rotation 538.

The distal end 524-1 of plug assembly plug assembly 516-1 of first lock cylinder 510-1 is configured and positioned to drivably engage first drive portion 552-1 of split driver 552. In particular, for example, with reference to FIGS. 59 and 60, distal end 524-1 of plug assembly 516-1 may include a cylindrical recess 560-1 that defines a side wall 562-1, with slots 564-1 formed in side wall 562-1. First drive portion 552-1 of split driver 552 may be formed as a cylinder 566-1 having radially extending protrusions 568-1. Cylinder 566-1 of first drive portion 552-1 is received in cylindrical recess 560-1 of plug assembly 516-1, and the radially extending protrusions 568-1 of first drive portion 552-1 are received in slots 564-1 of plug assembly 516-1, along co-axis of rotation 538.

The distal end 524-2 of plug assembly plug assembly 516-2 of second lock cylinder 510-2 is configured and positioned to drivably engage second drive portion 552-2 of split driver 552. In particular, for example, distal end 524-2 of plug assembly 516-2 may include a cylindrical recess 560-2 that defines a side wall 562-2, with slots 564-2 formed in side wall 562-2. Second drive portion 552-2 of split driver 552 may be formed as a cylinder 566-2 having radially extending protrusions 568-2. Cylinder 566-2 of second drive portion 552-2 is received in cylindrical recess 560-2 of plug assembly 516-2, and the radially extending protrusions 568-2 of second drive portion 552-2 are received in slots 564-2 of plug assembly 516-2, along co-axis of rotation 538.

Thus, split driver 552 has direct radial support relative to co-axis of rotation 538 provided only by the distal end 524-1 of plug assembly 516-1 of first lock cylinder 510-1 and the distal end 524-2 of plug assembly 516-2 of second lock cylinder 510-2. In turn, cam 556 has direct radial support relative to co-axis of rotation 538 provided only by split driver 552. In other words, cam 556 is not directly supported by housing 532 relative to co-axis of rotation 538.

Referring to FIG. 60 in relation to FIG. 59, a first spring 570-1 is interposed between the distal end 524-1 of plug assembly 516-1 of first lock cylinder 510-1 and first drive portion 552-1 of split driver 552. A second spring 570-2 is interposed between the distal end 524-2 of plug assembly 516-2 of second lock cylinder 510-2 and second drive portion 552-2 of split driver 552. Thus, springs 570-1 and 570-2 bias split driver 552 to be centered in cam 556 when in a normal state, i.e., in a state not acted upon by a key.

When a key is inserted into plug assembly 516-1 of first lock cylinder 510-1, split driver 552 is moved laterally along co-axis of rotation 538 to position first drive portion 552-1 of split driver 552 in driving engagement with cam 556 in opening 558 of cam 556, and simultaneously second drive portion 552-2 of split driver 552 is positioned to be out of driving engagement with cam 556, i.e., second drive portion 552-2 is slid through opening 558 of cam 556 to be completely outside cam 556. Movement of split driver 552 laterally along co-axis of rotation 538 may be effected, for example, by direct contact with the tip of the key as the key is fully inserted into keyway 526-1 of plug assembly 516-1.

When a key is inserted into plug assembly 516-2 of second lock cylinder 510-2, split driver 552 is moved laterally along co-axis of rotation 538 to position second drive portion 552-2 of split driver 552 in driving engagement with cam 556 in opening 558 of cam 556, and simultaneously first drive portion 552-1 of split driver 552 is positioned to be out of driving engagement with cam 556, i.e., first drive portion 552-1 is slid through opening 558 of cam 556 to be completely outside cam 556. Movement of split driver 552 laterally along co-axis of rotation 538 may be effected, for example, by direct contact with the tip of the key as the key is fully inserted into keyway 526-2 of plug assembly 516-2.

When rekeyable lock cylinder assembly 506 is inserted into opening 504 of mortise lock 500 (see FIG. 56), cam 556 (see FIGS. 57-59) may be engaged with a linking device (not shown) to selectively operate bolt 502 of mortise lock 500.

Figure 61A:
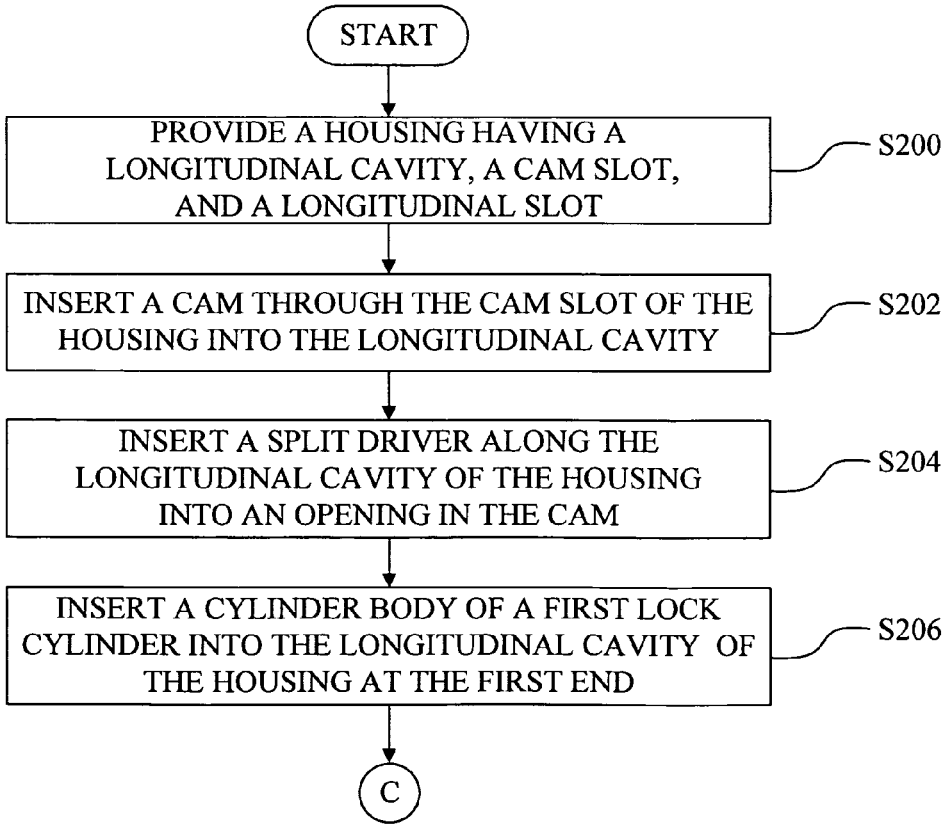
FIGS. 61A and 61B show a flowchart representing a method for assembling the rekeyable lock cylinder assembly of FIGS. 57-60.
Figure 61B:
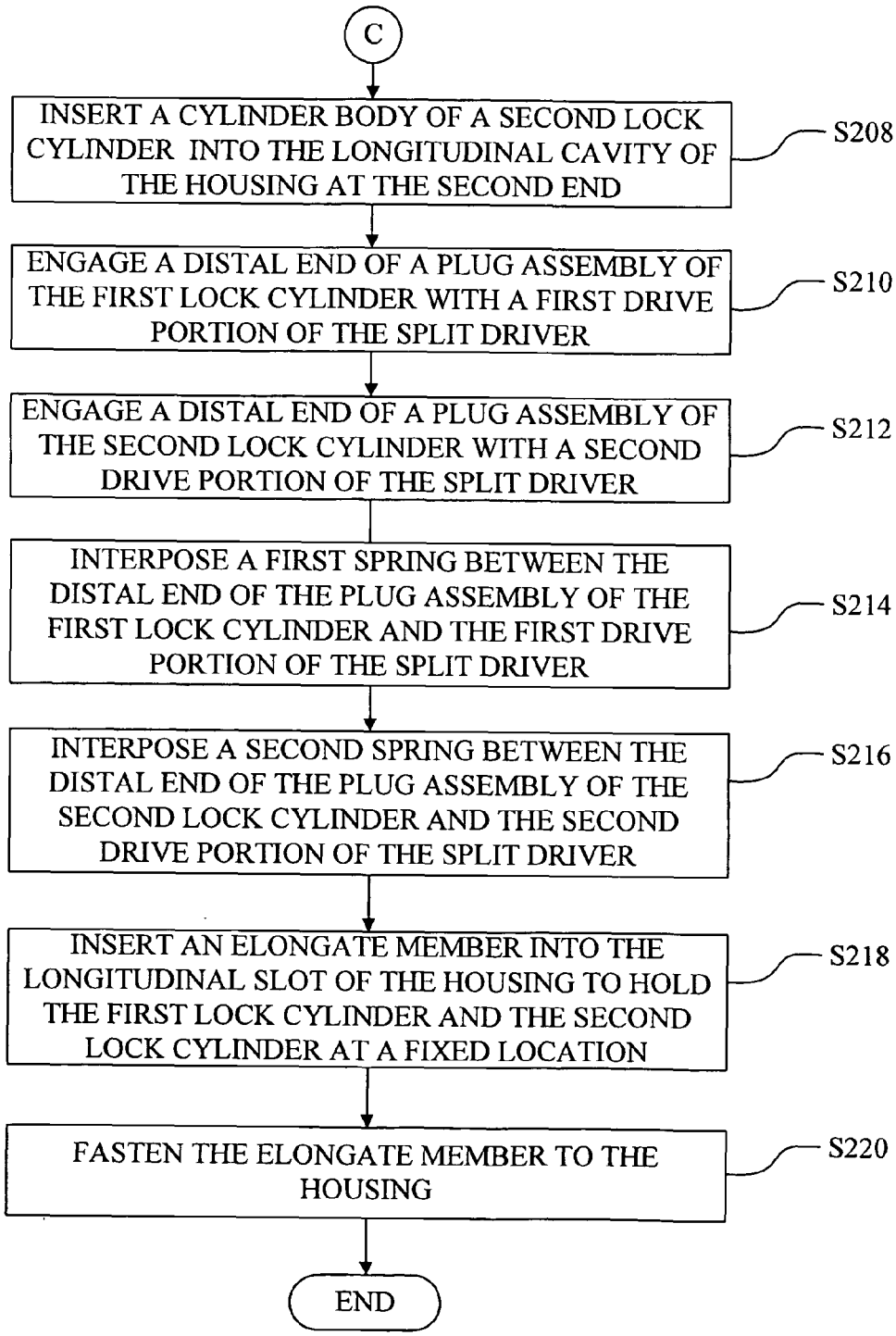
Figure 62:
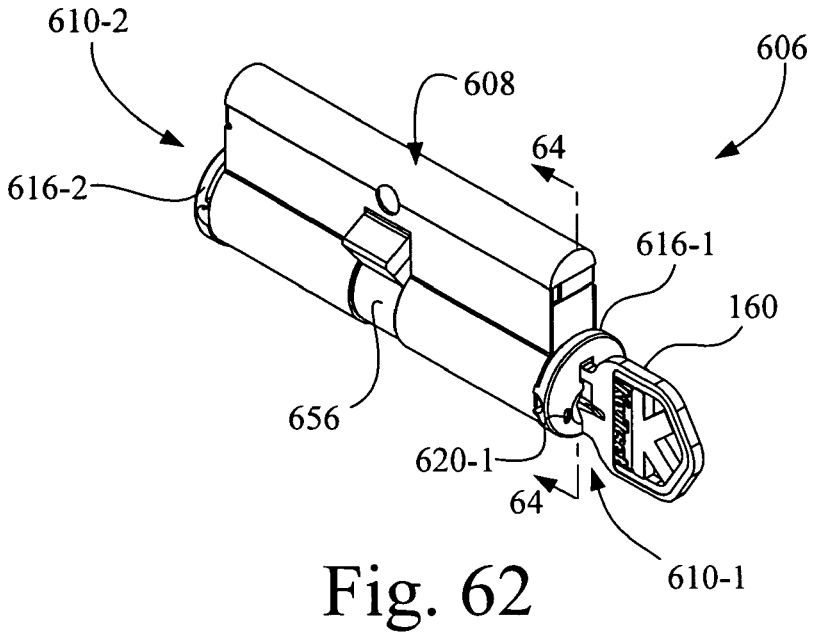
FIG. 62 is a perspective view of another rekeyable lock cylinder assembly configured for use with the mortise lock of FIG. 56.

FIGS. 61A and 61B show a flowchart representing a method for assembling rekeyable lock cylinder assembly 506.

At act S200, housing 532 is provided, which has first end 532-1 spaced apart from second end 532-2 along longitudinal cavity 536. Longitudinal slot 540 of housing 532 is parallel to and adjacent to longitudinal cavity 536. Cam slot 542 extends perpendicular to the extent of longitudinal cavity 536 and longitudinal slot 540 in central portion 544 of housing 532.

At act S202, cam 556 is inserted through cam slot 542 of housing 532 into longitudinal cavity 536.

At act S204, split driver 552 is inserted along longitudinal cavity 536 of housing 532, i.e., parallel to co-axis of rotation 538, into opening 558 in cam 556. Opening 558 of cam 556 receives split driver 552 in a sliding relationship.

At act S206, cylinder body 512-1 of first lock cylinder 510-1 is inserted into longitudinal cavity 536 of housing 532 at first end 532-1.

At act S208, cylinder body 512-2 of second lock cylinder 510-2 is inserted into longitudinal cavity 536 of housing 532 at second end 532-2.

At act S210, distal end 524-1 of plug assembly 516-1 of first lock cylinder 510-1 is engaged with first drive portion 552-1 of split driver 552.

At act S212, distal end 524-2 of plug assembly 516-2 of second lock cylinder 510-2 is engaged with second drive portion 552-2 of split driver 552.

At act S214, first spring 570-1 is interposed between distal end 524-1 of plug assembly 516-1 of first lock cylinder 510-1 and first drive portion 552-1 of split driver 552.

At act S216, second spring 570-2 is interposed between distal end 524-2 of plug assembly 516-2 of second lock cylinder 510-2 and second drive portion 552-2 of split driver 552.

At act S218, elongate member 546 is inserted into longitudinal slot 540 of housing 532. Mounting features 548-1, 550-1 and 548-2, 550-2 of elongate member 546 respectively engage mounting features 528-1, 530-1 of first lock cylinder 510-1 and mounting features 528-2, 530-2 of second lock cylinder 510-2 to hold first lock cylinder 510-1 and second lock cylinder 510-2 in housing 532 at a fixed location.

At act S220, elongate member 546 is fastened to housing 532, such as by heat staking or mechanical staking.

Referring now to FIGS. 62-67, there is shown a rekeyable lock cylinder assembly 606 in accordance with another embodiment of the present invention, which is configured and sized to be received in opening 504 of mortise lock 500 of FIG. 56. Rekeyable lock cylinder assembly 606 includes a mortise lock adapter 608 for adapting lock cylinders 610-1 and 610-2 for use with mortise lock 500.

It is to be understood that each of lock cylinders 610-1 and 610-2 may be configured with the components and operational characteristics described above with respect to either of lock cylinder 10 or lock cylinder 210 so as to facilitate rekeying, and such description is incorporated by reference for use in association with lock cylinders 610-1 and 610-2. Thus, for ease of discussion, a description of the internal components and rekeying aspects of lock cylinders 610-1 and 610-2 will not be repeated here.

Figure 63:
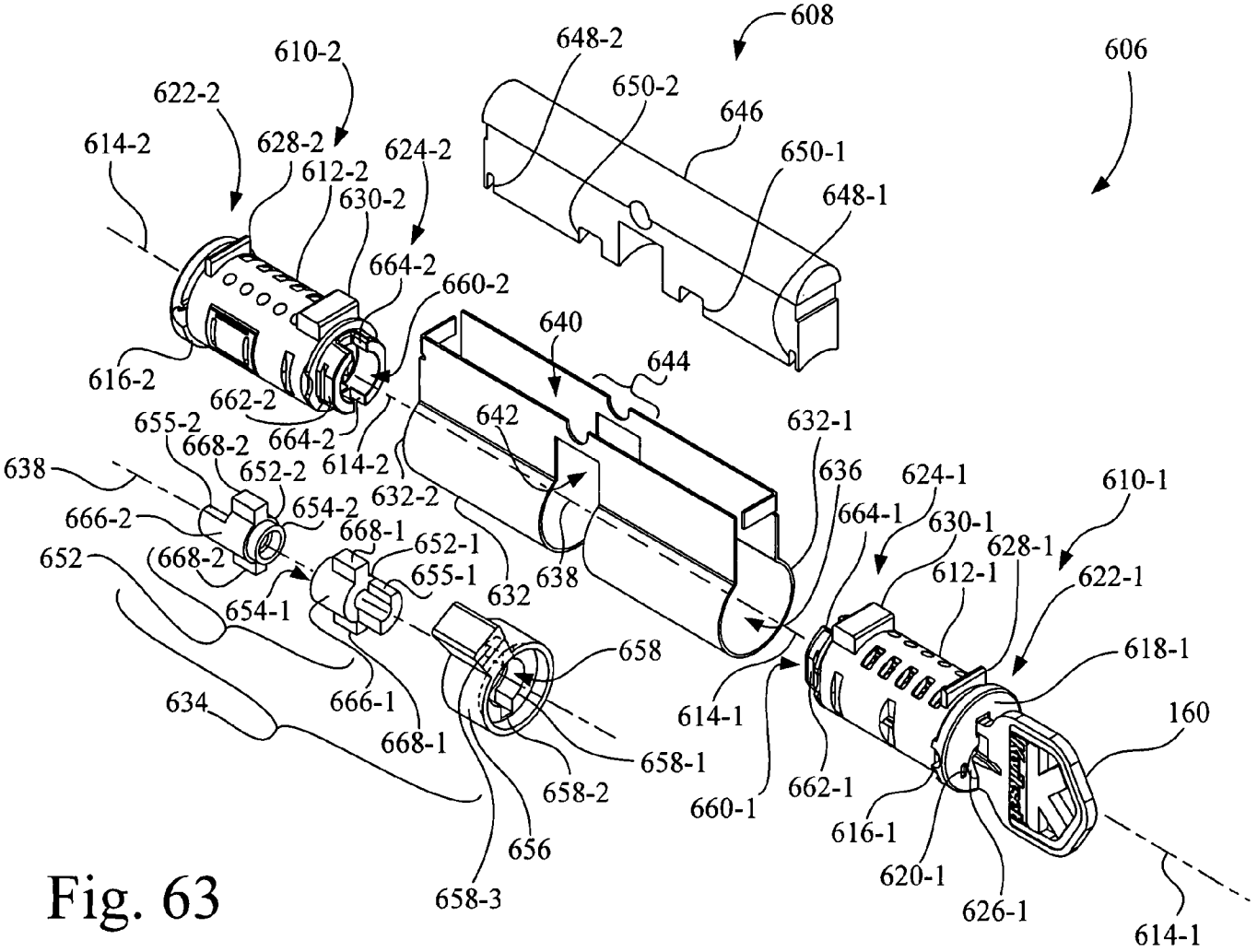
FIG. 63 is an exploded perspective view of the rekeyable lock cylinder assembly of FIG. 62.

As best shown in FIG. 63, first lock cylinder 610-1 includes a cylinder body 612-1 with a longitudinal axis 614-1. A plug assembly 616-1 is disposed in cylinder body 612-1 and is rotatable about longitudinal axis 614-1. Plug assembly 616-1 has a lock face 618-1 with a tool receiving aperture 620-1. Plug assembly 616-1 has a proximal end 622-1 and a distal end 624-1 separated from the proximal end 622-1, with the proximal end 622-1 being located nearest to lock face 618-1. Plug assembly 616-1 has a keyway 626-1 extending from proximal end 622-1 toward distal end 624-1 that is configured for receiving a key, such as for example key 160 (see also FIG. 8) or key 354 (FIG. 33).

Figure 65:
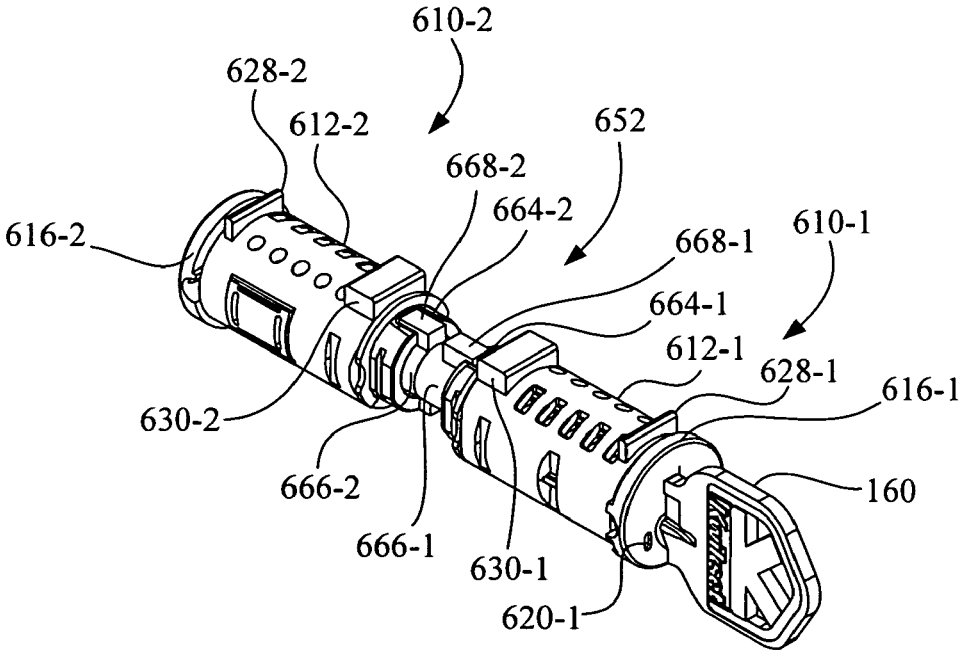
FIG. 65 is a perspective view of a portion of the rekeyable lock cylinder assembly of FIG. 62, absent the housing.
Figure 64:
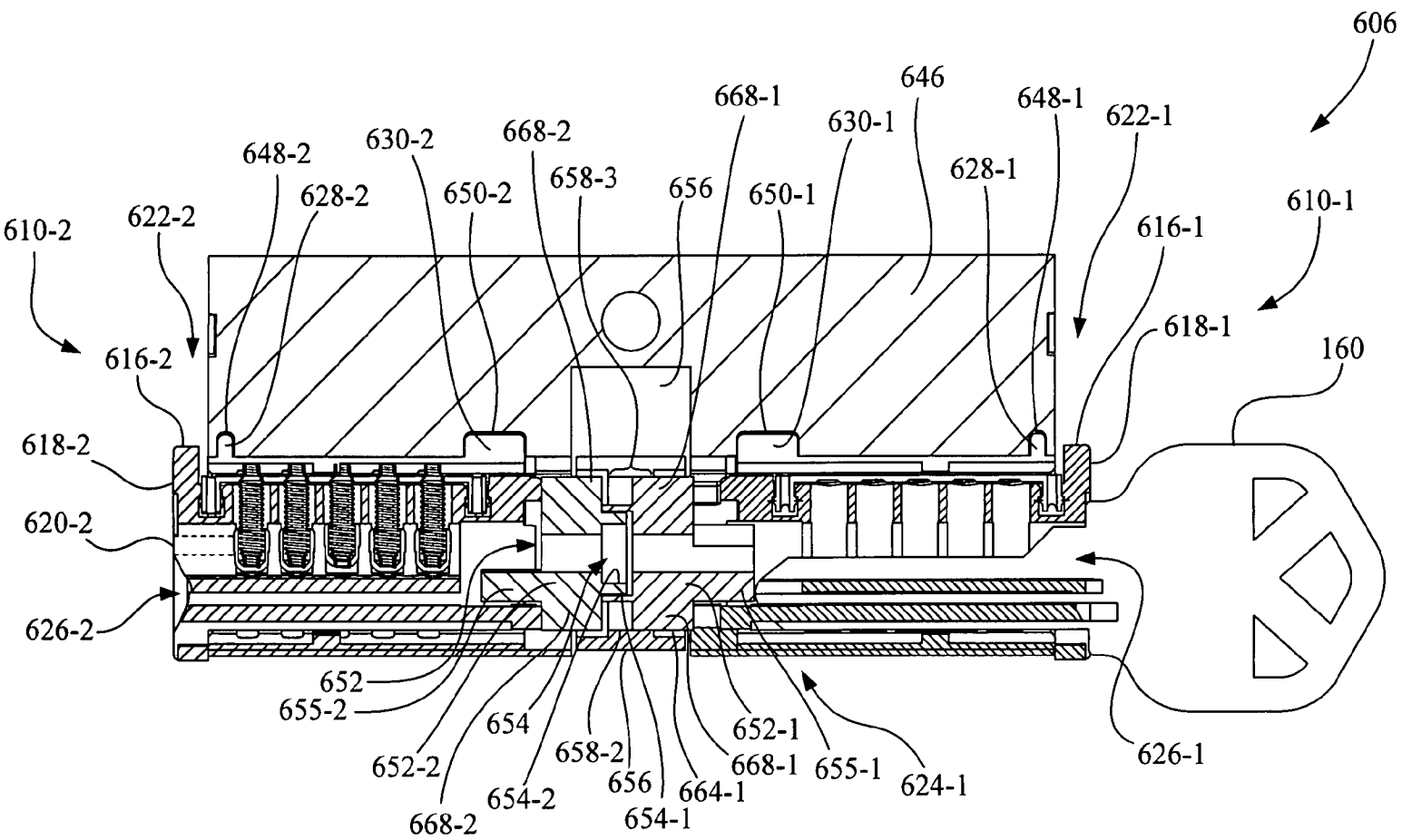
FIG. 64 is a section view of the rekeyable lock cylinder assembly of FIG. 62 taken along line 64-64.
Figure 66:
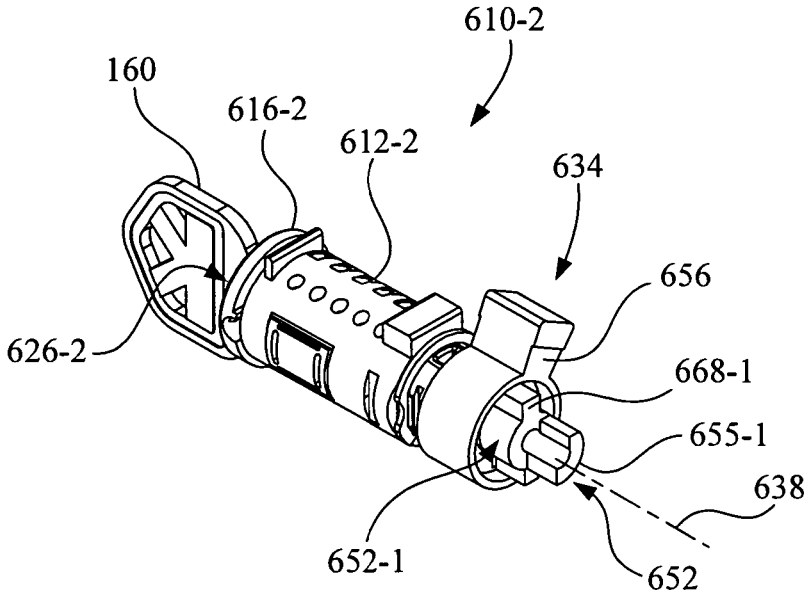
FIG. 66 is a perspective view of a portion of the rekeyable lock cylinder assembly of FIG. 65 having the second lock cylinder removed to more clearly show the cam and cam driver.
Figure 67:
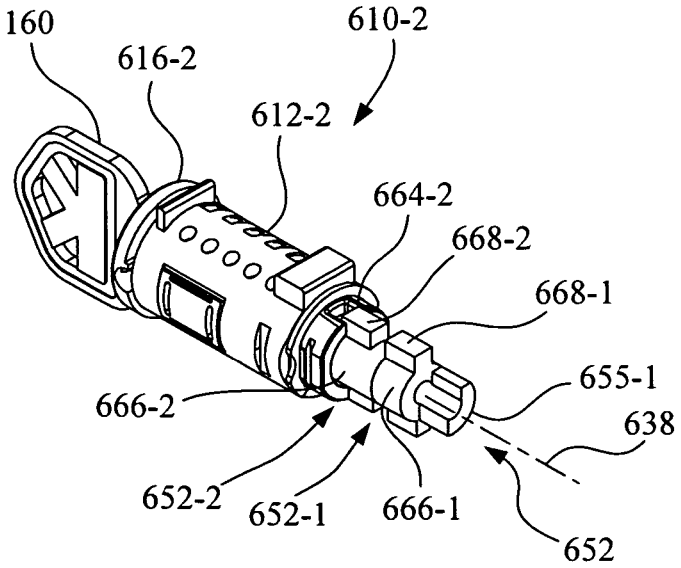
FIG. 67 is a perspective view of a portion of the rekeyable lock cylinder assembly of FIG. 66 having the cam removed to expose the split cam driver.

As shown in FIGS. 63-65, cylinder body 612-1 includes a mounting feature 628-1 and a mounting feature 630-1, which are spaced apart along the longitudinal extent of cylinder body 612-1 along longitudinal axis 614-1. Mounting features 628-1 and 630-1 may be configured, for example, as a pair of upwardly extending rectangular protrusions. Those skilled in the art will recognize that mounting features 628-1 and 630-1 may be of other shapes and exterior profiles, such as cylindrical, and may alternatively be a recessed area in cylinder body 612-1. Also, the number of mounting features may be one or more.

Second lock cylinder 610-2 includes a cylinder body 612-2 with a longitudinal axis 614-2. A plug assembly 616-2 is disposed in cylinder body 612-2 and is rotatable about longitudinal axis 614-2. As best shown in FIG. 64, plug assembly 616-2 has a lock face 618-2 with a tool receiving aperture 620-2. As shown in FIG. 63, plug assembly 616-2 has a proximal end 622-2 and a distal end 624-2 separated from the proximal end 622-2, with the proximal end 622-2 being located nearest to lock face 618-2. Referring again also to FIG. 64, plug assembly 616-2 has a keyway 626-2 extending from proximal end 622-2 toward distal end 624-2 that is configured for receiving a key, such as for example key 160 (see also FIG. 8) or key 354 (FIG. 33).

As shown in FIGS. 63-65, cylinder body 612-2 includes a mounting feature 628-2 and a mounting feature 630-2, which are spaced apart along the longitudinal extent of cylinder body 612-2 along longitudinal axis 614-2. Mounting features 628-2 and 630-2 may be configured, for example, as a pair of upwardly extending rectangular protrusions. Those skilled in the art will recognize that mounting features 628-2 and 630-2 may be of other shapes and exterior profiles, such as cylindrical, and may alternatively be a recessed area in cylinder body 612-2. Also, the number of mounting features may be one or more.

Referring to FIG. 63, mortise lock adapter 608 includes a housing 632 and a mortise lock actuator 634.

Housing 632 is configured with a longitudinal (e.g., cylindrical) cavity 636 for receiving first lock cylinder 610-1 and second lock cylinder 610-2. Longitudinal cavity 636 defines a co-axis of rotation 638 for first lock cylinder 610-1 and second lock cylinder 610-2, which corresponds to longitudinal axis 614-1 of plug assembly 616-1 of first lock cylinder 610-1 and to longitudinal axis 614-2 of plug assembly 616-2 of second lock cylinder 610-2.

Housing 632 has a first end 632-1 spaced apart from a second end 632-2 along longitudinal cavity 636. Cylinder body 612-1 of first lock cylinder 610-1 is received into longitudinal cavity 636 of housing 532 at first end 632-1. Cylinder body 612-2 of second lock cylinder 610-2 is received into longitudinal cavity 636 of housing 632 at second end 632-2. Housing 632 has a longitudinal slot 640 having a longitudinal extent that is parallel to and adjacent to longitudinal cavity 636. Housing 632 has a cam slot 642 that radially extends perpendicular to the longitudinal extent of each of longitudinal cavity 636 and longitudinal slot 640 in a central portion 644 of housing 632 with respect to co-axis of rotation 638.

Mortise lock adapter 608 also includes an elongate member 646 configured for insertion into longitudinal slot 640 of housing 632. Elongate member 646 has mounting features 648-1 and 650-1 configured for engaging the corresponding mounting features 628-1 and 630-1 of first lock cylinder 610-1, and has mounting features 648-2 and 650-2 configured for engaging the corresponding mounting features 628-2 and 630-2 of second lock cylinder 610-2. Mounting features 648-1, 650-1, 648-2 and 650-2 of elongate member 546 hold first lock cylinder 610-1 and second lock cylinder 610-2 in housing 632 at a fixed location when elongate member 646 is mounted in longitudinal slot 640. Mounting features 648-1, 650-1, 648-2 and 650-2 of elongate member 546 prevent longitudinal movement of first lock cylinder 610-1 and second lock cylinder 610-2 in housing 632 along co-axis of rotation 638, as well as prevent rotation of first cylinder body 612-1 of first lock cylinder 610-1 and second cylinder body 612-2 of second lock cylinder 610-2 around co-axis of rotation 638. The mounting of elongate member 646 in longitudinal slot 640 may be accomplished, for example, by mechanically staking or heat staking elongate member 646 to housing 632.

Mortise lock actuator 634 includes a split driver 652 and a cam 656. Split driver 652 has a first drive portion 652-1 rotatably coupled to a second drive portion 652-2. The rotatable coupling of first drive portion 652-1 and second drive portion 652-2 may be accomplished, for example, by a cylindrical recess/post arrangement 654-1, 654-2. Recess 654-1 of first drive portion 652-1 is sized and configured to slidably and rotatably receive post 654-2 of second drive portion 652-2. First drive portion 652-1 includes a first support flange 655-1 having a semi-circular configuration. Second drive portion 652-2 includes a second support flange 655-2 having a semi-circular configuration.

Cam 656 has an opening 658 that receives split driver 652 in a sliding relationship along co-axis of rotation 638. Opening 658 has an end view profile corresponding to that of the end view exterior shape of split driver 652. In the present embodiment, for example, opening 658 has a cylindrical bore 658-1, with diametric slots 658-2, 658-3 extending radially outwardly from cylindrical bore 658-1. Referring also to FIG. 64, opening 658 facilitates lateral movement of split driver 652 along co-axis of rotation 638 independent of cam 656, while facilitating a driving interaction between split driver 652 and cam 656 in a rotational direction around co-axis of rotation 638.

The distal end 624-1 of plug assembly 616-1 of first lock cylinder 610-1 is configured and positioned to drivably engage split driver 652. In particular, for example, with reference to FIGS. 63-65, distal end 624-1 of plug assembly 616-1 may include a cylindrical recess 660-1 that defines a side wall 662-1, with slots 664-1 formed in side wall 662-1. First drive portion 652-1 of split driver 652 may be formed as a cylinder 666-1 having radially extending protrusions 668-1. First support flange 655-1 of first drive portion 652-1 is received in cylindrical recess 660-1 of plug assembly 616-1, and the radially extending protrusions 668-1 of first drive portion 652-1 are received in slots 664-1 of plug assembly 616-1 along co-axis of rotation 638 for driving engagement therewith around co-axis of rotation 638.

The distal end 624-2 of plug assembly plug assembly 616-2 of second lock cylinder 610-2 is configured and positioned to drivably engage second drive portion 652-2 of split driver 652. In particular, for example, distal end 624-2 of plug assembly 616-2 may include a cylindrical recess 660-2 that defines a side wall 662-2, with slots 664-2 formed in side wall 662-2. Second drive portion 652-2 of split driver 652 may be formed as a cylinder 666-2 having radially extending protrusions 668-2. Second support flange 655-2 of second drive portion 652-2 is received in cylindrical recess 660-2 of plug assembly 616-2, and the radially extending protrusions 668-2 of second drive portion 652-2 are received in slots 664-2 of plug assembly 616-2 along co-axis of rotation 638 for driving engagement therewith around co-axis of rotation 638.

Thus, split driver 652 has direct radial support relative to co-axis of rotation 638 provided only by the distal end 624-1 of plug assembly 616-1 of first lock cylinder 610-1 and the distal end 624-2 of plug assembly 616-2 of second lock cylinder 610-2. In turn, cam 656 has direct radial support relative to co-axis of rotation 638 provided only by split driver 652. In other words, cam 656 is not directly supported by housing 632 relative to co-axis of rotation 638.

Referring to FIG. 64, when a key, e.g., key 160, is inserted into plug assembly 616-1 of first lock cylinder 610-1, split driver 652 is moved laterally along co-axis of rotation 638 to position first drive portion 652-1 of split driver 652 in driving engagement with cam 656 in opening 658 of cam 656, and simultaneously second drive portion 652-2 of split driver 652 is positioned to be out of driving engagement with cam 656, i.e., second drive portion 652-2 is slid through opening 658 of cam 656 to be completely outside the driven portion, e.g., slots 658-2, 658-3, of cam 656. Movement of split driver 652 laterally along co-axis of rotation 638 may be effected, for example, by direct contact with the tip of key 160 as the key 160 is fully inserted into keyway 626-1 of plug assembly 616-1.

Likewise, (see also FIGS. 66 and 67) when a key, e.g., key 160, is inserted into plug assembly 616-2 of second lock cylinder 610-2, split driver 652 is moved laterally along co-axis of rotation 638 to position second drive portion 652-2 of split driver 652 in driving engagement with cam 656 in opening 658 of cam 656, and simultaneously first drive portion 652-1 of split driver 652 is positioned to be out of driving engagement with cam 656, i.e., first drive portion 652-1 is slid through opening 658 of cam 656 to be completely outside the driven portion, e.g., slots 658-2, 658-3, of cam 656. Movement of split driver 652 laterally along co-axis of rotation 638 may be effected, for example, by direct contact with the tip of the key 160 as the key 160 is fully inserted into keyway 626-2 of plug assembly 616-2.

When rekeyable lock cylinder assembly 606 is inserted into opening 504 of mortise lock 500 (see FIG. 56), cam 656 (see FIGS. 62, 63 and 66) may be engaged with a linking device (not shown) to selectively operate bolt 502 of mortise lock 500.

The above-described embodiments, of course, are not to be construed as limiting the breadth of the present invention. Modifications and other alternative constructions will be apparent that are within the spirit and scope of the invention as defined in the appended claims.

The invention claimed is:

1. A rekeyable lock cylinder assembly, comprising:

(a) at least one lock cylinder, each lock cylinder including:

a cylinder body with a longitudinal axis;

a locking bar disposed in the cylinder body for movement transverse to, and rotationally about, the longitudinal axis;

a plug assembly disposed in the cylinder body and being rotatable about the longitudinal axis, the plug assembly having a lock face with a tool receiving aperture, and having a proximal end and a distal end separated from the proximal end with the proximal end being located nearest to the lock face;

a plurality of pins and a corresponding plurality of racks disposed in the plug assembly, the plurality of racks being configured to be selectively engaged with the plurality of pins; and a first member coupled to the plurality of racks, the first member being moveable in response to application of a force by a tool received through the tool receiving aperture, the first member being configured to simultaneously disengage all of the plurality of racks from the plurality of pins in response to the movement of the first member; and (b) a mortise lock adapter, including:

a housing configured with a longitudinal cavity for receiving the cylinder body of the at least one lock cylinder, the at least one lock cylinder being mounted to the housing; and a mortise lock actuator coupled to the plug assembly of the at least one lock cylinder, wherein the at least one lock cylinder comprises a first lock cylinder and a second lock cylinder, and wherein:

the housing of the mortise lock adapter has a first end spaced apart from a second end along the longitudinal cavity;

the cylinder body of the first lock cylinder is received into the longitudinal cavity of the housing at the first end;

the cylinder body of the second lock cylinder is received into the longitudinal cavity of the housing at the second end;

the mortise lock actuator includes a split driver and a cam, the cam having an opening that receives the split driver in a sliding relationship, the split driver having a first drive portion rotatably coupled to a second drive portion;

the distal end of the plug assembly of the first lock cylinder being configured and positioned to drivably engage the first drive portion of the split driver; and the distal end of the plug assembly of the second lock cylinder is configured and positioned to drivably engage the second drive portion of the split driver, wherein:

the longitudinal cavity of the housing defines a co-axis of rotation corresponding to the longitudinal axis of the plug assembly of the first lock cylinder and to the longitudinal axis of the plug assembly of the second lock cylinder;

the cam has direct radial support relative to the co-axis provided only by the split driver; and the split driver has direct radial support relative to the co-axis provided only by the distal end of the plug assembly of the first lock cylinder and the distal end of the plug assembly of the second lock cylinder.

2. The rekeyable lock cylinder assembly of claim 1, wherein the plug assembly of the first lock cylinder has a first keyway for receiving a key, and wherein when the key is inserted into the plug assembly of the first lock cylinder, the split driver is moved along the co-axis to position the first drive portion of the split driver in driving engagement with the cam in the opening of the cam, and simultaneously the second drive portion of the split driver is positioned to be out of driving engagement with the cam.

3. The rekeyable lock cylinder assembly of claim 1, wherein the plug assembly of the second lock cylinder has a second keyway for receiving a key, and wherein when the key is inserted into the plug assembly of the second lock cylinder, the split driver is moved along the co-axis to position the second drive portion of the split driver in driving engagement with the cam in the opening of the cam, and simultaneously the first drive portion of the split driver is positioned to be out of driving engagement with the cam.

4. A rekeyable lock cylinder assembly, comprising:

(a) at least one lock cylinder, each lock cylinder including:

a cylinder body with a longitudinal axis;

a locking bar disposed in the cylinder body for movement transverse to, and rotationally about, the longitudinal axis;

a plug assembly disposed in the cylinder body and being rotatable about the longitudinal axis, the plug assembly having a lock face with a tool receiving aperture, and having a proximal end and a distal end separated from the proximal end with the proximal end being located nearest to the lock face;

a plurality of pins and a corresponding plurality of racks disposed in the plug assembly, the plurality of racks being configured to be selectively engaged with the plurality of pins; and a first member coupled to the plurality of racks, the first member being moveable in response to application of a force by a tool received through the tool receiving aperture, the first member being configured to simultaneously disengage all of the plurality of racks from the plurality of pins in response to the movement of the first member; and (b) a mortise lock adapter, including:

a housing configured with a longitudinal cavity for receiving the cylinder body of the at least one lock cylinder, the at least one lock cylinder being mounted to the housing; and a mortise lock actuator coupled to the plug assembly of the at least one lock cylinder, wherein the at least one lock cylinder comprises a first lock cylinder and a second lock cylinder, and wherein:

the housing has a first end spaced apart from a second end along the longitudinal cavity, the housing having a longitudinal slot parallel to and adjacent to the longitudinal cavity, and the housing having a cam slot that extends perpendicular to the extent of the longitudinal cavity and the longitudinal slot in a central portion of the housing;

the mortise lock actuator includes a split driver and a cam, the cam having an opening that receives the split driver in a sliding relationship, the split driver having a first drive portion rotatably coupled to a second drive portion;

the cylinder body of the first lock cylinder is received into the longitudinal cavity of the housing at the first end, and the cylinder body of the second lock cylinder is received into the longitudinal cavity of the housing at the second end, the longitudinal cavity of the housing defining a co-axis of rotation of the plug assembly of the first lock cylinder and the plug assembly of the second lock cylinder;

the distal end of the plug assembly of the first lock cylinder being configured and positioned to drivably engage the first drive portion of the split driver, and the distal end of the plug assembly of the second lock cylinder being configured and positioned to drivably engage the second drive portion of the split driver; and an elongate member configured for insertion into the longitudinal slot of the housing, the elongate member having mounting features for engaging the first lock cylinder and the second lock cylinder to hold the first lock cylinder and the second lock cylinder in the housing at a fixed location when the elongate member is mounted in the longitudinal slot.

5. The rekeyable lock cylinder assembly of claim 4, further comprising:

a first spring interposed between the distal end of the plug assembly of the first lock cylinder and the first drive portion of the split driver; and a second spring interposed between the distal end of the plug assembly of the second lock cylinder and the second drive portion of the split driver.

6. The rekeyable lock cylinder assembly of claim 4, wherein:

direct radial support of the cam relative to the co-axis is provided only by the split driver; and direct radial support of the split driver relative to the co-axis is provided only by the distal end of the plug assembly of the first lock cylinder and the distal end of the plug assembly of the second lock cylinder.

7. A rekeyable lock cylinder assembly, comprising:

(a) a first lock cylinder and a second lock cylinder, each of the first lock cylinder and the second lock cylinder including a cylinder body with a longitudinal axis, and a plug assembly disposed in the cylinder body and being rotatable about the longitudinal axis, the plug assembly having a lock face, and having a proximal end and a distal end separated from the proximal end with the proximal end being located nearest to the lock face; and (b) a mortise lock adapter, including a housing having a longitudinal cavity defining a co-axis of rotation for the first lock cylinder and the second lock cylinder, with each of the first lock cylinder and the second lock cylinder being received in the longitudinal cavity, the housing having a cam slot located in a central portion of the housing; and a mortise lock actuator having a split driver and a cam, the cam having an opening that receives the split driver in a sliding relationship, the split driver having a first drive portion rotatably coupled to a second drive portion, the split driver being positioned to be engaged by the first lock cylinder and the second lock cylinder, the cam being configured to extend through the cam slot of the housing, and wherein:

direct radial support of the cam relative to the co-axis of rotation is provided only by the split driver; and direct radial support of the split driver relative to the co-axis of rotation is provided only by the distal end of the plug assembly of the first lock cylinder and the distal end of the plug assembly of the second lock cylinder.

8. The rekeyable lock cylinder assembly of claim 7, wherein the distal end of the plug assembly of the first lock cylinder is configured and positioned to drivably engage the first drive portion of the split driver, and the distal end of the plug assembly of the second lock cylinder is configured and positioned to drivably engage the second drive portion of the split driver.

9. The rekeyable lock cylinder assembly of claim 8, wherein the plug assembly of the first lock cylinder has a first keyway for receiving a key, and wherein when the key is inserted into the plug assembly of the first lock cylinder, the split driver is moved along the co-axis of rotation to position the first drive portion of the split driver in driving engagement with the cam in the opening of the cam, and simultaneously the second drive portion of the split driver is positioned to be out of driving engagement with the cam.

10. The rekeyable lock cylinder assembly of claim 8 wherein the plug assembly of the second lock cylinder has a second keyway for receiving a key, and wherein when the key is inserted into the plug assembly of the second lock cylinder, the split driver is moved along the co-axis of rotation to position the second drive portion of the split driver in driving engagement with the cam in the opening of the cam, and simultaneously the first drive portion of the split driver is positioned to be out of driving engagement with the cam.

11. The rekeyable lock cylinder assembly of claim 8, further comprising:

a first spring interposed between the distal end of the plug assembly of the first lock cylinder and the first drive portion of the split driver; and a second spring interposed between the distal end of the plug assembly of the second lock cylinder and the second drive portion of the split driver, wherein the first spring and the second spring are configured to bias the split driver to be centered in the cam.

12. The rekeyable lock cylinder assembly of claim 7, wherein the mortise lock adapter further includes:

the housing having a longitudinal slot parallel to and adjacent to the longitudinal cavity, the cam slot extending perpendicular to the extent of the longitudinal cavity and the longitudinal slot in the central portion of the housing; and an elongate member configured for insertion into the longitudinal slot of the housing, the elongate member having mounting features configured to engage each of the first lock cylinder and the second lock cylinder to hold the first lock cylinder and the second lock cylinder in the housing at a fixed location when the elongate member is mounted in the longitudinal slot.

13. A rekeyable lock cylinder assembly, comprising:

(a) a first lock cylinder and a second lock cylinder, each of the first lock cylinder and the second lock cylinder including a cylinder body with a longitudinal axis, and a plug assembly disposed in the cylinder body and being rotatable about the longitudinal axis, the plug assembly having a lock face, and having a proximal end and a distal end separated from the proximal end with the proximal end being located nearest to the lock face; and (b) a mortise lock adapter, including:

a housing having a longitudinal cavity, and a first end spaced apart from a second end along the longitudinal cavity, the housing having a longitudinal slot parallel to and adjacent to the longitudinal cavity, and the housing having a cam slot that extends perpendicular to the extent of the longitudinal cavity and the longitudinal slot in a central portion of the housing;

a mortise lock actuator that includes a split driver and a cam, the cam having an opening that receives the split driver in a sliding relationship, the split driver having a first drive portion rotatably coupled to a second drive portion, the cam being inserted through the cam slot of the housing into the longitudinal cavity, and the split driver being inserted along the longitudinal cavity into the opening in the cam; and an elongate member configured for insertion into the longitudinal slot of the housing, the elongate member having mounting features configured to engage each of the first lock cylinder and the second lock cylinder to hold the first lock cylinder and the second lock cylinder in the housing at a fixed location when the elongate member is mounted in the longitudinal slot.

14. The rekeyable lock cylinder assembly of claim 13, wherein:

the cylinder body of the first lock cylinder is received into the longitudinal cavity of the housing at the first end, and the cylinder body of the second lock cylinder is received into the longitudinal cavity of the housing at the second end, the longitudinal cavity of the housing defining a co-axis of rotation of the plug assembly of the first lock cylinder and the plug assembly of the second lock cylinder;

the distal end of the plug assembly of the first lock cylinder is configured and positioned to drivably engage the first drive portion of the split driver; and the distal end of the plug assembly of the second lock cylinder is configured and positioned to drivably engage the second drive portion of the split driver.

15. The rekeyable lock cylinder assembly of claim 14, further comprising:

a first spring interposed between the distal end of the plug assembly of the first lock cylinder and the first drive portion of the split driver; and a second spring interposed between the distal end of the plug assembly of the second lock cylinder and the second drive portion of the split driver, wherein the first spring and the second spring are configured to bias the split driver to be centered in the cam.

16. The rekeyable lock cylinder assembly of claim 14, wherein:

direct radial support of the cam relative to the co-axis of rotation is provided only by the split driver; and direct radial support of the split driver relative to the co-axis is provided only by the distal end of the plug assembly of the first lock cylinder and the distal end of the plug assembly of the second lock cylinder.

17. A method for assembling a rekeyable lock cylinder assembly, comprising:

providing a housing that has a first end spaced apart from a second end along a longitudinal cavity, the housing having a longitudinal slot parallel to and adjacent to the longitudinal cavity, and the housing having a cam slot that extends perpendicular to the extent of the longitudinal cavity and the longitudinal slot in a central portion of the housing;

inserting a cam through the cam slot of the housing into the longitudinal cavity, the cam having an opening;

inserting a split driver along the longitudinal cavity into the opening in the cam, the opening receiving the split driver in a sliding relationship, the split driver having a first drive portion rotatably coupled to a second drive portion;

inserting a cylinder body of a first lock cylinder into the longitudinal cavity of the housing at the first end;

inserting a cylinder body of a second lock cylinder into the longitudinal cavity of the housing at the second end, the longitudinal cavity of the housing defining a co-axis of rotation of the plug assembly of the first lock cylinder and the plug assembly of the second lock cylinder;

engaging a distal end of a plug assembly of the first lock cylinder with the first drive portion of the split driver;

engaging a distal end of a plug assembly of the second lock cylinder with the second drive portion of the split driver;

inserting an elongate member into the longitudinal slot of the housing, the elongate member having mounting features configured to engage each of the first lock cylinder and the second lock cylinder to hold the first lock cylinder and the second lock cylinder in the housing at a fixed location when the elongate member is inserted into the longitudinal slot; and fastening the elongate member to the housing.

18. The method of claim 17, further comprising:

interposing a first spring between the distal end of the plug assembly of the first lock cylinder and the first drive portion of the split driver; and interposing a second spring between the distal end of the plug assembly of the second lock cylinder and the second drive portion of the split driver, wherein the first spring and the second spring are configured to bias the split driver to be centered in the cam.

19. The method of claim 17, wherein:

direct radial support of the cam relative to the co-axis of rotation is provided only by the split driver; and direct radial support of the split driver relative to the co-axis of rotation is provided only by the distal end of the plug assembly of the first lock cylinder and the distal end of the plug assembly of the second lock cylinder.

* * * * *